US009005409B2

(12) United States Patent
Guarnaccia et al.

(10) Patent No.: US 9,005,409 B2
(45) Date of Patent: Apr. 14, 2015

(54) ELECTRO CHEMICAL DEPOSITION AND REPLENISHMENT APPARATUS

(75) Inventors: David Guarnaccia, Carlisle, MA (US); Arthur Keigler, Wellesley, MA (US); Demetrius Papapanayiotou, Westford, MA (US); Johannes Chiu, Bedford, MA (US)

(73) Assignee: Tel Nexx, Inc., Billerica, MA (US)

( * ) Notice: Subject to any disclaimer, the term of this patent is extended or adjusted under 35 U.S.C. 154(b) by 198 days.

(21) Appl. No.: 13/445,457

(22) Filed: Apr. 12, 2012

(65) Prior Publication Data

US 2012/0298504 A1 Nov. 29, 2012

Related U.S. Application Data

(63) Continuation-in-part of application No. 13/445,217, filed on Apr. 12, 2012.

(60) Provisional application No. 61/475,417, filed on Apr. 14, 2011.

(51) Int. Cl.

| | |
|---|---|
| ***C25D 17/02*** | (2006.01) |
| ***C25D 21/22*** | (2006.01) |
| ***C25D 17/00*** | (2006.01) |
| *C25D 7/12* | (2006.01) |

(52) U.S. Cl.

CPC ..... *C25D 21/22* (2013.01); *C25D 17/001* (2013.01); *C25D 17/002* (2013.01); *C25D 7/123* (2013.01)

(58) Field of Classification Search

None

See application file for complete search history.

(56) References Cited

U.S. PATENT DOCUMENTS

| | | | |
|---|---|---|---|
| 3,072,545 | A | 1/1963 | Walter et al. |
| 3,658,470 | A | 4/1972 | Zievers et al. |
| 4,118,295 | A | 10/1978 | Korenowski et al. |
| 4,469,564 | A | 9/1984 | Okinaka et al. |

(Continued)

FOREIGN PATENT DOCUMENTS

| | | |
|---|---|---|
| EP | 471577 | 2/1992 |
| EP | 690934 | 6/1998 |

(Continued)

OTHER PUBLICATIONS

"Couple", http://dictionary.reference.com/browse/coupled, accessed on Jul. 8, 2014.*

(Continued)

*Primary Examiner* — Harry D Wilkins, III

(74) *Attorney, Agent, or Firm* — Rothwell, Figg, Ernst & Manbeck, P.C.

(57) ABSTRACT

An electrochemical deposition apparatus adapted to deposit metal onto a surface of a substrate, the apparatus has a frame configured for holding a process electrolyte. A substrate holder is removably coupled to the frame, the substrate holder supporting the substrate in the process electrolyte. An anode fluid compartment is removably coupled to the frame and containing an anolyte and having an anode facing the surface of the substrate, the anode fluid compartment further having a ion exchange membrane disposed between the anode and the surface of the substrate, the anode fluid compartment removable from the frame as a unit with the ion exchange membrane and the anode. The holder, the anode and the membrane are arranged in the frame so that ions from the anode pass through the ion exchange membrane into and primarily replenish ions in the process electrolyte depleted by ion deposition onto the surface of the substrate.

30 Claims, 22 Drawing Sheets

(56) References Cited

U.S. PATENT DOCUMENTS

| | | | | |
|---|---|---|---|---|
| 4,565,609 | A | 1/1986 | Nobel et al. | |
| 4,778,572 | A | 10/1988 | Brown | |
| 4,789,439 | A | 12/1988 | Bunk et al. | |
| 4,789,444 | A | 12/1988 | Watanabe et al. | |
| 4,832,812 | A | 5/1989 | Brown | |
| 4,877,498 | A | 10/1989 | Fukuda et al. | |
| 4,906,340 | A | 3/1990 | Brown | |
| 5,039,576 | A | 8/1991 | Wilson | |
| 5,112,447 | A | 5/1992 | Gestaut et al. | |
| 5,162,079 | A | 11/1992 | Brown | |
| 5,173,170 | A | 12/1992 | Brown et al. | |
| 5,186,811 | A | 2/1993 | Otani et al. | |
| RE34,191 | E | 3/1993 | Brown | |
| 5,384,017 | A | 1/1995 | Lumbroso | |
| 5,478,445 | A | 12/1995 | Barker et al. | |
| 5,593,557 | A | 1/1997 | Sopher et al. | |
| 5,804,053 | A | 9/1998 | Vaccaro et al. | |
| 5,883,762 | A | 3/1999 | Calhoun et al. | |
| 5,997,712 | A | 12/1999 | Ting et al. | |
| 6,099,713 | A | 8/2000 | Yanada et al. | |
| 6,210,556 | B1 | 4/2001 | Toben et al. | |
| 6,251,255 | B1 | 6/2001 | Copping et al. | |
| 6,261,433 | B1 | 7/2001 | Landau | |
| 6,277,263 | B1 | 8/2001 | Chen | |
| 6,299,753 | B1 | 10/2001 | Chao et al. | |
| 6,365,017 | B1 * | 4/2002 | Hongo et al. | 204/212 |
| 6,368,475 | B1 | 4/2002 | Hanson et al. | |
| 6,379,520 | B1 | 4/2002 | Kuriyama et al. | |
| 6,503,375 | B1 | 1/2003 | Maydan et al. | |
| 6,527,920 | B1 | 3/2003 | Mayer et al. | |
| 6,531,039 | B2 | 3/2003 | Kohut | |
| 6,576,110 | B2 | 6/2003 | Maydan | |
| 6,607,653 | B1 | 8/2003 | Tsuji et al. | |
| 6,632,335 | B2 | 10/2003 | Kunisawa et al. | |
| 6,660,137 | B2 | 12/2003 | Wilson et al. | |
| 6,793,794 | B2 | 9/2004 | Hongo et al. | |
| 6,875,331 | B2 | 4/2005 | Herchen | |
| 6,878,258 | B2 | 4/2005 | Kovarsky | |
| 6,878,368 | B2 | 4/2005 | Ohta et al. | |
| 6,890,416 | B1 | 5/2005 | Mayer et al. | |
| 6,923,899 | B2 | 8/2005 | Brown et al. | |
| 7,012,333 | B2 | 3/2006 | Shimoyama et al. | |
| RE39,123 | E | 6/2006 | Kuriyama et al. | |
| 7,128,823 | B2 | 10/2006 | Yang et al. | |
| 7,151,049 | B2 | 12/2006 | Beica et al. | |
| 7,195,702 | B2 | 3/2007 | Bokisa, Sr. et al. | |
| 7,247,222 | B2 | 7/2007 | Yang et al. | |
| 7,264,698 | B2 | 9/2007 | Hanson et al. | |
| 7,264,704 | B2 | 9/2007 | Nevosi et al. | |
| 7,273,535 | B2 | 9/2007 | Kovarsky et al. | |
| 7,351,314 | B2 | 4/2008 | Klocke et al. | |
| 7,351,315 | B2 | 4/2008 | Klocke et al. | |
| 7,387,717 | B2 | 6/2008 | Kunisawa et al. | |
| 7,387,964 | B2 | 6/2008 | So et al. | |
| 7,393,439 | B2 | 7/2008 | McHugh et al. | |
| 7,402,227 | B2 | 7/2008 | Yoshioka et al. | |
| 7,427,338 | B2 | 9/2008 | Dordi et al. | |
| 7,585,398 | B2 | 9/2009 | Hanson et al. | |
| 7,628,898 | B2 | 12/2009 | Klocke et al. | |
| 7,713,859 | B2 | 5/2010 | Richardson et al. | |
| 7,794,573 | B2 | 9/2010 | Klocke | |
| 8,012,332 | B2 | 9/2011 | Yoshioka et al. | |
| 8,029,653 | B2 | 10/2011 | Yamamoto et al. | |
| 2002/0027080 | A1 | 3/2002 | Yoshioka et al. | |
| 2002/0032499 | A1 | 3/2002 | Wilson et al. | |
| 2003/0000844 | A1 * | 1/2003 | Carl et al. | 205/183 |
| 2003/0201170 | A1 | 10/2003 | Gandikota et al. | |
| 2003/0201184 | A1 | 10/2003 | Dordi et al. | |
| 2004/0000491 | A1 | 1/2004 | Kovarsky et al. | |
| 2004/0016647 | A1 | 1/2004 | Yang et al. | |
| 2004/0026255 | A1 | 2/2004 | Kovarsky et al. | |
| 2004/0065543 | A1 | 4/2004 | Kovarsky | |
| 2004/0134775 | A1 | 7/2004 | Yang et al. | |
| 2005/0009260 | A1 | 1/2005 | Kim et al. | |
| 2005/0092601 | A1 | 5/2005 | Herchen | |
| 2005/0092602 | A1 | 5/2005 | Herchen | |
| 2005/0121317 | A1 * | 6/2005 | Klocke et al. | 204/252 |
| 2005/0133364 | A1 * | 6/2005 | Leonida | 204/279 |
| 2005/0167275 | A1 | 8/2005 | Keigler et al. | |
| 2005/0173253 | A1 | 8/2005 | Huang | |
| 2006/0102467 | A1 | 5/2006 | Herchen et al. | |
| 2006/0108228 | A1 | 5/2006 | Kovarsky et al. | |
| 2006/0113006 | A1 | 6/2006 | Masuda et al. | |
| 2006/0157355 | A1 | 7/2006 | Baskaran et al. | |
| 2006/0237323 | A1 | 10/2006 | Baskaran et al. | |
| 2007/0037005 | A1 | 2/2007 | Heber et al. | |
| 2007/0037377 | A1 | 2/2007 | Richardson et al. | |
| 2007/0068819 | A1 * | 3/2007 | Singh et al. | 205/83 |
| 2007/0068820 | A1 | 3/2007 | Baskaran et al. | |
| 2007/0246350 | A1 | 10/2007 | Togashi | |
| 2008/0105555 | A1 | 5/2008 | Iwazaki | |
| 2008/0217182 | A1 | 9/2008 | Dai | |
| 2008/0245669 | A1 * | 10/2008 | Yoshioka et al. | 205/210 |
| 2010/0038255 | A1 | 2/2010 | Lee et al. | |
| 2010/0206735 | A1 | 8/2010 | Wurm et al. | |
| 2011/0031112 | A1 | 2/2011 | Birang et al. | |
| 2011/0073483 | A1 | 3/2011 | Hafezi et al. | |
| 2011/0226614 | A1 | 9/2011 | Rash et al. | |
| 2013/0081941 | A1 | 4/2013 | Yoshioka et al. | |
| 2013/0112563 | A1 | 5/2013 | Tomantschger et al. | |

FOREIGN PATENT DOCUMENTS

| | | |
|---|---|---|
| GB | 293648 | 10/1972 |
| JP | 51044527 | 4/1976 |
| JP | 63216998 | 9/1988 |
| JP | 2239611 | 9/1990 |
| JP | 3039500 | 6/1991 |
| JP | 5179496 | 7/1993 |
| JP | 5302199 | 11/1993 |
| JP | 6158397 | 6/1994 |
| JP | 6280098 | 10/1994 |
| JP | 6336700 | 12/1994 |
| JP | 7108458 | 4/1995 |
| JP | 7211669 | 8/1995 |
| JP | 7236827 | 9/1995 |
| JP | 7300699 | 11/1995 |
| JP | 2070087 | 7/1996 |
| JP | 9165699 | 6/1997 |
| JP | 9509222 | 9/1997 |
| JP | 10116758 | 5/1998 |
| JP | 10121297 | 5/1998 |
| JP | 10199814 | 7/1998 |
| JP | 10204695 | 8/1998 |
| JP | 03039500 | 5/2000 |
| JP | 2000160390 | 6/2000 |
| JP | 2000160399 | 6/2000 |
| JP | 2000219993 | 8/2000 |
| JP | 2006322069 | 11/2006 |
| WO | WO9015171 | 12/1990 |
| WO | WO9925902 | 5/1999 |

OTHER PUBLICATIONS

"Couple", http://www.google.com/search?q=coupled, accessed on Jul. 8, 2014.*

International Search Report issued Jul. 16, 2012 in PCT/US12/33422 filed Apr. 13, 2012.

Written Opinion issued Jul. 16, 2012 in PCT/US12/33422 filed Apr. 13, 2012.

U.S. Office Action mailed Mar. 14, 2014 in co-pending U.S. Appl. No. 13/445,217, filed Apr. 12, 2012 (22 pages).

Notification of Transmittal (PCT/ISA/220), International Search Report (PCT/ISA/210), and Written Opinion (PCT/ISA/237), mailed Jan. 21, 2015 in corresponding PCT/US 14/63828 (8 pages).

* cited by examiner

ELECTRO CHEMICAL DEPOSITION AND REPLENISHMENT APPARATUS

CROSS-REFERENCE TO RELATED APPLICATIONS

This application claims the benefits of and priority to U.S. Provisional Patent Application Ser. No. 61/475,417 filed on Apr. 14, 2011, entitled "ELECTRO OSMOSIS CHEMICAL PRODUCTIVITY APPARATUS AND METHOD FOR ELECTRO DEPOSITION", U.S. patent application Ser. No. 13/445,217, filed on Apr. 12, 2012, entitled "ELECTRO CHEMICAL DEPOSITION AND REPLENISHMENT APPARATUS", the disclosures of which are incorporated herein by reference in their entireties.

1. FIELD

The disclosed embodiment relates generally to a method and apparatus for electro chemical deposition, and more particularly to a method and apparatus for electro chemical deposition and replenishment.

2. BRIEF DESCRIPTION OF RELATED DEVELOPMENTS

Electro deposition, among other processes, is used as a manufacturing technique for the application of films, for example, tin, tin silver, nickel, copper or otherwise to various structures and surfaces, such as semiconductor wafers and silicon work pieces or substrates. An important feature of systems used for such processes is their ability to produce films with uniform and repeatable characteristics such as film thickness, composition, and profile relative to the underlying workpiece profile. Electro deposition systems may utilize a primary electrolyte that requires replenishment upon depletion. By way of example, in tin silver applications a tin salt solution liquid replenishment may be required upon depletion. Such replenishment may be expensive as a function of the application and may require significant down time of the electro deposition tool or sub module for service and process re qualification that adversely affects the cost of ownership of the deposition tool. Accordingly, there is a desire for new and improved methods and apparatus for replenishment of depleted process electrolyte in electro deposition tools.

BRIEF DESCRIPTION OF THE DRAWINGS

The foregoing aspects and other features of the disclosed embodiment are explained in the following description, taken in connection with the accompanying drawings, wherein.

DETAILED DESCRIPTION OF THE EXEMPLARY EMBODIMENT (s)

Figure 1:
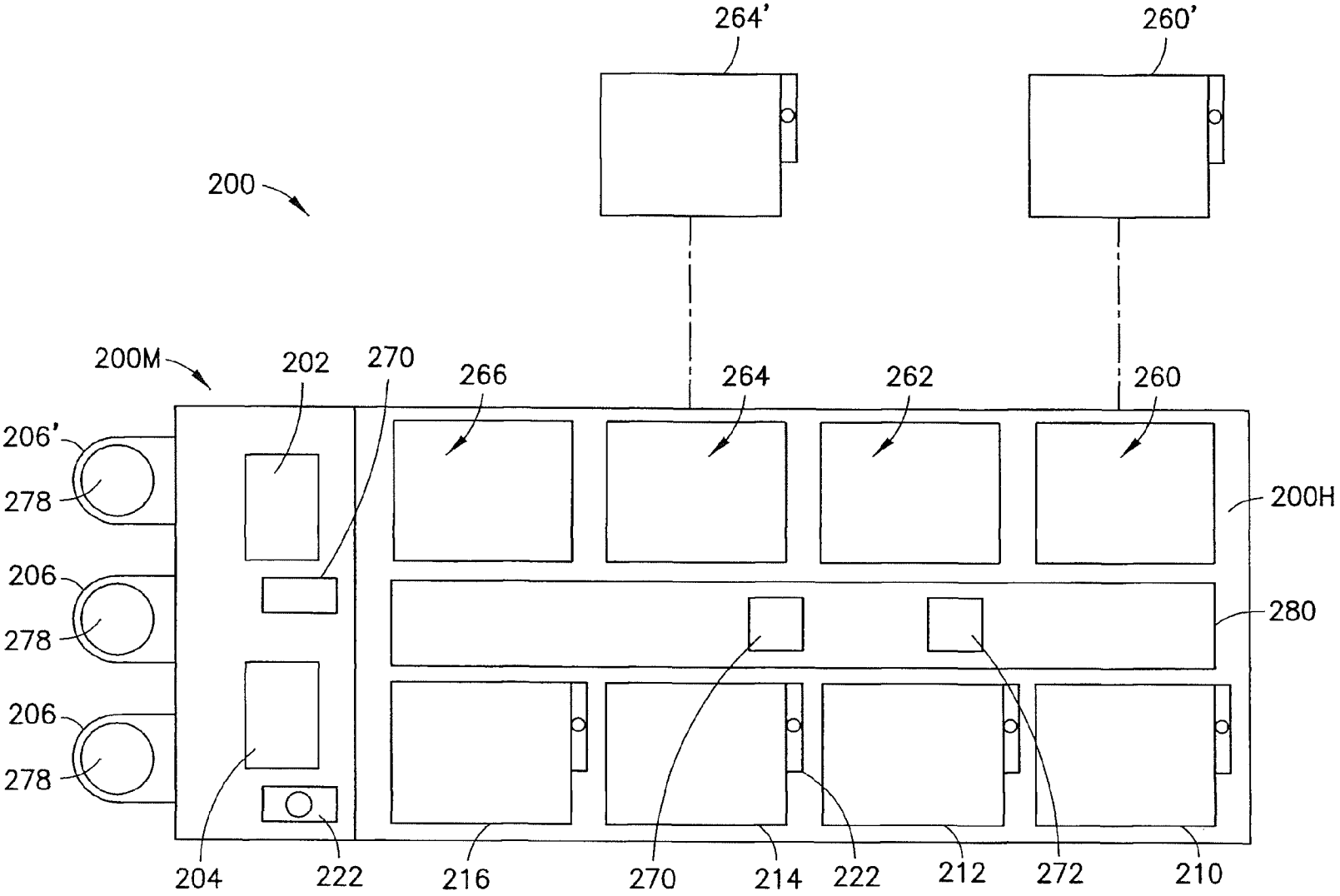
FIG. 1 shows an exemplary wafer electro-deposition system.

Referring now to FIG. 1, there is shown a commercial wafer electro-deposition machine suitable for a manufacturing process in accordance with an aspect of the disclosed embodiment. Although the aspects of the disclosed embodiment will be described with reference to the drawings, it should be understood that the aspects of the disclosed embodiment can be embodied in many forms. In addition, any suitable size, shape or type of elements or materials could be used. The disclosed embodiment may be implemented in a commercially available electrodeposition machine such as the Stratus from NEXX Systems in Billerica Mass. System 200 may incorporate features as disclosed in the International Application WO 2005/042804 A2 published under the Patent Cooperation Treaty and having publication date May 12, 2005 and as disclosed in U.S. Publication No. 2005/0167275 published Aug. 14, 2005 and entitled method and apparatus for fluid processing a workpiece, both of which are hereby incorporated by reference herein in their entirety. System 200 is shown in block diagram form as an exemplary system. In accordance with another aspect of the disclosed embodiment, more or less modules may be provided having different configurations and locations. System 200 may include the industrial electrodeposition machine 200M, that may contain load ports 206 by which substrates, for example, previously patterned with photoresist as described above are inserted and withdrawn from the system. Loading station 204 may have a robotic arm which transfers substrates 278 into substrate-holders 270, 272, 274 which are then transferred by transport 280 to modules 210, 212, 214, 216, (described in greater detail further below and also shown schematically in FIGS. 2A and 5) and processed either in parallel, in succession or in combination parallel and succession. By way of example, the process in succession or otherwise may include a copper (Cu) electrodeposition module 216, a nickel (Ni) electrodeposition module 214, a tin (Sn) electrodeposition module 212, a tin-silver (SnAg) electrodeposition module 210. Further, aspects of the disclosed embodiment may be similarly applied to a copper (Cu) electrodeposition module 216, a nickel (Ni) electrodeposition module 214, a tin (Sn) electrodeposition module 212, a tin-silver (SnAg) electrodeposition module or any suitable metal deposition module. The substrates may then be returned to the loading station 204 which unloads the substrates and passes them through a substrate cleaning module 202 from which they are returned to the load ports 206. Cleaning steps, using de-ionized water for example, may be disposed before and after the electrodeposition steps, for example, cleaning modules 262, 266 may be provided. Alternately, modules 262 and 266 may be rinse or thermal treatment modules as well as clean modules. Replenishment modules 260, 264 (identified in general in FIG. 1) may be provided, for example, resident within a common enclosure of system 200 for chemical productivity and replenishment of modules 210, 212, 214 and 216. For example, enclosure 200H may form a housing for the components and modules of system 200, with suitable environment and cleanliness controls therein. As may be realized, in the exemplary embodiment, the chemical replenishment modules may not be located within a common housing or area (similar to housing 200H) but may be located off board or remote, such as replenishment modules 260', 264' (see FIG. 1) may be provided with or without on board modules 260, 264 for replenishment of modules 210, 212, 214 and 216. Here, remote replenishment modules may be placed adjacent system 200, in a chase below system 200 or distant from system 200, for example, some distance away or in a separate room. In accordance with another aspect of the disclosed embodiment, replenishment modules may not be provided. In accordance with another aspect of the disclosed embodiment, more or less modules in more or less suitable combinations and for deposition of more or less different or similar materials may be provided in any suitable combination.

One or more controller(s) 222 may be provided and communicably coupled to each station or module to sequence the process and/or transport within the station or module. A system controller(s) 222 may be provided within the system 200 to sequence substrates between the stations or process modules and to coordinate system actions, such as, host communication, lot loading and unloading or otherwise those actions that are required to control the system 200. Controller 222 may be programmable to plate the workpiece with a suitable metal, metal alloy, and/or other plating material, for example, with one or more of tin, (Sn), Tin-Silver (SnAg), Copper (Cu), Nickel (Ni) in process module(s) disposed to accept an anode and support a plating bath. Accordingly, the controller for process module 212 may be programmed for plating Tin onto a workpiece. Controller 222 may be further programmable to rinse the workpiece in a rinse tank disposed to support rinsing substantially all of the plating chemistry from the workpiece. Controller 222 may further be programmable, for example, to plate the workpiece with tin and silver in process module 210 disposed to accept an anode and support a plating bath. Controller 222 may further be programmable, for example, to thermally treat the workpiece in a thermal treatment module disposed to thermally treat the workpiece to cause the tin and tin-silver layers to intermix and form a substantially uniform tin-silver alloy feature. Controller 222 may be further programmable, for example, to deposit copper on the workpiece with copper electrodeposition module 216. Controller 222 may further be programmable, for example, to deposit nickel on the workpiece with nickel electrodeposition module 214. Controller 222 may further be programmable to clean the workpiece with clean module 262. In the disclosed embodiment, as previously noted, four electrodeposition modules 210, 212, 214, 216, are shown and cleaning modules 262, 266, and chemical replenishment modules 260, 264 identified in the figure in a general manner for example purposes only. In accordance with another aspect of the disclosed embodiment, one system may have more or less modules disposed in any suitable configuration. By way of example, system 200 may have tin (Sn) electrodeposition module(s) and tin-silver (SnAg) electrodeposition module(s) with the chemistry being replenished from one or more remote or off board from apparatus 200M (e.g. one or more chemistry replenishment or productivity modules 260', 264' are shown in FIG. 1 for example purposes only, though more or fewer may be provided. As previously noted, the apparatus may also include one or more onboard, for example, resident with the apparatus, chemistry replenishment or productivity modules. As a further example, separate tools (not shown) having different electrodeposition module(s) may be provided. As a further example, multiple duplicate electrodeposition modules may be provided to allow multiple workpieces to be processed in parallel to increase the throughput of the system. As such, all such variations, alternatives and modifications of system configurations are embraced.

Figure 2A:
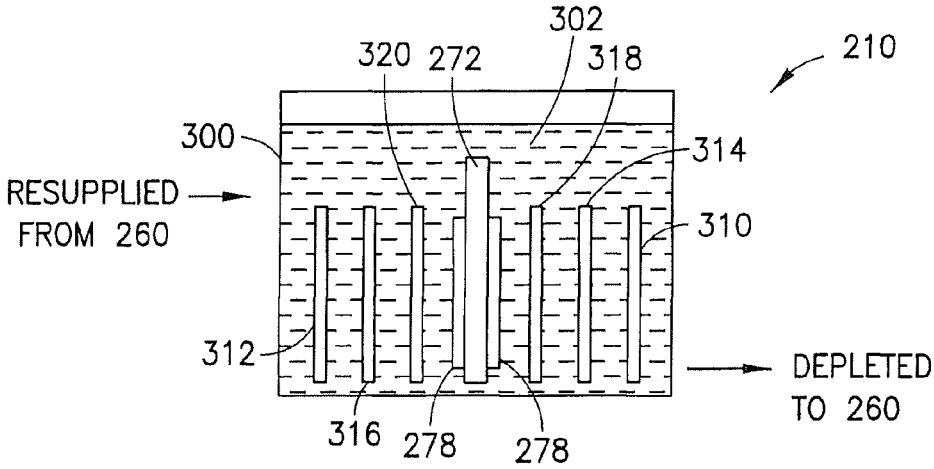
FIG. 2A shows a electro-deposition module.

Referring now also to FIG. 2A, there is shown a block diagram of an exemplary electrodeposition process module 210. Electrodeposition module 210 may, for example, incorporate features similar to modules found in Stratus tools from NEXX Systems in Billerica Mass. and may incorporate features as disclosed in the International Application WO 2005/042804 A2 published under the Patent Cooperation Treaty and having publication date May 12, 2005 and as disclosed in U.S. Publication No. 2005/0167275 published Aug. 14, 2005 and entitled method and apparatus for fluid processing a workpiece, both of which are hereby incorporated by reference herein in their entirety. Exemplary electrodeposition module 210 has housing 300 which contains fluid 302 where fluid 302 may flow through housing 300 and where fluid 302 may be a circulated electrolyte resupplied or replenished by modules such as replenishment module 260 or otherwise. Workpiece holder 272 may be removable from housing 300 by handler 280 and may hold substrates 278. Although two substrates are shown, holder 272 may hold more or less substrate(s). Anodes 310, 312 are provided with shield plates 314, 316 and paddle or fluid agitation assemblies 318 and 320. In accordance with another aspect of the disclosed embodiment, more or less assemblies may be provided. For example, a single anode may be provided. By way of further example, the anode may be part of housing 300 or shield plates 314, 316 and paddle or fluid agitation assemblies 318 and 320 may not be provided.

Figure 2B:
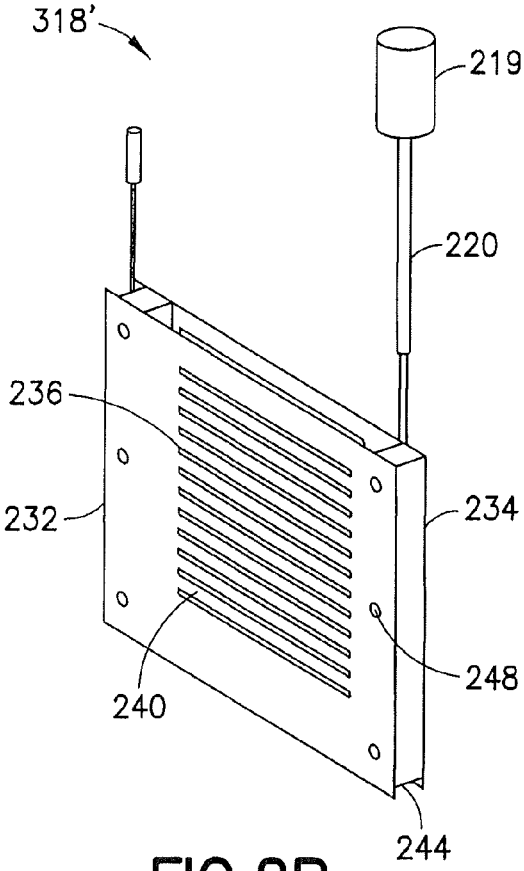
FIG. 2B shows a shear plate agitation member.
Figure 2C:
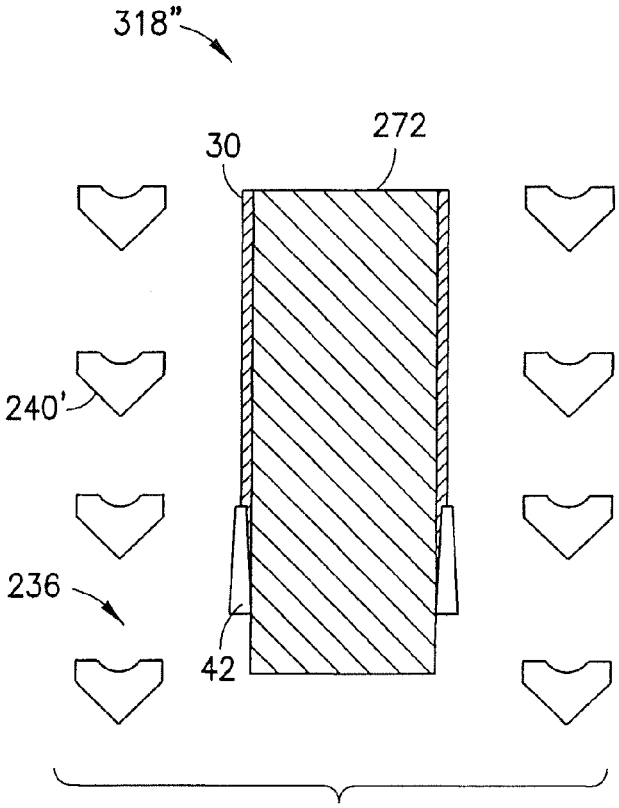
FIG. 2C shows a shear plate agitation member.
Figure 2D:
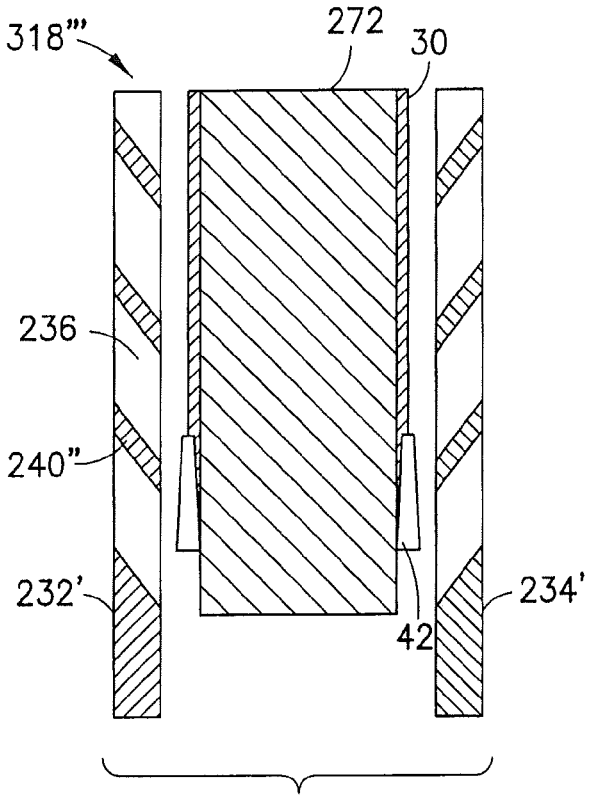
FIG. 2D shows a shear plate agitation member.
Figure 2E:
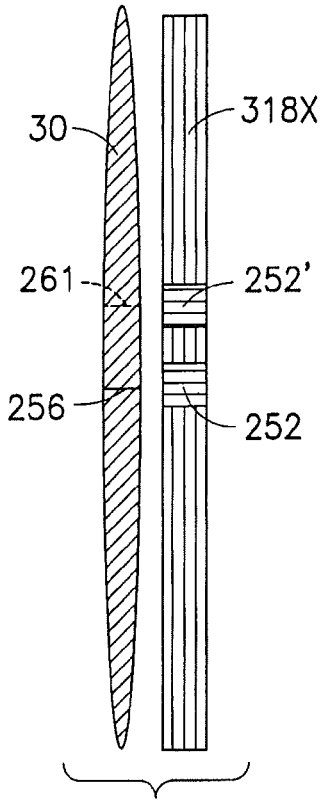
FIG. 2E shows a shear plate agitation member.
Figure 2F:
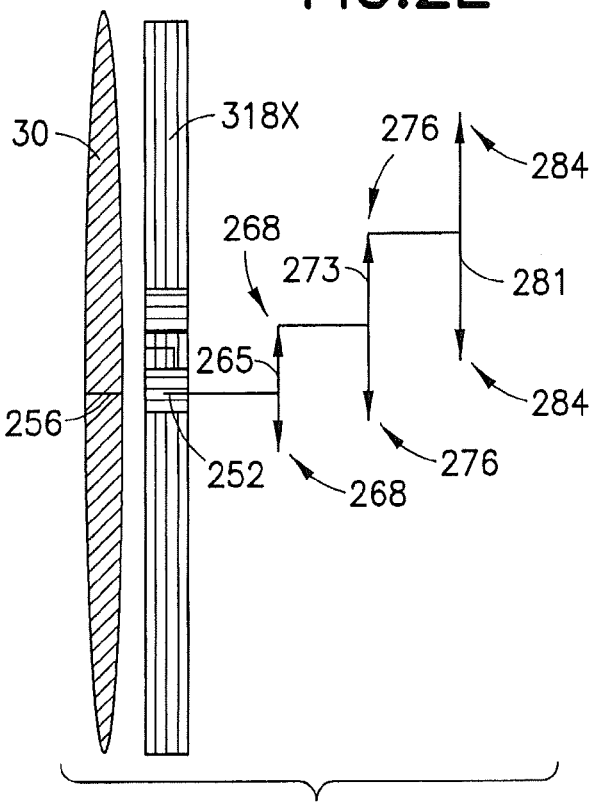
FIG. 2F shows a diagram of an oscillatory motion of a member.
Figure 2G:
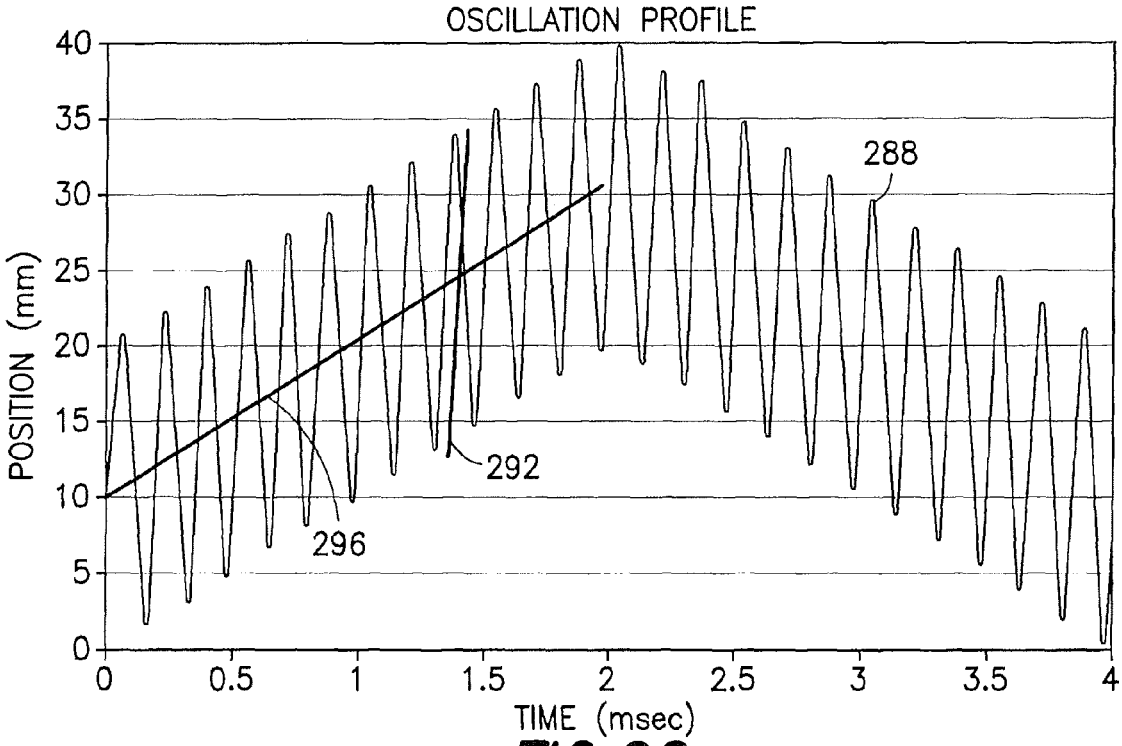
FIG. 2G shows a graph of a non uniform oscillatory motion of a member.
Figure 2H:
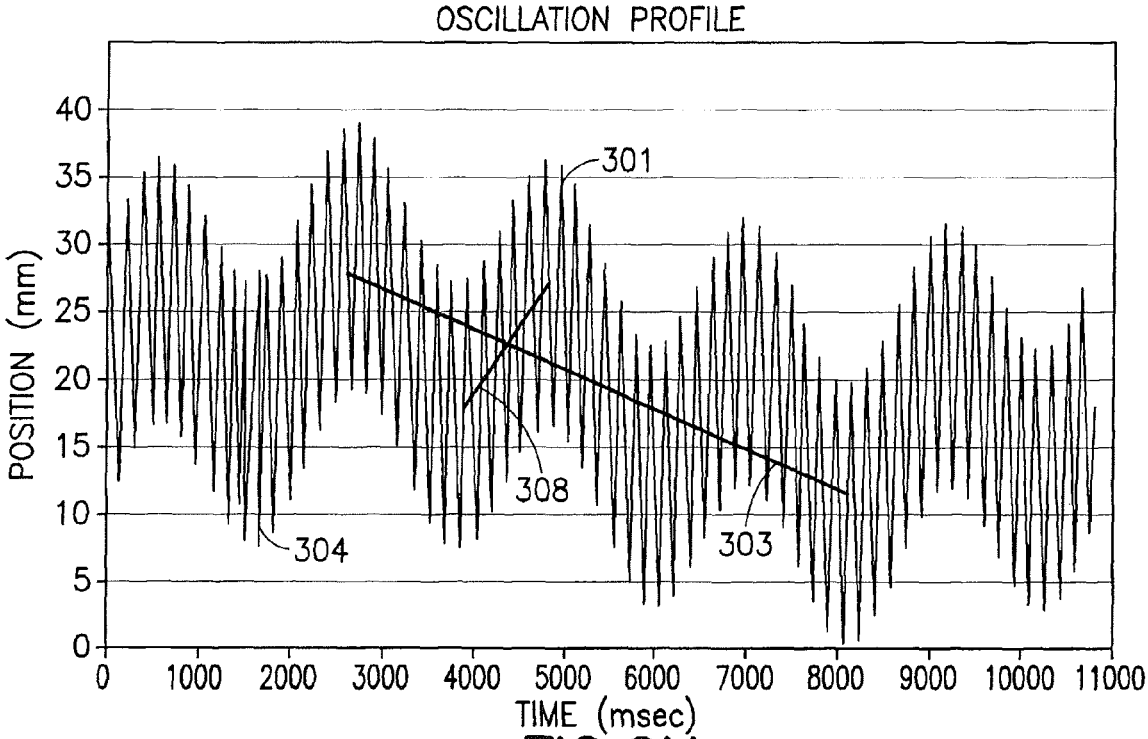
FIG. 2H shows a graph of a non uniform oscillatory motion of a member.

Referring now to FIG. 2B-2D, there is shown respectively a shear plate agitation member 318', a schematic cross section view of the shear plate agitation member 318' and another schematic cross section representation of the shear plate agitation member 318". Referring also to FIG. 2E, there is shown another schematic elevation view of a representative shear plate agitation member 318*x*, disposed in proximity to an object surface 30 subjected to fluid agitation from the agitation member as will be described further below. Referring also to FIG. 2F, there is shown a diagram of an oscillatory motion of an agitation member respect to a desired reference frame. Referring also to FIG. 2G, there is shown a graph of an exemplary non uniform oscillatory motion of a member. Referring also to FIG. 2H, there is shown a graph of a non uniform oscillatory motion of a member. The shear plate agitation member and oscillatory motion may incorporate features as in modules found in Stratus tools from NEXX Systems in Billerica Mass. and may incorporate features as disclosed in the International Application WO 2005/042804 A2 published under the Patent Cooperation Treaty and having publication date May 12, 2005 and as disclosed in U.S. Publication No. 2005/0167275 published Aug. 14, 2005 and entitled "Method and Apparatus for Fluid Processing a Workpiece", both of which are hereby incorporated by reference herein in their entirety. The shear plate agitation member and motion(s) may be utilized in any exemplary module, such as exemplary plating module 210 (see also FIG. 2A) or as disclosed below and in accordance with another aspect of the disclosed embodiment or combinations with respect to anodes, cathodes or ion exchange membranes in electro osmosis replenishment modules, for example, module 260, 260' (see also FIG. 1) or otherwise. For example, one or more shear plate agitation member(s) may be used in conjunction with one or more surface(s) of anodes, cathodes or ion exchange membranes in electro osmosis replenishment modules for agitation or otherwise, for example, to reduce clogging or fouling of such membranes or to otherwise facilitate performance of such membranes.

In various aspects of the disclosed embodiment, the member 318 may be referred to for purposes of description as a paddle assembly or a fluid agitation paddle. In one aspect of the disclosed embodiment, the member 318 is a SHEAR PLATE agitation paddle. The member 318 can be moved substantially parallel to a surface 30, for example of a workpiece being retained by the workpiece holder 272. The member 318 can be moved with a non-uniform oscillatory motion to agitate the fluid (for example a motion having a profile as illustrated in FIGS. 2F-2G). In various aspects of the disclosed embodiment, the oscillation frequency of the member 318 can be between about 0 Hz and about 20 Hz, although the frequency can be higher depending on the application. In accordance with another aspect of the disclosed embodiment, the oscillation frequency of the member 318 is between about 4 Hz and about 10 Hz. In In accordance with another aspect of the disclosed embodiment, the oscillation frequency may be about 6 Hz. In accordance with another aspect of the disclosed embodiment, the agitation paddle may be moved in a uniform oscillatory motion. Here, the member 318 may be moved by one or more motors 216. The member 204 can be connected to the motor(s) 219 using connection rods 220. Here, the motor(s) 219 may be linear drive motors or a linear motor assembly. Suitable linear motors include linear drive motors available from the LinMot Corporation in Delavan, Wis. or otherwise. In various aspects of the disclosed embodiment, the motors 219 can be fixably or removably attached to a housing. The motors 219 can be positioned on the center plane of the housing. In one aspect of the disclosed embodiment, the weight of the member 318 and the inertial forces incurred during reciprocating motion of the member 318 may supported by the linear motors via the magnetic field forces between the motor slider and the motor windings rather than by mechanical bearings. The one or more motors 219 can be computer controlled.

Referring now again to FIG. 2B, there is shown a perspective view of an exemplary embodiment of a member 318' for agitating a fluid during fluid processing of a workpiece. The member 318' may include a first plate 232 and a second plate 234. In accordance with another aspect of the disclosed embodiment, the member may have but a single plate. In the exemplary embodiment shown, each plate 232 and 234 defines a series of spaced openings 236. The shape of the spaced openings 236 can be, for example, oval or rectangular. Each plate 232 and 234 can also include a series of spaced blades 240 for agitating the fluid. The profile of the spaced blades 240 can be straight, angled, cup-shaped, or square. The center points of the series of spaced openings 236 or the series of spaced blades 240 can be positioned in a substantially equidistant periodic array. For example, the centers can be positioned with about 10 to about 30 mm between them. In one detailed embodiment, the centers are position about 20 mm apart. In one aspect of the disclosed embodiment, the series of spaced openings 236 agitates the fluid when the member 318' is moved. In one aspect of the disclosed embodiment, the series of spaced blades 240 agitates the fluid when the member 318' is moved. In one aspect of the disclosed embodiment, both the openings 236 and the blades 240 agitate the fluid. In the disclosed embodiment, an edge surface of a spaced blade 240 agitates the fluid. The plates 232 and 234 can be formed from a suitable metal, plastic, or polymer. Suitable metals include titanium, stainless steel, or aluminum. Suitable plastics include polyvinyl chloride (PVC), chlorinated PVC (CPVC), HDPE, and PVDF. In various aspects of the disclosed embodiment, either of the plates 232 and 234 can be positioned in close proximity to a surface, for example, between about 2 mm and about 10 mm from the surface of the workpiece or surface adjacent member 318', although smaller or larger distances can be used in close proximity to a surface depending on the application. As will be discussed in other aspects of the disclosed embodiment, agitation member(s) may similarly be placed adjacent other surfaces in close proximity thereto. In one aspect of the disclosed embodiment, the thickness of at least one of the plates 232 and 234 is between about 3 mm and about 6 mm, although smaller or larger distances can be used depending on the application and/or the construction of the material. Relatively thin pieces can be used so that the plate 318 can be positioned as close to the adjacent surface or workpiece as desired for suitable mixing flow against and across surface 30. The first and second plates 232 and 234 may be joined by one or more spacer features 244 and to form the member 319'. In FIG. 2B, the first and second plates 232 and 234 are shown attached to the spacer features 244 by screws 248, although other means may be used, including, but not limited to, rivets, glues, epoxies, adhesives, or outer suitable attachment means. The plates 232 and 234 and the spacer features 244 can define a cavity in which an embodiment of the workpiece holder 272 can be inserted during processing. The spacer features 244 can facilitate alignment of the member 318' to the workpiece holder 272. In various aspects of the disclosed embodiment, the member 318 or 318' can be aligned to the workpiece holder 272 or adjacent surface by the housing in a manner that offers high precision without requiring mechanical support of the member 318 or 318'. As described above, the motors 219 may support the member 318 or 318' and reaction forces imparted to the member from the fluid, as well as inertial forces during motion without assistance from bearings. Precise and consistent separation between the member 318 or 318' and the workpiece holder 272 (or surface 30) can be achieved if desired using guide wheels (not shown) or other suitable guides mounted on the housing. The guide wheels can turn freely on an axle that is securely mounted on a side wall of the housing. Alignment wheels can also be mounted the housing for positioning the workpiece holder 272. The relationship between the guide wheels and the alignment wheels can be such that the member 318 or 318' to the workpiece surface is consistent to within less than about 0.2 mm. This promotes a substantially uniform fluid boundary layer to occur at the workpiece surface when the member 318 or 318' is moved substantially parallel to the workpiece surface. Referring again now to FIG. 2C, there is shown a cross-section of another aspect of the disclosed embodiment of a member 318" for agitating a fluid during fluid processing of a workpiece. The spaced blades 240' are shown to have a general cup shape for example purposes. In FIG. 2C, the spaced bladed 240' are shown adjacent the surface 30 (for example a workpiece retained on the workpiece holder 272 using the retainer 42). In various aspects of the disclosed embodiment, the series of spaced openings 236 and/or the series of spaced blades 240' agitate the fluid when the member 318" is moved. In one aspect of the disclosed embodiment, an edge surface of a spaced blade 240' agitates the fluid. Here, the edge surface can be a side surface, a pointed surface, or a rounded surface. Referring now to FIG. 2D, there is shown a cross-section of another aspect of the disclosed embodiment of a member 318'''. The spaced blades 240" may have an angled profile, and are shown adjacent the surface 30 (for example a workpiece retained on the workpiece holder 272 using retainer 42). In various aspects of the disclosed embodiment, the series of spaced openings 236 and/or the series of spaced blades 240" agitate the fluid when the member 318" is moved. As described above, the agitation or paddle member 318, 318', 318" or 318''' (referred to herein collectively as 318*x*) can be used to agitate the fluid. In some aspects of the disclosed embodiment, the member 318*x* can be moved using a non-uniform oscillation profile. In one exemplary embodiment, the non-uniform oscillatory motion includes a reversal position that changes after each stroke of the non-uniform oscillatory motion. Furthermore, the motion may be characterized as a series of substantially continuous consecutive geometrically asymmetric oscillations wherein each consecutive oscillation of the series is geometrically asymmetric having at least two substantially continuous opposing strokes wherein reversal positions of each substantially continuous stroke of the substantially continuous asymmetric oscillation are disposed asymmetrically with respect to a center point of each immediately preceding substantially continuous stroke of the oscillation.

Referring to FIG. 2E, a blade 240, 240', or 240" or a center point of a spaced opening 236 (referred to herein collectively as a center point 252) adjacent a particular surface or workpiece point 256 on a surface of the workpiece 30 need not return to the same workpiece point 256 after one complete oscillation stroke. The center point 252 can travel along the surface of the workpiece 30 as the member 318*x* oscillates, and after one complete oscillation stroke, the center point 252' can be at a nearby workpiece point 261. In one aspect of the disclosed embodiment, the non-uniform oscillatory motion includes a primary oscillation stroke and at least one secondary oscillation stroke. The length of the primary oscillation stroke can be substantially the same as the separation of the spaced openings 236 defined by the member 318*x*. In one detailed embodiment, the length of the primary oscillation stroke can be substantially the same as the separation of adjacent spaced openings 236.

Referring now to FIG. 2F, there an exemplary primary oscillation stroke 265 can change a reversal position of an oscillation stroke of the member 318*x*. In one detailed embodiment, the primary oscillation stroke 265 changes a reversal position 268 of the center point 252 of the member 318*x*. An exemplary first secondary oscillation stroke 273 can change a reversal position of an oscillatory motion of the member 318*x*. In one detailed embodiment, the first secondary oscillation stroke 273 changes a reversal position 276 of the center point 252. In various aspects of the disclosed embodiment, this can also be understood as changing a reversal position of the primary oscillation stroke 265. An exemplary second secondary stroke 281 can change a reversal position of an oscillatory motion of the member 318*x*. In one aspect of the disclosed embodiment, the second secondary stroke 281 changes a reversal position 284 of the center point 252. In various aspects of the disclosed embodiment, this can also be understood as changing a reversal position of the first secondary oscillation stroke 273. As illustrated, a center point 252 is used to show the relative motion of the member 318*x*. Any point X along the surface of the member 318*x*, though, can be used to show the change in reversal position of that point X as the member 318*x* moves. In some aspects of the disclosed embodiment, the member can be formed from a plurality of pieces. Each piece includes one or more spaced openings or one or more spaced blades. In one aspect of the disclosed embodiment, each piece can be connected to a separate motor so that its motion is independent of a proximate piece. In one aspect of the disclosed embodiment, each piece can be connected to the same motor so that the pieces move in concert. In some aspects of the disclosed embodiment, the plurality of pieces are positioned on the same side of a workpiece so that the motion of two or more pieces of the member 204*x* agitates the fluid. Referring now to FIG. 2G, there is shown a graphical representation of an exemplary non-uniform oscillation profile 288 for agitating a fluid during fluid processing of a workpiece. The exemplary workpiece 272 and center point 252 in FIGS. 2E and 2F are referenced for illustrative purposes. The position of the center point 252 of the member 318*x* relative to the workpiece point 256 on the surface of the workpiece 272 is plotted versus time. In the disclosed embodiment of the member 318*x*, the separation of the center points 252 is about 20 mm. The primary oscillation stroke is substantially the same as the separation between the center point 252 and an adjacent center point of the member 318*x*. The secondary oscillation stroke is about 40 mm. Line 292 shows the relative travel of the center point as a result of the primary oscillation stroke. Line 296 shows the relative travel of the center point as a result of the secondary oscillation stroke. By using a combination of primary and secondary strokes, the reversal position of the oscillation pattern in front of the workpiece 272 can change sufficiently relative to the process time. This can preclude a non-uniform time averaged electric field or fluid flow field on the surface of the workpiece. This can minimize an electric field image or a fluid flow image of the member on the surface of the workpiece, which improves the uniformity of a deposition.

Referring now to FIG. 2H, there is shown a graphical representation of another exemplary non-uniform oscillation profile 301 for agitating a fluid during fluid processing of a workpiece. With the member 318*x*, the separation of the center points 252 is about 20 mm. The primary oscillation stroke is substantially the same as the separation between the center point 252 and an adjacent center point of the member 318*x*. The first secondary oscillation stroke is about 30 mm. The second secondary oscillation stroke is about 40 mm. The oscillatory motion can include additional secondary oscillation strokes. Line 304 shows the relative travel of the center point as a result of the primary oscillation stroke. Line 308 shows the relative travel of the center point as a result of the first secondary oscillation stroke. Line 313 shows the relative travel of the center point as a result of the second secondary oscillation stroke. The period of the first secondary oscillation stroke is about 2 seconds, and the period of the second secondary oscillation stroke is about 10 seconds. This can move the position at which the oscillation reversal occurs, which can spread the reversal point of each spaced blade or the center point of each spaced opening by about 0.1 mm. This can reduce or substantially eliminate any imaging of the reversal position onto the surface 30. Oscillation of the member 318*x* can also form a non-periodic fluid boundary layer at the surface of the workpiece 272. In accordance with another aspect of the disclosed embodiment, the agitation motion of the paddle may be a uniform oscillatory motion. In one aspect of the disclosed embodiment, the member 318*x* reduces fluid boundary layer thickness at the surface of the workpiece 272, 278. In one detailed embodiment, the fluid boundary layer thickness is reduced to less than about 10 um. Furthermore, motion of the member can reduce or substantially eliminate entrapment of air or gas bubbles in the fluid from the surface 30 (e.g. of the workpiece 272, 278). In one aspect of the disclosed embodiment, fluid flow carries the air or gas bubbles near a growing film surface in a housing for plating or depositing. In another embodiment, fluid flow agitates fluid proximate an ion exchange membrane in a housing of an electro osmosis replenishment module as will be described in greater detail below.

Figure 3:
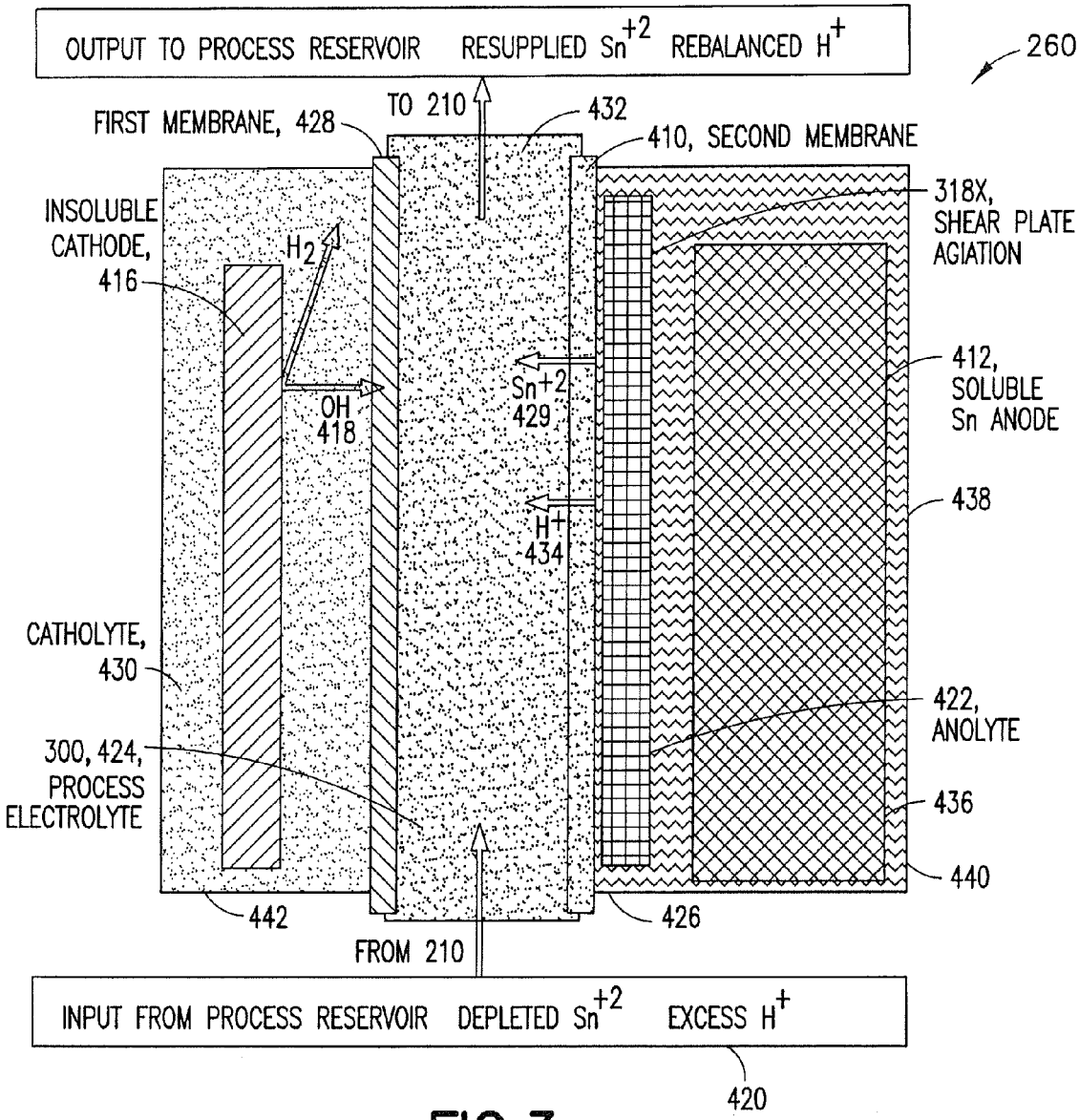
FIG. 3 shows a electro osmosis replenishment module.

Referring now to FIG. 3, there is shown electro osmosis replenishment process module 260. In FIG. 3, primary transport paths are shown in an Sn version of shear-plate electro-osmosis module. In accordance with another aspect of the disclosed embodiment, any suitable metal or material may be provided (e.g. Cu, Ni, Sn, Sn—Ag or otherwise). As shown, the replenishment module may include two separate membranes 410, 428, that may independently isolate the cell cathode 416, and anode 412 respectively from each other and from the process fluid. For example, in Sn—Ag applications, first membrane 410 prohibits the transport of Ag+-ligand complexes to the soluble Sn anode 412, thereby avoiding unwanted Ag immersion deposition on the Sn anode 412. Water electrolysis at the cathode supplies OH− ions 418 to neutralize H+ ions 420 generated at the process module insoluble anode 310. Shear-plate agitation 318*x* on the anode side of anode-membrane 410 may provide fluid mixing for better transport of Sn-ion 424 through the membrane 410. Further, fluid agitation over the membrane as effected by the agitation paddle or shear-plate 318*x* may also avoid or significantly reduce membrane fouling (with commensurate benefits to membrane effectiveness and life). Here, process electrolyte may be working process electrolyte 300 of deposition module 210.

Electro-osmosis is used as a method and apparatus to supply metal ions (e.g. replenish metal ions to process fluid) for wafer electrodeposition. As described previously, electro chemical deposition apparatus 200 may have a substrate deposition module 210-216 (see also FIGS. 2A, 5) having a substrate holder 272, an anode 310 and a working process electrolyte 300. The substrate deposition module is coupled via suitable piping and controls to electro osmosis module 260 that defines a chamber having a first (for example cationic) membrane 410 and a secondary soluble anode 412 in a secondary anolyte 422. Module 260 may also have a second (for example anionic or bipolar) membrane 428 and a secondary insoluble cathode 416 in a secondary catholyte 430. As may be realized from FIG. 3, in the embodiment shown, the first membrane 410 isolates the consumable anode and anolyte within an isolated chamber in the replenishment module. Similarly, the second membrane 428 defines a second isolated chamber in the module 260, isolating the cathode 416 and secondary catholyte 430 from fluids (e.g. secondary anolyte, working process fluid) in module 260. The terms primary and secondary in reference to the anolyte and catholyte are used for description purposes here to distinguish between working process electrolyte (primary) in the substrate deposition module 200 and chemical production electrolyte (secondary) in the module 260. The working process (primary) electrolyte 424, 300 is recirculated through an isolated region 432 (e.g. a third isolated chamber or region) of the module 260 bounded between the first membrane 410 and the second membrane 428. The region 432 is separate and isolated from the secondary soluble anode 412 and the secondary cathode 416 by the membrane 410 and the membrane 428. Here, ions 424, 434 from the secondary soluble anode 412 pass through the membrane 410 into the working process electrolyte 300 and in this manner electro osmosis module 260 replenishes the working process electrolyte 300 with the resupplied 424 and rebalanced 434 ions. Thus, in the exemplary embodiment, module 260 may have three substantially isolated fluid compartments 440, 432 and 442 in the electro-osmosis unit 260 with the compartments separated by specific kinds of membranes 410, 428 and where the compartments may be narrow compartments, for example, to minimize cell voltage. In the embodiment shown, anode 310 of module 210 may be inert, insoluble or otherwise. The working process electrolyte 300 may recirculate through the electro osmosis module 260 substantially continuously during a deposition of a material on a substrate on the substrate holder 272. In accordance with another aspect of the disclosed embodiment, recirculation may be continuous, intermittent on a fixed basis or on an as needed basis depending on factors, for example, factors such as levels of depletion, excess or other parameters as may be determined. Electro osmosis module may have one or more shear plate(s) 318*x*, for example, in the anolyte 422 proximate the cationic membrane 410 where the shear plate 318*x* agitates the anolyte 422 proximate the cationic membrane 410. In accordance with another aspect of the disclosed embodiment, one or more shear plates may be made proximate any suitable surface of ion exchange membranes, for example, within anolyte 422, working fluid region 432 or catholyte 430 or otherwise. Here, shear plate agitation may be provided on one or more membranes to improve ion transfer and avoid fouling. Electro osmosis module 260 may be provided remote from the substrate deposition module 210 or proximate module 210 (see for example FIG. 1). Substrate electro osmosis module 260 may be provided with any suitable secondary soluble anode, for example, tin pellets, copper, nickel or any suitable material. Electro osmosis module 260 may further be provided to replenish a single or multiple substrate deposition modules as required and may replenish in parallel, in series or on a demand basis or in any suitable combination. Secondary soluble anode 412 may comprises a pellet anode compartment 436 where the pellet anode compartment 436 may be replenished with soluble anode pellets 438 without interruption of operation of the electro chemical deposition apparatus 200. Any suitable chemistry for an electrodeposition module may similarly be migrated to and insoluble anode in the process cell with metal replacement and chemical dosing, in the local or off-board module 260, such as a chemical productivity system (CPS) unit. By eliminating the need to change anodes in the process section of deposition tool 200, for example, at module 210, the PM time, both for anode change and system requalification, is reduced. For some metals, like SnAg, the costs may be considerably reduced by switching from liquid metal-salt to solid metal anode material. Further, vertical cell configuration in module 210 may provide more insensitivity to gas generation (oxygen at the insoluble anode and hydrogen at the wafer/cathode) than, for example, fountain cell configurations. One implementation may be for a soluble Sn anode CPS system. In other aspects of the disclosed embodiment, copper, nickel or other suitable materials may be provided. Further, sub-systems, such as modules 210, 260, 260' or otherwise may be provided as upgrades to process tools to provide for costs savings.

In the embodiment shown in FIG. 3, double membrane electro-osmosis with shear plate agitation is shown. Here, chemical productivity system (CPS) 260 is shown as a shear-plate electro-osmosis (SPEO) module that provides membrane separation between the process chemistry 424, 300 and a working anolyte 422 and catholyte 430. Specific ion-exchange membranes may be useful for controlling the relevant reactions, and using shear-plate type of agitation, for example, on the anode side of the anode membrane or without shear plate agitation. For example, in the case of tin (Sn), or tin-silver (Sn—Ag) deposition, apparatus 260 provides a source of tin ions (Sn2+) from a solid consumable (e.g. pellets or one piece) tin anode 412 to replenish the tin consumed at the workpiece 278. During electrodeposition of tin-silver (SnAg) on the workpiece 278, replenishment of tin ions (Sn2+) is provided at shear-plate electro-osmosis (SPEO) module 260 without contaminating the solid tin anode with silver from the SnAg solution. Here, an apparatus and method to supply a source of metal ions from a solid (e.g. pellets, or one piece) anode source 412 which is remotely positioned from the workpiece processing module 210 is shown. Processing module 210, as noted before contains an insoluble anode 310 to generate the electric field on the workpiece 278 required for electrodeposition without dissolving and providing metal ions into the working catholyte solution. In one aspect of the disclosed embodiment for chemical control of a complex electrodeposition process solutions, a remote process module 260 may be provided with associated pumping, storage and filtering, where the remote process module may include ion-exchange membranes that separate the working process catholyte 300 from a secondary anolyte 422 and catholyte 430, in conjunction with secondary cathode and anode pairs. In response to a suitable applied voltage, metal ions 424 dissolve from the secondary anode and pass through the anode membrane into the primary process solution while hydroxide ions are generated by dissociation of water at the secondary cathode 416 which then pass through the cathode membrane into the primary process solution. Here, remote process module 260 may be a type of electro-osmosis system. For example, suitable for generating tin-ions for a tin-silver bath process module 260 may contain three fluid compartments 440, 432, 442, each of which may be connected to a local fluid reservoir by suitable pumps. Tin pellet anode compartment 440 may be separated by a cationic membrane 410 such as Snowpure Excellion (I-100) or Dupont Nafion where anolyte fluid 422 may be an acid solution with a pH higher than that of the catholyte. Primary tin-silver bath compartment 432 may be bounded by the anode and cathode membranes 410, 428 where the fluid 424, 300 flowing through this compartment 432 is the primary SnAg bath which is recirculated between the remote CPS unit 260 and the wafer plating tool 200, 210. Cathode section 442 may be separated by an ionic membrane 428, for example CMX-S monovalent selective membrane (Astom CMX-S), containing an acidic solution. The ionic membrane separation of the Sn-anode from the main SnAg bath may significantly minimize the possibility of Ag immersion deposition onto the Sn-anode surface. Strong fluid agitation 318*x* may be immediately adjacent to the anode membrane surface on the anode side of the membrane 410. The electro osmosis module 260 (also referred to herein as the chemical production system, chemical productivity system, replenishment module or the chemical replenishment module) may be built from any suitable materials in any desired manner to define the three isolated chambers formed with the first and second membranes 410, 428.

Figure 4:
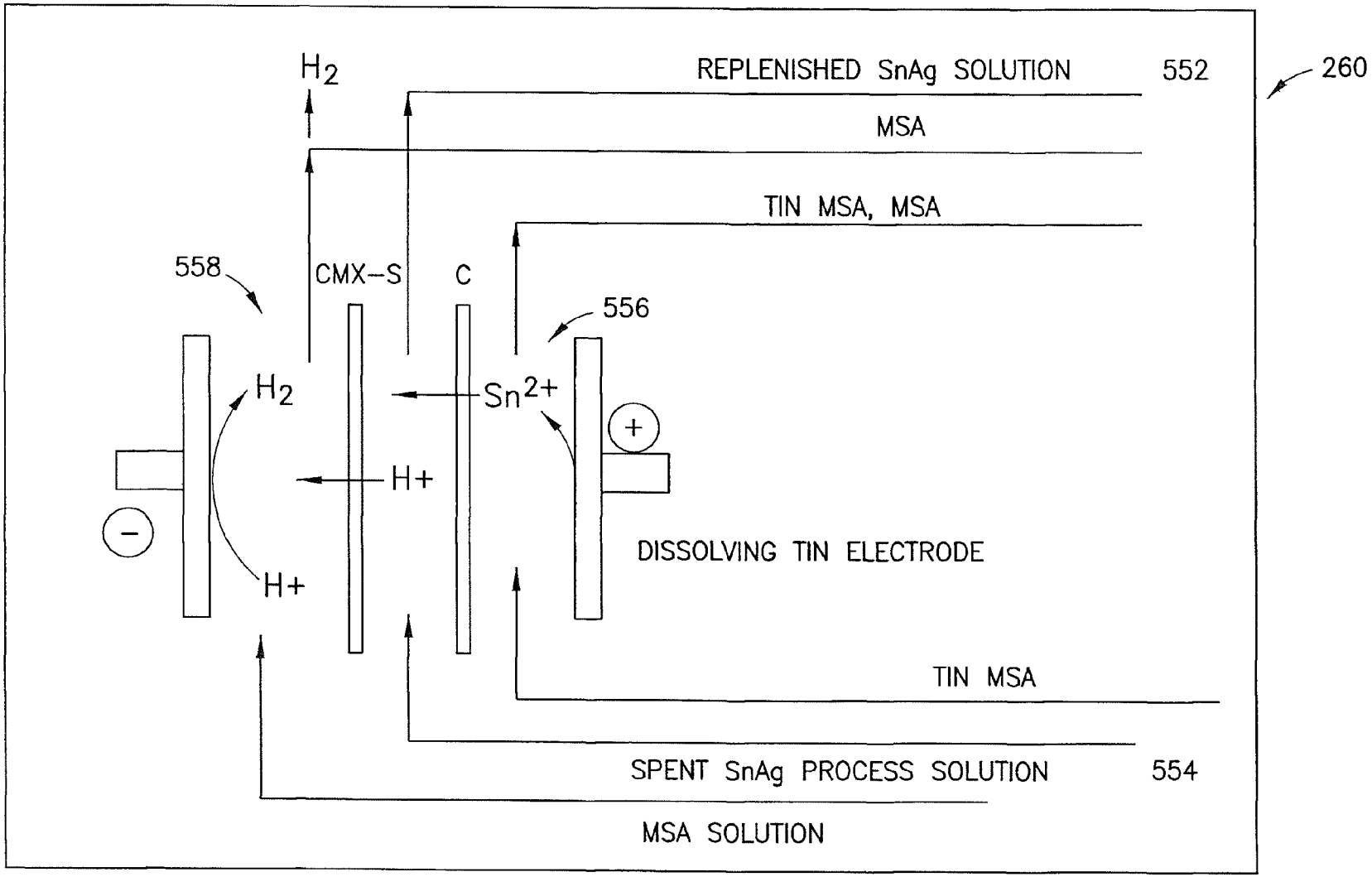
FIG. 4 shows a electrosynthesis flow-cell layout.
Figure 5:
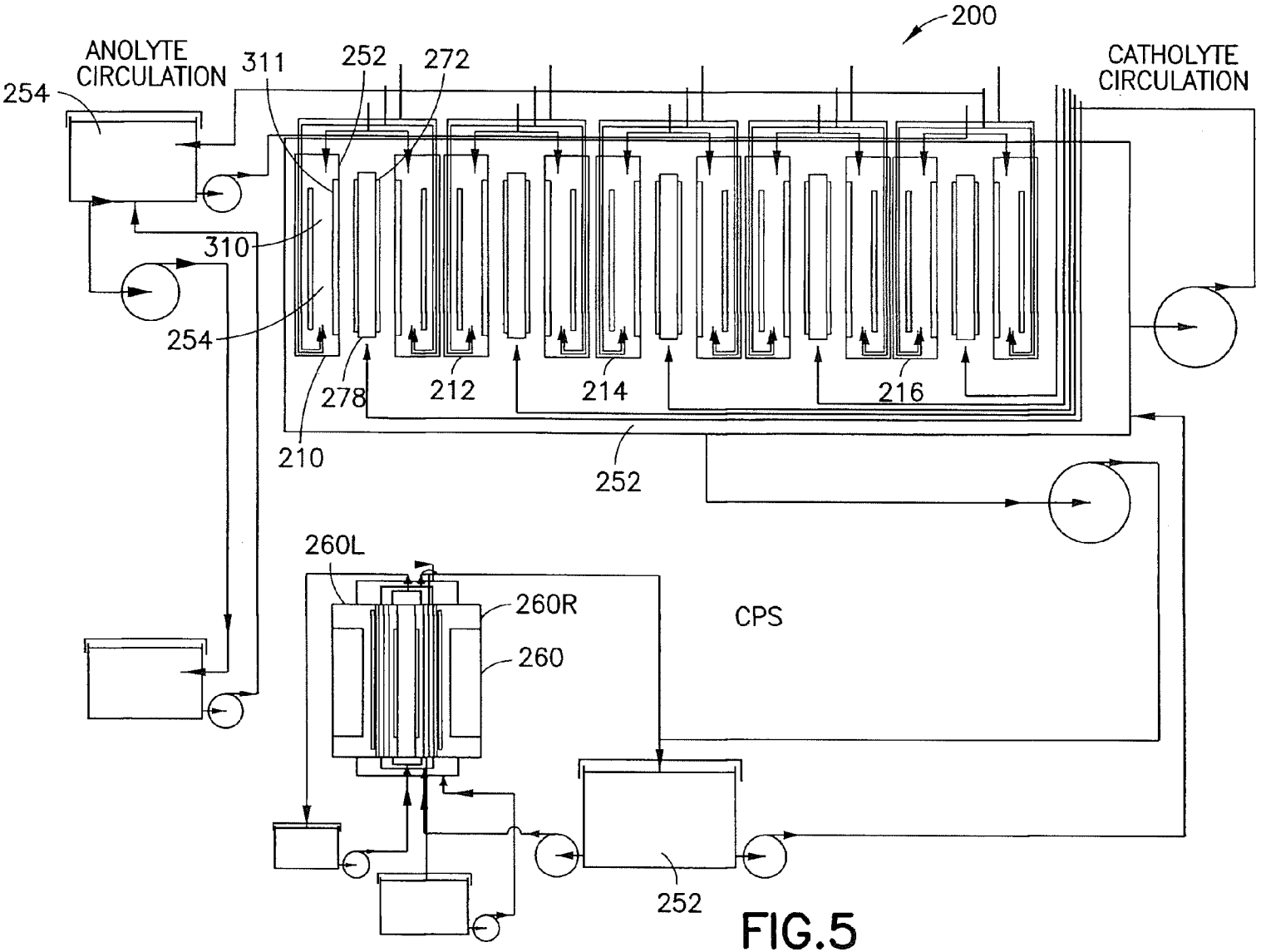
FIG. 5 shows an electro deposition portion and chemical productivity system (CPS)
Figure 5A:
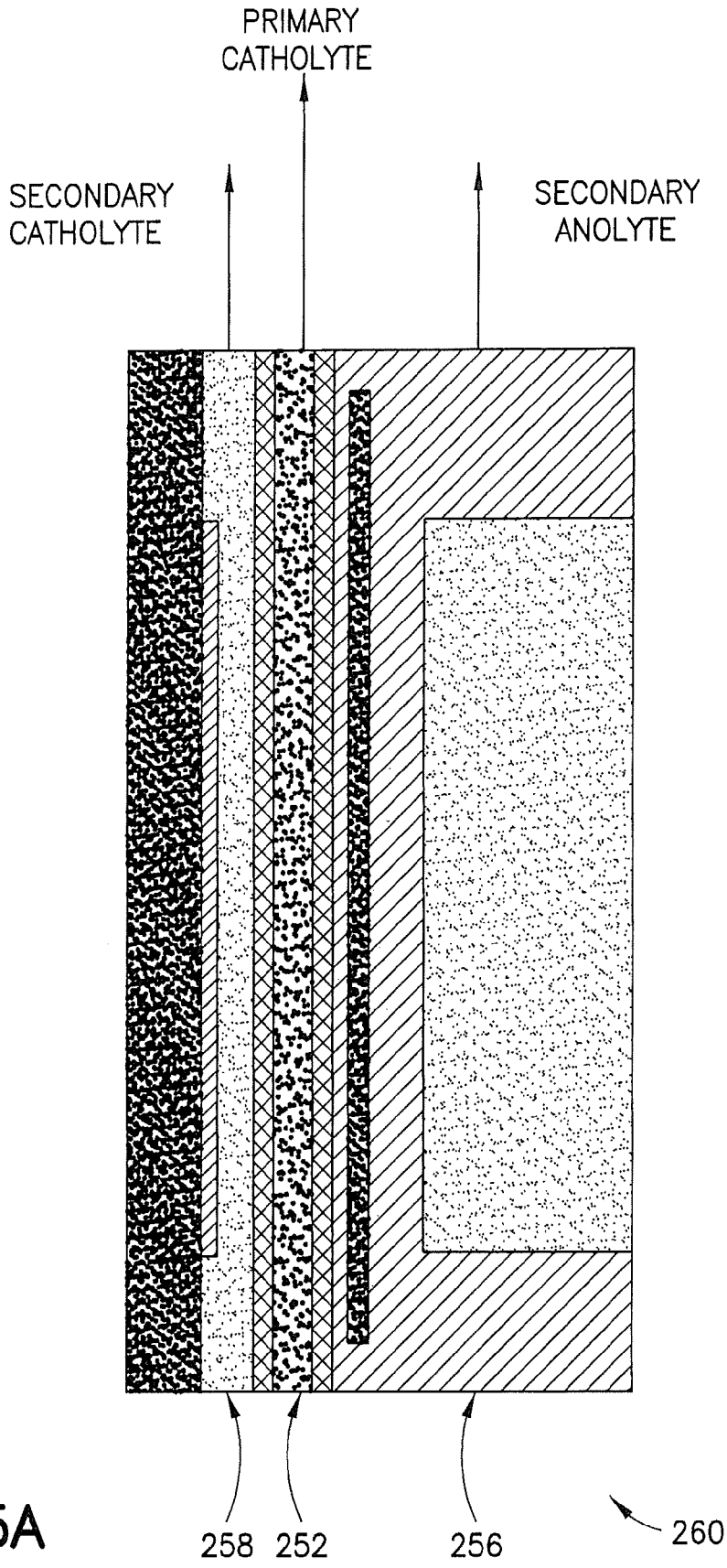
FIG. 5A shows a chemical productivity module of the CPS system.
Figure 6:
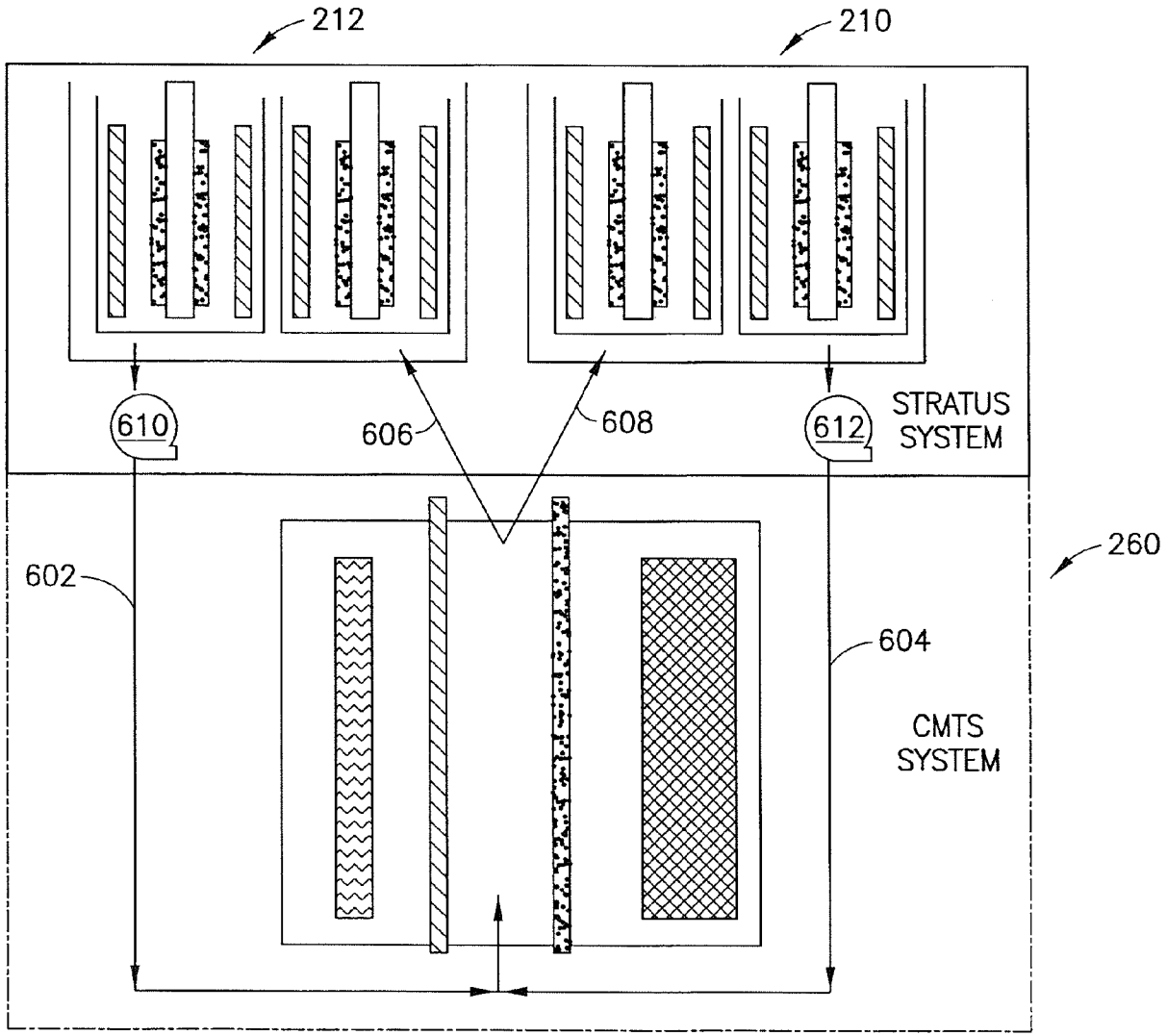
FIG. 6 shows a chemical management and transfer system.

Referring now to FIG. 4, there is shown a electrosynthesis flow-cell layout corresponding to CPS module 260. In the embodiment shown, the three isolated chamber configuration of module 260 allows four separate chemical solutions to be controlled as part of the chemical production process. Referring now also to FIG. 5, there is shown a schematic view of a processing portion of system (CPS) 200 (see also FIG. 1), with an exemplary number of electro chemical deposition processing modules 210-216, and a chemical productivity system (CPS) portion with an electro osmosis (or shear plate electro osmosis, SPEO) module 260. Module 260 in FIG. 6 is illustrated as having an opposing pair (siamese) arrangement that comprises a pair of similar submodule portions 260R, 260L (arranged similarly to module 260 shown in FIGS. 3-4 with portion 260R being substantially opposite to portion 260L). FIG. 5A shows an enlarged schematic view of SPEO module 260, or corresponding to the right hand portion 260R of the module shown in FIG. 5. A first fluid includes a primary bath, or working catholyte 252 (SnAg bath for example) that plates wafers, substrates or otherwise. About half (or other desired amount) of this chemistry may be in the process tool 200 reservoirs and another portion of the primary fluid may be in the reservoir within the CPS unit 260 which is close loop pumped through the SPEO module 200 within the CPS. By way of example, a process tool may have 500 liters in the tool and 100's of liters in the CPS unit, where the working catholyte may be broken into several reservoir pairs (e.g. module pair 260R, 260L) to allow continued production if one is taken off-line. All SnAg constituents may be monitored in the CPS and controlled by dosing and bleed-out. A second fluid includes (if desired) a primary anolyte 254, or working anolyte, that is in a small reservoir (for example within the plating tool itself) and is separated from the working catholyte by an ionic exchange membrane 311, if provided, within the ECD module 210. In some aspects of the disclosed embodiment, the small reservoir may not be for all metal systems, in which case the primary bath is in fluid contact with both the wafer/cathode and the anode in the ECD module 210. A third fluid includes a secondary anolyte 256 in the SPEO module, which has a local reservoir/pump in the CPS. Here, pH and [Sn2+] or other metal ion, and MSA concentration may be monitored and adjusted as needed. A fourth fluid includes a secondary catholyte 258 in the SPEO module, which has a local reservoir/pump in the CPS. Here, further variables may be monitored and adjusted as needed. Exemplary sources of variations to system include:

Wafers, which may deposit impurities into primary the bath in a process known as "drag-in," or which cause leach-out of chemical additives into the primary bath are a potential source of variation such as:

Total deposition activity (amp-hours): cathodic deposition of metal from primary bath and cathodic reaction of organic species (breakdown generation) is also a potential sources of variation.

Time: reactions within the primary bath, evaporation, oxidation in primary reservoirs is a potential source of variation Material build-up on membranes or electro-dissolution of anode metal is a potential source of process variation.

Process interrupt, for example for manual addition of metal pellets to anode compartments, is another potential source of process variation.

Referring now to FIG. 6, there is shown a schematic representation of the combined electro plating substrate process tool and chemical productivity system shown in FIG. 5. FIG. 6 represents a system layout showing four ECD process modules in a reservoir in the process system 200 and a single electro-osmosis (EO) unit 260 in the CPS with process tool 200 to CPS 260 fluid supply 602, 604 and return 606, 608 piping and reservoir layout with pumps 610, 612.

Figure 7:
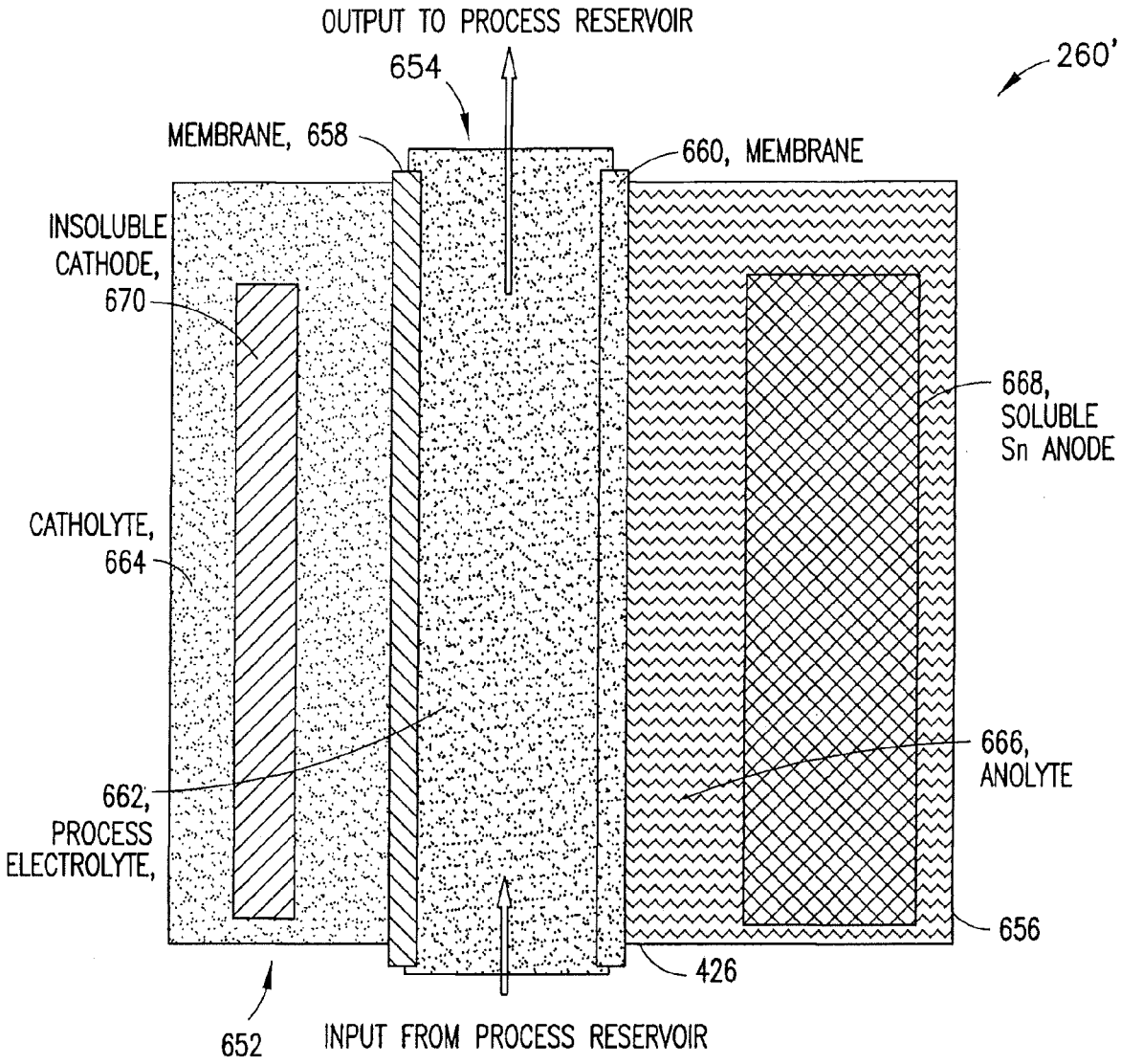
FIG. 7 shows a electro osmosis replenishment module.
Figure 8:
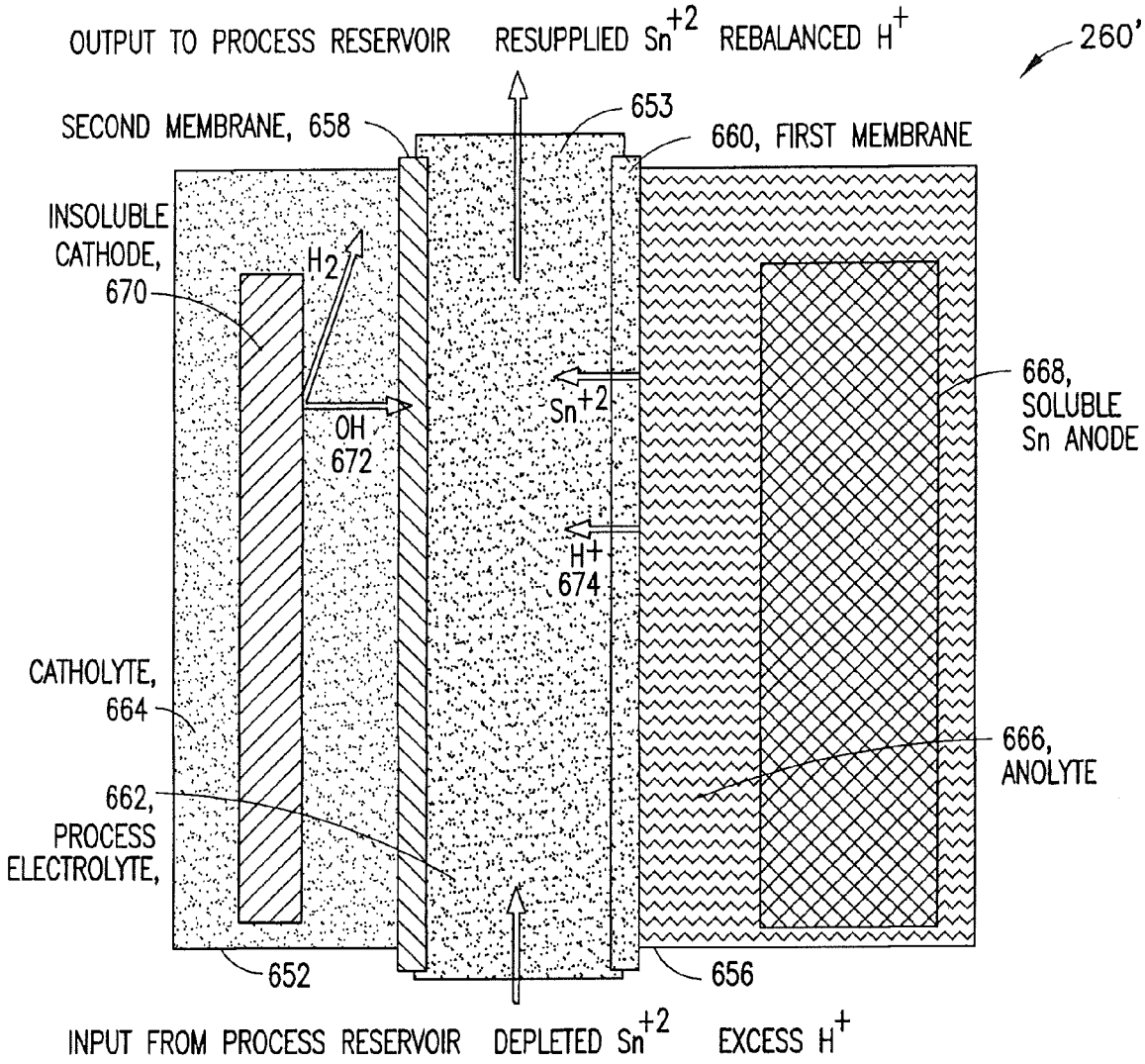
FIG. 8 shows a electro osmosis replenishment module.

Referring now to FIG. 7, there is shown a electro osmosis replenishment module 260'. Module 260' is operationally similar to module 260 wherein FIG. 7 shows a schematic view of a Sn electro-osmosis unit 260'. Here, three fluid compartments 652, 654, 656 are separated by two ionic membranes 658, 660 (membrane 658 may also be bi-polar) and where the central compartment 654 contains the process (primary) electrolyte 662, the cathode compartment contains (secondary) catholyte 664 and cathode 670 and the anode compartment 656 contains (secondary) anolyte 666 and soluble anode 668. Referring also to FIG. 8, there is shown electro osmosis replenishment module 260'. Here, the primary transport paths in Sn-Electro-osmosis module is shown. Membrane 660 (for example a cationic membrane) prohibits the transport of Ag-ligant complexes to the soluble Sn anode 668, thereby avoiding unwanted Ag immersion deposition on the Sn anode 668. Water electrolysis at the cathode 670 supplies OH− ions 672 to neutralize H+ ions 674 generated at the process module 210 insoluble anode 310.

Referring again to FIGS. 5-5A, in accordance with one aspect of the disclosed embodiment, a secondary (with respect to the primary plating process module) electro-osmosis system, CPS, may be provided, for example, remote in the fab sub-basement. One or two ionic exchange (though one membrane may be bi-polar) membranes may be provided, as described previously, between the soluble Sn (or other soluble metal) anode and the dummy cathode. Thus, the deplated Sn or other metal dissolved (from the metal anodes) is blocked from depositing on the dummy cathode so that Sn ions may be pumped back into the main reservoir to compensate for Sn plated out on the wafer. Referring to FIG. 5, multiple SnAg reservoirs and process cells 210-216 within the process system 200 may be serviced by a single electro-osmosis unit 260 in the CPS. In accordance with another aspect of the disclosed embodiment, other chemical management functions may also be incorporated into the CPS, such as bath make-up and either current based or analysis based replenishment. Potential features of electro-osmosis 1) Tin anode replaced while tool is running 2) Readily compatible with pellet tin 3) Anode material and membrane only in one place, not repeated for each wafer, ease of maintenance and lower capital cost; 4) No anode related non-uniformity.

Figure 9:
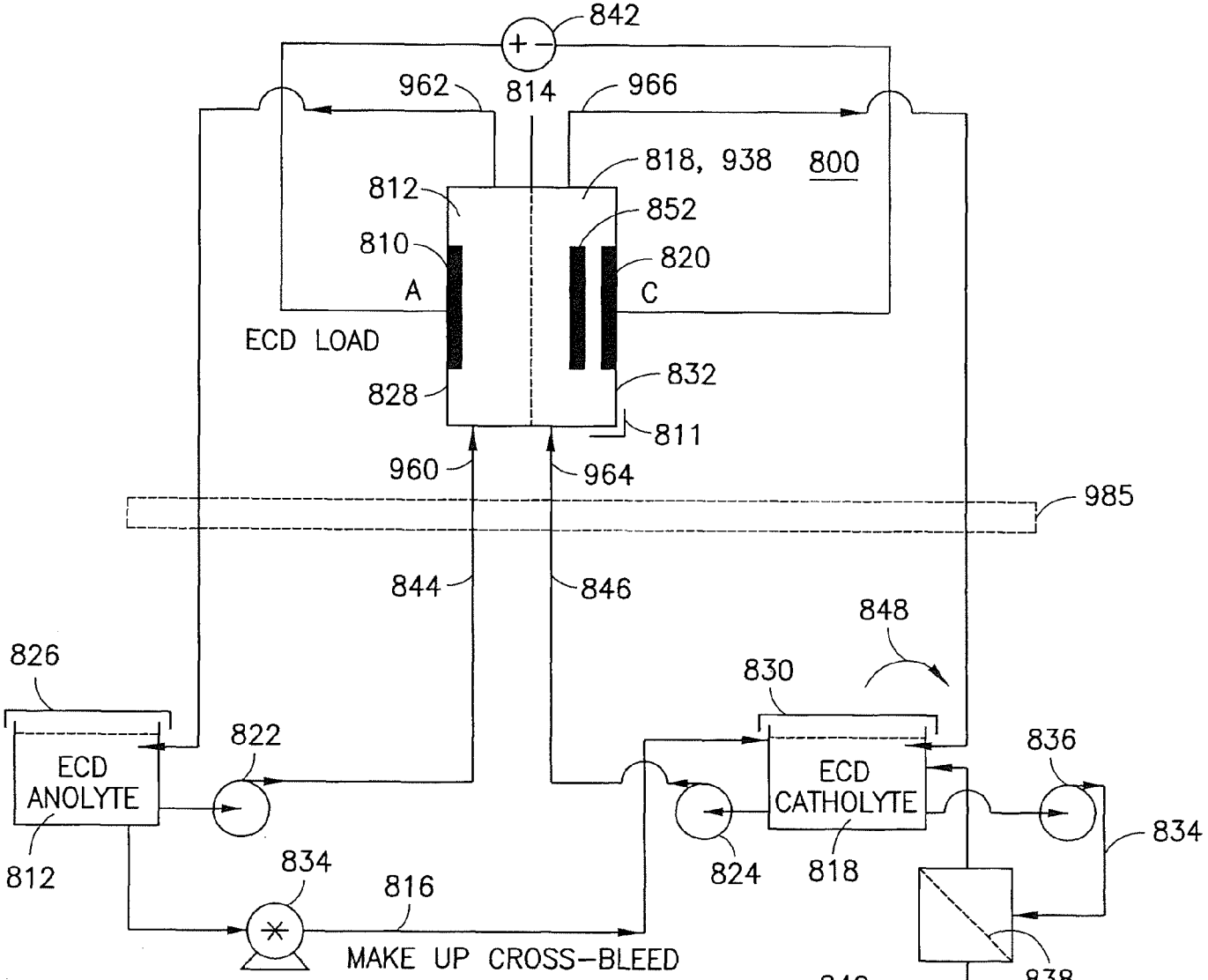
FIG. 9 shows a diagram of an electrochemical deposition system.

Referring now to FIG. 9, there is shown a diagram of an electro chemical deposition module 800, ECD anolyte reservoir 826 and ECD catholyte reservoir 830. Deposition module 800 may be used in conjunction with a replenishment module as will be described or as shown without a replenishment module, instead utilizing replenishment sources 844, 846 as shown. In the embodiment shown, plating cell 800 has soluble anode 810, distinct ECD anolyte 812, ion exchange membrane 814 and cross bleed 816. In the embodiment shown, soluble anode 810 may be a soluble anode, for example, a solid SN anode or otherwise. A soluble anode may be a source of ions in which metal is dissolved into an electrolyte by an anodic potential. In systems with a soluble anode, the anodic reaction is sustained by dissolution of the metal to form corresponding metal ions in solution. Soluble anodes can be any geometry, whether a block of metal, pellets, a metal mesh, or otherwise. For example, a soluble anode may be a soluble plate, such as a SN or other metal plate. By way of further example, a soluble anode may be soluble Sn or other metal pellets in an inert compartment. Alternately, any suitable soluble source may be provided. In accordance with another aspect of the disclosed embodiment, any suitable soluble anode may be used. Plating cell 800 further has ECD catholyte 818 and cathode substrate or wafer 820. Here, pump 822 may be provided to recirculate ECD anolyte 812 between ECD anolyte reservoir 826 and anode compartment 828. Further, pump 824 may be provided to recirculate ECD catholyte 818 between ECD catholyte reservoir 830 and cathode compartment 832. Here, anode compartment 828 is separated from cathode compartment 832 by cation exchange membrane 814. Pump 834 may be provided for cross bleed 816 between anode compartment 828 and cathode compartment 832. Water Extraction Unit 834 may be provided having circulation pump 836 and ultra-filtration, ionic or other similar membrane 838 where pressure across water selective membrane 838 allows for the selective extraction of water 840 where extraction is driven across size-exclusion membrane 838. Power source 842 selectively provides bias between anode 810 and cathode or substrate 820 during electro chemical deposition (ECD). Such bias may be by direct current, pulsed current or otherwise. Anolyte replenishment 844 may include Sn salt, anti oxidants, MSA (methane sulfonic acid), H2O or otherwise may be added. Anolyte cross bleed may include Sn2+, MSA− or otherwise. Catholyte replenishment 846 may include Ag salt and additives, such as anti oxidants, leveler or otherwise. Bleed out 848 may be required to balance replenishment 844, 846 and bleed in 816 or otherwise as needed. In the case of an Sn anode, Membrane 814 may selectively pass Sn2+, H+ and H2O from anolyte compartment 828 to catholyte compartment 832 while MSA− passes in the opposite direction. In the disclosed embodiment, ion-exchange membrane 814 is shown present and separates anolyte 812 and catholyte 814 solutions. As membranes may not be ideally selective for the species intended, some amount of cross-bleed 816 or transfer of plating cell anolyte solution 812 into the plating cell catholyte 818, with supplemental feeding of the anolyte, may be necessary in some cases to balance the species between anolyte 812 and catholyte 818. The amount of cross-bleed 816 and the amount and identity of the anolyte feed solutions may be configurable by the user, for example, in Simulation mode or otherwise. For example, in Control mode, these quantities, and scheduling, may be determined by controller 850, possibly in conjunction with the higher level system controller. Shear plate 852 may further be provided in deposition module for fluid agitation at the surface of substrate 820 as previously described. In accordance with another aspect of the disclosed embodiment, any suitable features may be provided, for example, additional shear plates may be provided with respect to membrane 814 or other features may be provided.

In the aspects of the disclosed embodiment shown, the purpose of the plating cell is to deposit metal from solution to a substrate or loaded wafer. In general, the half reaction for this may be expressed as $Mz++ze- \rightarrow M0$ (Eq. 1). Here, electrons, e− are supplied by the current flowing through the cell. Here, there may be at least one accompanying reaction that provides the electrons and that occurs at the anode where the substrate or wafer may be the cathode. The anode may also provide metal ions to replace those consumed in Eq. 1. In addition, another source of those ions may be provided by dosing of liquid solution to the cell. Potential sources of these ionic species include VMS (Virgin Makeup Solution), which contains a number of species present at a specified concentration, and separate metal ion concentrates. These concentrates include the metal itself but also may include counterions (e.g., sulfate or methane sulfonate) and, may also include an appropriate acid. Here, a user may provide the appropriate concentrations to achieve desired process results. With respect to the disclosed aspects of the disclosed embodiment, SnAg plating may be described, however in accordance with another aspect of the disclosed embodiment any suitable species may be provided. For example, the metal in question may be Cu, Sn, or other suitable species, depending on the application where the system may be configurable and expandable. In the disclosed aspects of the disclosed embodiment, a plating cell may consist of one solution or two. In the case when two solutions are present, they may be separated by a membrane. The membrane allows some species to transfer across and blocks others. The selectivity of the membrane, or the degree to which it favors particular species, varies with membrane type and the actual chemistry being used. In addition to the metal ions, the plating solution may contain an acid, possibly other minor metallic species, and additives of a usually organic nature (but which can be inorganic, e.g., chloride); each of which may be tracked and controlled. In the plating cell, species are generated or consumed. As noted above, an example of consumption is the plating half-reaction. Here, the other species may be consumed as well. Here, some species have both an idle and an electrolytic mode of consumption. Each of these consumption modes has a rate associated with it. For example, idle consumption may be proportional to the time the cell sits and does not actively process wafers. Alternately, electrolytic consumption occurs when current is being passed through the cell (i.e., when wafers are being processed), and can be considered as proportional to the charge (Amp·hours) passed through the cell. To compensate for the consumption of the species in the cell, replenishment may be performed by dosing with solutions containing those species. Additionally, dosing of the inorganic species may be provided. Such dosing may be necessary when the inorganic species are consumed by plating and not replenished by dissolution of a corresponding anode. Also, dosing may be provided for makeup of species lost to dilution or as the feed in a feed and bleed scheme. The consumption of the additives and, in some cases, contamination from substrates or wafers, may lead to the build up, over time, of unwanted by-products in the bath. Here, by-products can be detrimental to plating quality and, so, must be kept to acceptable levels. To accomplish this, various forms of Bleed and Feed may be used with the central approach being dilution where portions of a bath are discarded and replaced by fresh solution in a controlled manner. The implementations may vary. One implementation may involve "Feed and Bleed" where new VMS (Virgin Makeup Solution) may be added and other constituents until a predetermined bath volume is established with subsequent drain off of excess volume of bath. Another implementation may involve "Bleed and Feed" where a predetermined portion of the bath may be bled off, for example, once per day and with feed during the rest of the time. Another implementation may involve "Continuous Bleed and Feed" where bleed and feed may be applied simultaneously, according to a determined rate. Another implementation may involve "Occasional Dumps" where the bath may be dumped as needed—possibly triggered by a set of criteria, for example, TOC (total organic carbon) level or otherwise. Another implementation may involve "No Bleed and Feed" where, in this scenario, there may be a requirement to run until a certain condition is reached, for example, the concentration of a particular species reaches a critical value. In each case, there may be restrictions around bleeding, feeding, or both, such as an imposed constraint to not disturb the bath while a wafer is being processed or otherwise as needed. In the disclosed aspects of the disclosed embodiment, anodes may be soluble or insoluble. A soluble anode, as the name implies, dissolves in solution at a rate proportional the current.

In the aspects of the disclosed embodiment shown, wafers or substrates may be wetted prior to entering a plating bath, for example, with water. This provides an additional water source to the plating bath. The term used to designate this source may be "Drag In". A corresponding loss of plating solution may occur when a wafer or substrate is removed from the bath. The term used to designate this source may be "Drag Out". Each wafer or substrate may be plated at current settings specified in a Recipe. In actual use, the recipes may include a number of steps. In a control scenario, the current and plating time history of each wafer or substrate may be available from a database. There are a number of scenarios may be simulated or incorporated into a control algorithm, including various chemistries and hardware configurations (in the form of connections between the various tanks and the presence or absence of membrane separators) where an implementation of the controller may be able to accommodate these various scenarios. For example, interfacing with scripts (or routines) to redefine the behavior of the membranes, as models or otherwise.

In the aspects of the disclosed embodiment shown, replenishment module and Plating Bath Control may be provided by a controller. For example, sampling measurement and control based on usage, concentration and suitable bleed and feed, bleed/cross bleed may be done by monitoring of concentrations by standard methods, off board chemical analysis systems, for example, supplied by ECI or Ancosys augmented by models developed from first principles or accumulating empirical data, as appropriate. Predictive control of one or all reservoirs may be provided accounting for factors such as tool loading, component consumption models, membrane transfer models or otherwise may be provided. Here, models may be developed from first principles or accumulating empirical data, as appropriate. Controller may have control software for a number of different purposes. For example, one mode of use may be Simulation, where different scenarios can be modeled and compared. A second mode may be Control, where most parameters of the model are fixed and the Software is used as part of a predictive dosing scheme allowing tight control of plating baths, as well as maintaining a record of interventions. Finally, the Software, in one version of simulation mode, may further be useful for correlating experimental data to allow the determination of, e.g, transfer parameters or decomposition rates.

In the aspects of the disclosed embodiment shown, membrane fouling may be reduced and managed. The fouling of the membranes may be defined as obstruction of the membrane either within the "pores" or at one or both of the membrane surfaces. The result being that fouling increases the resistance of the membrane to the point where the membrane may be unusable. Fouling is a particular concern with Sn-containing solutions of the type used in plating processes (whether anolytes or catholytes), since the solutions are often prone to formation of suspended solids (through the production of sparingly soluble Sn(IV) species). Features may be provided, for example with in the replenishment module to manage fouling, for example, a number of precautions may be taken to minimize the formation of Sn(IV). Minimization of this Sn(II) loss pathway has a number of potential benefits including: 1. Reducing the amount of suspended solids in the solutions (such solids can adhere to surfaces and form an impeding film, or Sn(IV) species can precipitate within membrane pores—either way, fouling). And, ancillary to fouling, 2. Reducing the amount of Sn required for replenishment (either by dosing of concentrate or through dissolution of a solid source), and 3. reduction of plating defects. Here, Sn(IV) may form from the oxidation of Sn(II) via one of two possible pathways: (1) reaction of Sn(II) with dissolved O2 gas, or (2) direct oxidation at an anode. The use of a soluble Sn anode minimizes formation of Sn(IV) via oxidation at the anode. The reason for this can be seen from consideration of the standard potentials for primary reactions occurring at soluble and insoluble anodes and the standard potential for Sn(II) oxidation. The net driving force towards Sn oxidation is much higher at an insoluble anode than at a Sn anode. Furthermore, in the aspects of the disclosed embodiment, the anode may be isolated from the bulk plating solution by a membrane (or membranes), substantially eliminating the anodic oxidation of Sn(II).

TABLE 1

| Standard Potentials | | |
|---|---|---|
| Anode Type | Reaction | Standard Potential (V) |
| Inert | Water Breakdown $O_2 + 4H^+ + 4e^- \leftrightarrow 2H_2O$ | 1.229 |
| Soluble | Sn Dissolution $Sn^{2+} + 2e^- \leftrightarrow Sn^0$ | −0.138 |
| N/A | $Sn^{4+}$ Formation ($Sn^{2+}$ Oxidation) $Sn^{4+} + 2e^- \leftrightarrow Sn^{2+}$ | 0.15 |
| N/A | Hydroquinone oxidation/reduction p-benzoquinone + $2H^+$ + 2e ↔ hydroquinone | 0.699 |

Elimination of the inert anode may also be seen to reduce the generation of dissolved O2 in the plating solution. The aspects of the disclosed embodiment include use of inert anodes in anolytes substantially free of Sn(II) and isolated from the plating solution by a membrane, thus restricting dissolved oxygen formation to solutions where it has little effect. Sn(IV) formation via dissolved oxygen may be further reduced by allowing for a mechanism of actively excluding oxygen from the atmosphere. This can include N2, or other inert gas, sparging or blanketing; or solution degas to remove dissolved oxygen. In addition, anti-oxidant compounds may be included in Sn or SnAg bath formulations. For example, a typical anti-oxidant is hydroquinone. Such anti-oxidants may scavenge oxygen from the plating baths by being oxidized themselves and may then be regenerated at the plating piece. Use of an inert anode provides a pathway for anti-oxidant oxidation, reducing the amount of anti-oxidant available in the bath. Use of a soluble Sn anode may eliminate or reduce the amount of anti-oxidant oxidation at the anode, for example, e.g., see the standard potentials in table 1. To further reduce the chances of fouling at the anode, the anti-oxidants, or anti-oxidant containing components of a given plating formulation, may be added to the anolyte, thus protecting the anolyte as well as catholyte. This is possible to do in the Sn or SnAg chemistries, unlike in Cu applications, since the motivators leading to the use of a distinct anolyte are different than in the case of Cu where the purpose is not to reduce the consumption of organic additives at the anode. With Sn-containing plating formulations, the organic components typically do not degrade even at inert anodes; the lower anodic potentials typical of soluble anodes should then pose little or no concern as to additive stability. Also, inclusion of the organic components in the anolyte makes for more efficient cross-bleeding, since the cross-bleed solution will be nearer in composition to the receiving (plating) solution. In addition, as Sn(II) is stable at low pH, the acidity of the anolyte needs to be maintained. For example, a preferred acidity may be pH less than or equal to 1. In accordance with another aspect of the disclosed embodiment, any suitable fouling reduction may be used, for example, further mitigating Sn(IV) formation with the associated benefits to membrane fouling and process efficiency.

In the aspects of the disclosed embodiment shown, anolyte composition may also be managed. The adjustment and choice of anolyte may be selected for optimum performance of cells configured, for example, to use soluble Sn. There is some latitude in selecting an anolyte composition, but there are considerations dictating that choice. For example, one consideration as disclosed previously may be mitigating Sn(IV) formation with the associated benefits to membrane fouling and process efficiency. An additional consideration may be maximizing Sn transport efficiency across the membrane.

In the aspects of the disclosed embodiment shown, plating solution volume reduction may also be managed. In some aspects of the disclosed embodiment, the imperfect efficiency of Sn ion transport across the membrane may require that periodic adjustments be made to keep the respective solutions within required control limits. One approach may be to periodically cross-bleed small amounts of anolyte to the plating solution, with the plating solution then back-fed with appropriate material, for example, which may include water, acid, additives, anti-oxidants, or Sn concentrate or otherwise. Here, the anolyte to plating solution cross-bleed, while providing a means of controlling the concentration of selected bath components, can result in increased plating solution bath volume over time. While that additional bath volume can be controlled by adapting a bleed and feed strategy, such an approach may not be desirable in some cases, notably where the cost of the discarded chemistry is a concern. An alternative approach to mitigating bath volume is water extraction by ultrafiltration through a suitably selected membrane. An alternative approach to reducing plating solution volume buildup is by substantially eliminating the need for anolyte to plating solution cross bleeds through use of a replenishment booster module. Here, the booster module current can be adjusted to make up for the inefficiency of the Sn transport across the anolyte to plating solution membrane. In addition, since the replenishment module cathodic reaction is substantially acid consumption, the replenishment module may also serve to reduce the acid accumulation in the plating solution.

Although the aspects of the disclosed embodiment may be described with respect to SnAg plating, any suitable material may be used. For example, Cu or other suitable metal may be provided instead of SnAg. Here, changes may include the chemistries in each cell, the membrane material, the bleed-and-feed or other bath maintenance method or otherwise. Here, for Cu, the chemistries may be either sulfuric acid or methanesulfonic acid (MSA) based. An objective for Cu plating may be to keep the additives from contacting the anode, in order to reduce additive consumption and the formation of detrimental by-products. With Cu, oxidation and formation of metal oxides is not as much an issue as with SnAg, so anolyte maintenance may be somewhat simplified, although a high Cu/Acid ratio may be maintained in the anolyte to favor Cu transport and minimize cross-bleed. Here, the configurations may remain substantially the same, with the main modifications being in the chemistry and the nature of the soluble anode. Within the configurations described there is room to implement a number of chemistry management scenarios, for example, degree and frequency of cross-bleed, anolyte and catholyte bleed and feed, other dosing requirements, or otherwise where these may be dictated by the particular application and chemical package. Further, for Sn, the nature of operation is much the same as for SnAg. Here, where there is no Ag, the benefit of the disclosed aspects of the disclosed embodiment may be mainly in the reduction of Sn oxides where the need may not be as acute as for SnAg, since soluble Sn anodes are already used for Sn. For SnAg, the Sn chemistries may be any of the commercially available chemical packages, for example, MSA based or otherwise. Further, for Cu, there may be a benefit to moving the anode maintenance off-board as disclosed where the benefit may be predominantly in additive consumption, by-product minimization, bleed and feed reduction, and ease of maintenance, possibly eliminating on-tool anode changes and increasing availability.

The aspects of the disclosed embodiment may use a soluble Sn anode for SnAg plating. In accordance with another aspect of the disclosed embodiment, a soluble anode may be provided for any suitable plating material. Here, the use of a soluble Sn anode for SnAg plating poses potential benefits where implementation requires a separation of the Sn anode from the plating since Ag can plate out on Sn, with the separation via a membrane thus isolating the plating chemistry from anode. Further, a separate shear plate may be provided in a replenishment module. Further, the plating module (s) and/or replenishment module(s) may be N2 purged modules or otherwise isolated. Features of a soluble anode may include reduced formation of Sn(IV) resulting in lower particles, reduced fouling, and additional available Sn for plating. Here, lower anodic potentials reduce water oxidation as compared to use of an insoluble/inert anode and results in elimination of O2. Additional features of a soluble anode may include reduced anti-oxidant "consumption. Here, the standard potential of HQ (Hydroquinone being an anti oxidant example) may be more "anodic" than Sn(0)→Sn(II) but less anodic than water oxidation where the membrane reduces exposure of the plating bath to the anode. Additional features of a soluble anode may include savings in Sn replenishment costs where Sn replenishment may be Sn liquid solution high in Sn concentration. Additional features of a soluble anode may include reduction of a bleed requirement. For example, using a soluble Sn source, the plating bath volume does not build as rapidly as with a liquid Sn source. By way of further example, a better preserved bath may exhibit a longer life. Further, in some applications, decreased occurrence of unwanted anodic reactions may be provided.

Accumulation of Sn in anolyte may require cross-bleed of anolyte to catholyte where the anolyte may be back fed with acid, water, and possibly minor components, for example, additive, anti-oxidant or otherwise. Some electro-osmotic water transport of water across membrane, depending on membrane type, may occur. Here, water may transport from the anolyte to the plating solution, for example, at a rate ~1-2 ml/A*hr, depending on conditions. Here, volume accumulation can be mitigated by Water Extraction, Replenishment or otherwise. Here, although the description is particular to tin silver; the aspects of the disclosed embodiment may be used for other metals where Sn is exemplary.

In an aspect of the disclosed embodiment, an electro chemical deposition apparatus 800 deposits metal onto a surface of a substrate 820. The electro chemical deposition apparatus 800 has a frame 811 configured for holding a process electrolyte 818, 838. A substrate holder (see for example, holder 272 as previously described or holder 1320 below) is removably coupled to the frame 811, the substrate holder supporting the substrate 820 in the process electrolyte. A anode fluid compartment 828 is removably coupled to the frame 811 and defining a fluid boundary envelope containing an anolyte 812 in the frame, and separating the anolyte from the process electrolyte, the fluid compartment having within the boundary envelope an anode, 810 facing the surface of the substrate 820, and an ion exchange membrane, 814 disposed between the anode 810 and the surface of the substrate 820, the anode fluid compartment fluid boundary envelope being 828 removable from the frame 811 as a unit with the ion exchange membrane 814 and the anode 810, for example, as will be described with respect to FIGS. 12-19 or otherwise. The holder, the anode 810 and the membrane 814 are arranged in the frame 811 so that ions from the anode 810 pass through the ion exchange membrane 814 into and primarily replenish ions in the process electrolyte 818, 938 depleted by ion deposition onto the surface of the substrate 820. In another aspect, the surface of the substrate 820 is in a substantially vertical orientation. In another aspect, the process electrolyte 818, 938 comprises a SnAg or other suitable bath. In another aspect, the anode comprises a Sn or Cu or other suitable anode. In another aspect, the ion exchange membrane 814 separates the anolyte 812 from the process electrolyte 818, 938.

Figure 10:
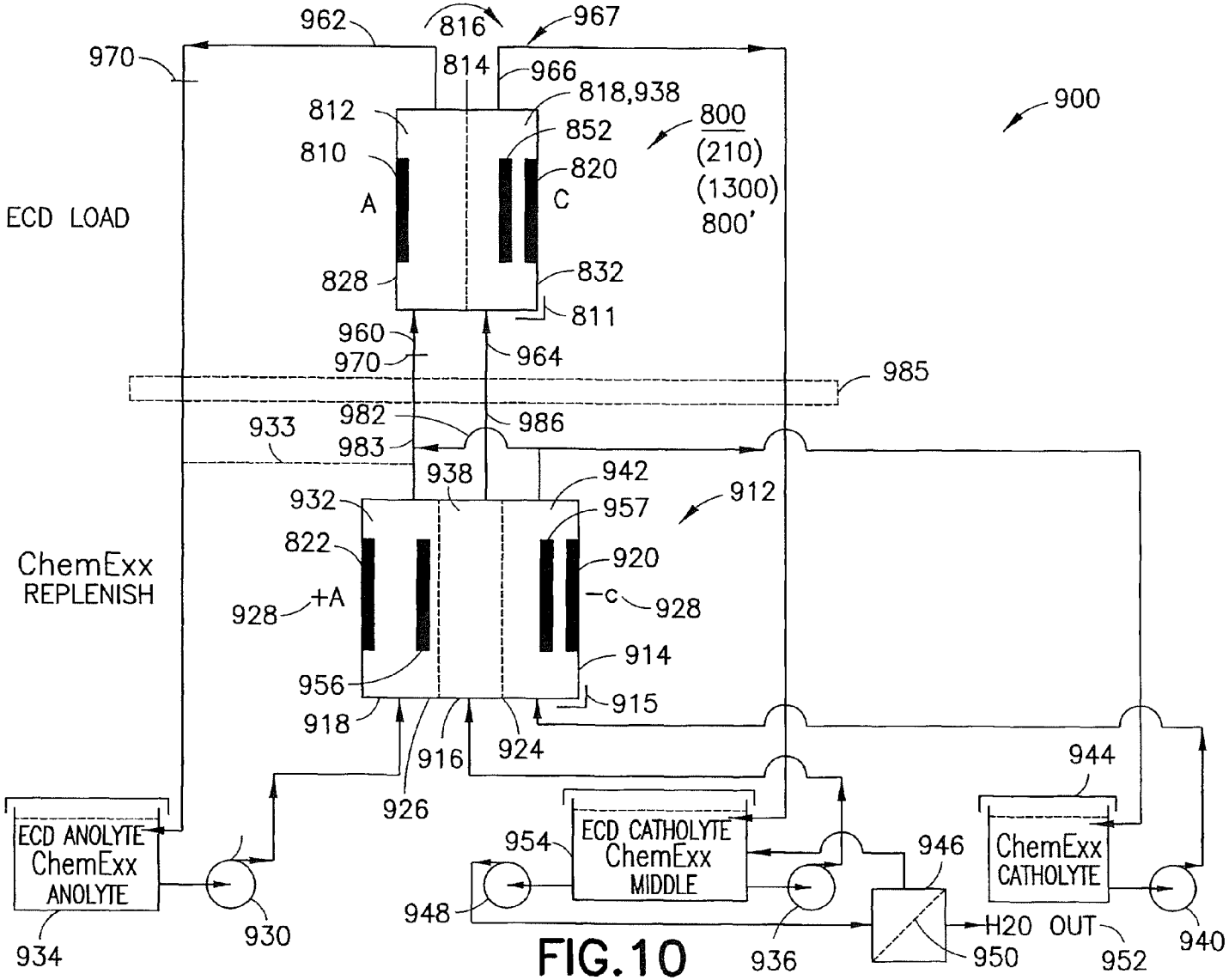
FIG. 10 shows a diagram of an electrochemical deposition system.

Referring now to FIG. 10, there is shown a diagram of an electrochemical deposition system 900 with an electro chemical deposition module 800 or 800' and with a replenishment module 912. In the aspects of the disclosed embodiment shown, replenishment module 912 may have features as previously described with respect to replenishment modules 260, 260' or otherwise. In the embodiment shown, replenishment module 912 may have secondary cathode compartment 914, plating solution replenishment channel or compartment 916, and secondary anode compartment 918. Secondary cathode compartment 914 may contain inert cathode 920. Secondary anode compartment 918 may contain soluble anode 922. Secondary cathode compartment 914 may be separated from plating solution replenishment channel or compartment 916 by membrane 924. Here, membrane 924 or replenishment module catholyte membrane 924 on the catholyte side may be CMX-S, manufactured by Asahi company of Japan and selective to cations, for example, where membrane 924 may be capable of differentiating between +1, +2 ions, by way of example, being a "single valent/monovalent selective membrane". Similarly, secondary anode compartment 918 may be separated from plating solution replenishment channel 916 by cationic membrane 926. Power source 928 may selectively provide bias between anode 922 and cathode 920. Pump 930 may circulate replenishment module anolyte 932 between secondary anode compartment 918 and anolyte reservoir 934, for example, where secondary anolyte compartment 918 is not connected to and bypasses 933 and is not connected to the deposition module 800 process anolyte compartment 828, for example, where anode compartment inlet and outlet 960, 962 are blocked. Pump 936 may recirculate plating solution 938 between plating solution replenishment channel or compartment 916 and process plating cell 800 and reservoir 954. Here, pump 936 may recirculate plating solution 938 between plating solution replenishment channel or compartment 916 and process plating cell 800 through plating compartment inlet and outlet 964, 966. Pump 940 may circulate replenishment module catholyte 942 between secondary cathode compartment 914 and catholyte reservoir 944. Water Extraction Unit 946 may be provided having circulation pump 948 and ultra-filtration or other similar membrane 950 where pressure across water selective membrane 950 allows for the selective extraction of water 952 where extraction is driven across membrane 950, which may be either of the size-exclusion or cationic types. Although the water extraction unit is shown with respect to reservoir 954 as exemplary, any suitable portion(s) of the system may utilize a water extraction unit or other suitable extraction unit as needed. One or more shear plate(s) 956 may be provided with respect to the membrane(s) 926, 924 or otherwise. Shear plate or agitation member 956, as previously described, is shown in anode compartment 932 for fluid agitation in close proximity to membrane 926 to prevent membrane fouling. Agitation member 956 may have features as previously described and may be provided additionally at any suitable anode, cathode or membrane surface. For example, an agitation member may be provided proximate soluble anode 922 to increase the transport of ions from the anode 922 thereby increasing the reaction rate. Alternately, no agitation member may be provided. Shear plate or agitation member 957 is shown in cathode compartment 942 for fluid agitation in close proximity to cathode 920. Agitation member 957 may have features as previously described and may be provided additionally at any suitable anode, cathode or membrane surface. Alternately, no agitation member may be provided. Agitation member 957 near cathode 920 sweeps away H2 and ensures that deposits of Sn that leak through membrane 924 are well adhered and dense. Here, if any Sn diffuses through the cationic membrane 924 it can deposit onto the cathode 920 where agitation 957 increases reaction rate and may ensure that such a deposition is compact with good adherence. Plating cell 800' may be provided as an alternative to cell 800, where cell 800' may also have either an inert non soluble anode or a soluble anode, a cathode wafer, shear or agitation plate, and power supply as previously described but with no ion exchange membrane, for example as described with respect to plating cell 210. Here, with cell 800', anode compartment inlet and outlet ports 960, 962 would be blocked 970 where deposition module 800 has no ion exchange membrane. Plating solution 938 is replenished 986 as previously described, for example utilizing pump 936 or otherwise exchanging fluids between the process electrolyte compartment and the replenishment compartment, for example, where alternately, a single bidirectional flow supply port may be provided instead of ports 964, 966. In another aspect of the disclosed embodiment, plating cell 800 has inert anode or soluble anode 810, distinct anolyte 812, membrane 814, cross bleed 816, wafer cathode 820 and shear plate 852. Plating solution 938 (818) is replenished as previously described and where the catholyte of replenishment module 800 may in addition be shared 982 with the anolyte of the ECD module 800. Line 982 shows a sharing of fluid between the cathode compartment of replenishment module 912 and the anode compartment of deposition module 800. Such sharing reduces the number of pumps and reservoirs required where fluid may be pumped in series, from a fluid tank through the two respective compartments. Alternately, the liquid may be pumped in parallel rather than series, for example, requiring additional lines, for example, parallel source and return lines to and from the deposition module and the replenishment unit, for example, where line 982 may be removed, but the effect of sharing fluid between the two compartments would remain. In each embodiment, replenishment cell 912 may act as the primary Sn source or may act as a supplementary or booster source. Here, replenishment module 912 allows for replenishment or rebalancing of a plating solution via exchange with two auxiliary solutions, an anolyte and catholyte. replenishment module catholyte may also be referred to as (CXC), replenishment module anolyte may also be referred to as (CXA), plating cell anolyte may be referred to as (PCA), and the plating solution or plating cell catholyte may be referred to as (PCC). Here, one aspect of the disclosed embodiment may involve the combining of the PCA and CXA into one solution. The replenishment module cell 912 may consist of three compartments. The compartments may be separated by appropriate membranes 924, 926. PCC may flow through the middle compartment 916 where current passes from the anolyte (CXA) to the catholyte (CXC) through the middle compartment 916. The proportion of the current carried by metal ions to that carried by H+ ions, depends on the membrane type and other conditions (concentrations, flow rate, membrane history, or otherwise). With proper selection of the CXA-PCC and PCC-CXC membranes, it is possible to selectively enrich the PCC in metal ion. As will be shown, replenishment module cell 912 is consistent with the flexibility of using either a soluble or an insoluble anode in the plating cell 800, 800' or when replenishing any suitable module. Replenishment module cell 912 may have a number of similarities with the plating cell, for example, both cells may have at least some similar reactions. The added reaction possible in the replenishment module cell 912, under some configurations, is the reduction of H+ ions to form hydrogen gas.

As previously described, system 900 provides for a Modified Cell 800 with a replenishment module 912 that may act as a booster module, for example where metal ions may be provided by both plating module 800 and replenishment module 912. Here, plating cell 800 may have a soluble anode, distinct anolyte, membrane and a cross bleed. Here, replenishment module 912 may be used as a secondary source or booster module with respect to plating cell 800 where module 912 anolyte may selectively be shared with the plating cell anolyte. As will be described, electro chemical deposition system 900 has module 912 that operates to supplement plating ions provided by deposition module 800, for example, where both deposition module 800 and replenishment module 912 may utilize soluble Sn, for example, each with a solid soluble Sn plate anode and/or anode pellets or otherwise. In this manner, replenishment module 912 acts as a secondary source of Sn or as a booster source of Sn with respect to deposition module 800. In alternate aspects of the disclosed embodiments, any suitable deposition metal or material may be provided, for example, Sn, SnAg, Cu or otherwise. The sharing may be continuous, intermittent or on an as needed basis. As seen, the plating cell is shown as a two-compartment cell, in accordance with another aspect of the disclosed embodiment, insoluble or soluble anode(s) may still be maintained. For example, both the plating cell 800 anode and the replenishment module 912 anode may be soluble. Additionally, the aspect of the disclosed embodiment shown does not preclude the possibility that some anolyte is also periodically bled 816 into the plating solution (PCC). In the aspects of the disclosed embodiment shown, replenishment module 912 may have features as previously described with respect to replenishment modules 260, 260' or otherwise. In other aspects of the disclosed embodiment shown, replenishment module 912 may have features as described with respect to modules 1500 as will be described. Further, in the aspects of the disclosed embodiment shown, deposition module 800 may have features as described and as will be described, for example, having an ion exchange membrane or with no ion exchange membrane. In accordance with one aspect of the disclosed embodiment, replenishment module 912 may have secondary cathode compartment 914, plating solution replenishment channel 916, and secondary anode compartment 918. Secondary cathode compartment 914 may contain inert cathode 920. Secondary anode compartment 918 may contain soluble or insoluble anode 922. Secondary cathode compartment 914 may be separated from plating solution replenishment channel 916 by membrane 924, for example, a monovalent selective membrane. Similarly, secondary anode compartment 918 may be separated from plating solution replenishment channel 916 by cationic membrane 926. Power source 928 may selectively provide bias between anode 922 and cathode 920. Pump 930 may circulate shared anolyte 932 between secondary anode compartment 918, deposition anode compartment 828 and anolyte reservoir 834. Pump 836 may recirculate plating solution 838 between plating solution replenishment channel 916 and deposition cathode compartment 832 and reservoir 954. Pump 940 may circulate replenishment module catholyte 942 between secondary cathode compartment 914 and catholyte reservoir 944. Water Extraction Unit 946 may be provided having circulation pump 948 and ultra-filtration or other similar membrane 950 where pressure across water selective membrane 950 allows for the selective extraction of water 952 where extraction is driven across size-exclusion membrane 950. Although the water extraction unit is shown with respect to reservoir 954 as exemplary, any suitable portion(s) of the system may utilize a water extraction unit or other suitable extraction unit as needed. One or more shear or agitation plate(s) 956 may be provided with respect to the membrane(s) 926, 924 or otherwise. Plating cell 910 has soluble anode 810, shared anolyte 812 in compartment 828, membrane 814, cross bleed 816, wafer cathode 820 and shear or agitation plate 852. Plating solution 938 may be replenished 986 as previously described and where the anolyte of replenishment module 912 may in addition be shared with the anolyte of the ECD module 800. Line 983 shows a sharing of the anolyte between the anode compartment of replenishment module 912 and the anode compartment of deposition module 800. Such sharing reduces the number of pumps and reservoirs required where fluid may be pumped in series, from the anolyte tank through the two respective anolyte compartments. Alternately, the liquid may be pumped in parallel rather than series, for example, requiring additional lines, for example, parallel source and return lines to and from the deposition module and the replenishment unit, for example, where line 983 may be removed, but the effect of sharing fluid between the two compartments would remain. In the embodiment shown, replenishment cell 912 acts as a secondary or booster Sn source selectively replenishing either continuously, intermittently or on an as needed basis. Further, solution 938 may be replenished 967 with Ag salts, MAS or other suitable additives as required. Further, solution may be replenished 982, for example, with anti oxidants, H2O or otherwise from chamber 914 or otherwise. Line 982 shows a sharing of fluid between the cathode compartment of replenishment module 912 and the anode compartment of deposition module 800. Such sharing reduces the number of pumps and reservoirs required where fluid may be pumped in series, from a fluid tank through the two respective compartments. Alternately, the liquid may be pumped in parallel rather than series, for example, requiring additional lines, for example, parallel source and return lines to and from the deposition module and the replenishment unit, for example, where line 982 may be removed, but the effect of sharing fluid between the two compartments would remain. Here, replenishment module 912 allows for supplementary replenishment or rebalancing of a plating solution via exchange with two auxiliary solutions, an anolyte and catholyte. In the exemplary embodiment, electro chemical deposition apparatus 900 may be provided adapted to deposit Sn or Sn alloy onto a surface of a substrate 820 in a configurable fashion. Here, electro chemical deposition apparatus 900 has a deposition module 800 having a deposition module frame 811 configured to hold a process electrolyte 938. As previously described, a substrate holder may be removably coupled to the deposition module frame 811, the substrate holder supporting the substrate 820 with the process electrolyte 938 contacting the surface of the substrate 820, the substrate acting as a first cathode. A first soluble anode 810 is coupled to the deposition module frame 811. The deposition module 800 has a configurable process electrolyte replenishment module interface port 985 configured in a first configuration, for example, as seen in FIG. 10 to interface with a process electrolyte replenishment module 912 and configured in a second configuration, for example, as seen in FIG. 9 to not interface with process electrolyte replenishment module 912 so that the process electrolyte replenishment module 912 is not a portion of the electro chemical deposition apparatus 900. The process electrolyte replenishment module 912 is adapted to replenish ions in the process electrolyte 938 with the process electrolyte replenishment module 912 having a replenishment module frame 915 offset from the deposition module 800. A process electrolyte recirculation compartment 916 is disposed in the replenishment module frame 915 configured so that the process electrolyte 938 is recirculating between the replenishment module 912 and the deposition module 800. An anode compartment 918 in the replenishment module frame 915 is coupled to the process electrolyte recirculation compartment 916, the anode compartment 918 having a second soluble anode 922, disposed therein for immersion in a secondary anolyte 932, and having a first ion exchange membrane 926 separating the secondary anolyte 932 from the process electrolyte. A cathode compartment 914 in the replenishment module frame is coupled to the process electrolyte recirculation compartment 916, the cathode compartment 914 having a second cathode 920 disposed therein for immersion in a secondary catholyte 942, and having a second ion exchange membrane 924 separating the secondary catholyte 942 from the process electrolyte 938. Both the first soluble anode 810 and the second soluble anode 922 replenish ions in the process electrolyte 938 depleted by ion deposition onto the surface in the first configuration. The first soluble anode 810 replenishes ions in the process electrolyte 938 depleted by ion deposition onto the surface in the second configuration. In another aspect of the disclosed embodiment, an electro chemical deposition apparatus 900 is provided where the configurable process electrolyte replenishment module interface port 985 comprises a process electrolyte inlet port 964 and a process electrolyte outlet port 966 in fluid communication with the deposition module frame 811, the process electrolyte inlet port 964 and the process electrolyte outlet port 965 coupled in fluid communication with the replenishment module 912 in the first configuration and with the process electrolyte inlet port 964 and the process electrolyte outlet port 965 blocked or not in fluid communication with the replenishment module 912 when in the second configuration. Here, for example, in the second configuration, replenishment module interface port 985 may be coupled as shown in FIG. 9. In another aspect of the disclosed embodiment, more or less features may be provided. For example, configurable process electrolyte replenishment module interface port 985 may have a single or multiple dedicated port(s) for configurably coupling or not to replenishment module 912 or alternately may be configurably coupled to a replenishment module and/or a circulation tank or otherwise.

In an aspect of the disclosed embodiment a process electrolyte replenishment module 912 replenishes ions in a process electrolyte 938 in a substrate electro chemical deposition apparatus 800 having a first anode 810 and a first cathode 820, the replenishment module having a second anode 922. The process electrolyte replenishment module 912 has a frame 915 offset from the chemical deposition apparatus 800. A process electrolyte recirculation compartment 916 is disposed in the frame 915 configured so that the process electrolyte 938 is recirculating between the replenishment module 912 and the deposition apparatus 800. An anode compartment 918 in the frame 915 is coupled to the process electrolyte recirculation compartment 916, the anode compartment 918 having the second anode 922, that is a soluble anode, disposed therein for immersion in a secondary anolyte 932, and having a first ion exchange membrane 926 separating the secondary anolyte 932 from the process electrolyte 938, the first ion exchange membrane 926 being a cationic membrane. A cathode compartment 914 is provided in the frame 915 coupled to the process electrolyte recirculation compartment 916, the cathode compartment 914 having a second cathode 920 disposed therein for immersion in a secondary catholyte 942, and having a second ion exchange membrane 924 separating the secondary catholyte 942 from the process electrolyte 938, the second ion exchange membrane 924 being a monovalent selective membrane. In another aspect, an agitation member 957 is moveably coupled to the frame 915 in the cathode compartment 914 in close proximity to the second cathode 920 to agitate the secondary catholyte 942 proximate the second cathode 920. In another aspect, the soluble second anode 922 and the first ion exchange membrane 926 are arranged so that ions from the soluble second anode 922 pass through the first ion exchange membrane 926 into the process electrolyte 938. In another aspect, the process electrolyte 938 comprises a SnAg bath, and wherein ions are replenished in the process electrolyte 938 without Ag contamination of the second anode 922.

Figure 11:
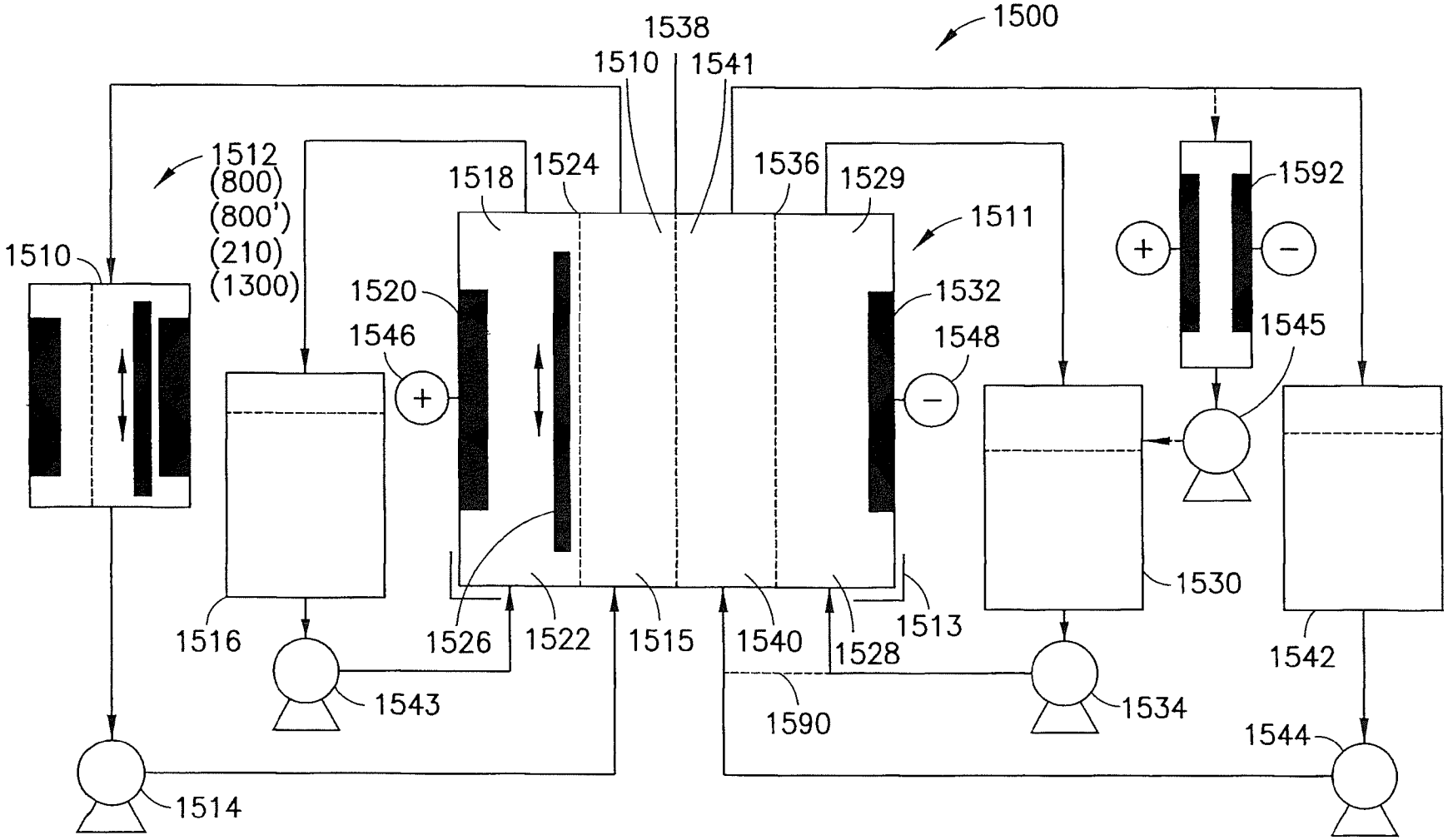
FIG. 11 shows a diagram of an electrochemical deposition system.

Referring now to FIG. 11, there is shown a diagram of electro chemical deposition apparatus 1500. Electro chemical deposition apparatus 1500 may be adapted to deposit Sn or Sn alloy onto a surface of a substrate. Alternately, any suitable metal may be deposited. Electro chemical deposition apparatus 1500 has a deposition module 1512 that may have features as previously described. For example, deposition module 1512 may have a deposition module frame or tank 1512 configured to hold a process electrolyte 1510. Further, deposition module 1512 may have a substrate holder as previously described removably coupled to the deposition module frame, the substrate holder supporting the substrate with the process electrolyte 1510 contacting the surface of the substrate and with the substrate acting as a first cathode. Further, deposition module 1512 may have a first soluble anode coupled to the deposition module frame as previously described. System 1500 further has process electrolyte replenishment module 1511 adapted to replenish ions in process electrolyte 1510. Here, process electrolyte replenishment module 1511 is shown having a replenishment module frame 1513 offset from deposition module 1512. Process electrolyte recirculation compartment 1515 is shown disposed in the replenishment module frame 1513 and configured so that the process electrolyte 1510 is recirculating between the replenishment module 1511 and the deposition module 1512, for example via pump 1514 or otherwise. Anode compartment 1522 is shown in the replenishment module frame 1513 coupled to the process electrolyte recirculation compartment 1515. Here, anode compartment 1522 has a second soluble anode 1520, disposed therein for immersion in a secondary anolyte 1518. First ion exchange membrane 1524, for example, a cationic membrane, is shown separating the secondary anolyte 1518 from the process electrolyte 1510. Shear plate or agitation member 1526 is shown in anode compartment 1522 for fluid agitation in close proximity to membrane 1524. Agitation member 1526 may have features as previously described and may be provided additionally at any suitable anode, cathode or membrane surface. Alternately, no agitation member may be provided. Tank 1516 and pump 1543 are shown for circulation of secondary anolyte 1518. Buffer compartment 1540 is shown in the replenishment module frame 1513 coupled to the process electrolyte recirculation compartment 1515. Here, buffer compartment 1540 has a buffer solution 1541 therein, and a second ion exchange membrane 1538, for example, a monovalent selective membrane, separating the buffer solution from the process electrolyte 1510. Tank 1542 and pump 1544 are shown for circulation of buffer solution 1541. Cathode compartment 1528 is shown in replenishment module frame 1513 coupled to buffer compartment 1540. Here, cathode compartment 1528 has a second cathode 1532 disposed therein for immersion in a secondary catholyte 1529. Cathode compartment 1528 has third ion exchange membrane 1536, for example, a monovalent selective membrane, separating the secondary catholyte 1529 from the buffer solution 1541. Tank 1530 and pump 1534 are shown for circulation of secondary catholyte solution 1529. Buffer solution 1541 may be MSA controlled so that Sn level remains below a threshold. Further, Buffer solution 1541 and secondary catholyte 1529 may be initially similar or identical, and subsequently similar or identical except for low levels of Sn. Positive 1546 and negative 1548 terminals may be connected to secondary anode 1520 and secondary cathode 1532 respectively to provide ions from secondary soluble anode 1520 through cationic membrane 1524 into process electrolyte 1510. In practical terms, membrane selectivity may not be perfect, for example, as 4-5% of the current through membrane 1538 may be Sn ions, with the remainder H+ ions. In the exemplary embodiment, the amount of Sn transferred to the secondary catholyte 1529 may be maintained at a low level by the additional buffer chamber 1540 to substantially eliminate deposits of Sn onto secondary cathode 1532 to extend lifetime. With the addition of buffer chamber 1540, the fraction of Sn that enters the buffer chamber 1540 through membrane 1538 may still be 4-5% or otherwise but these ions can be prevented from transporting to cathode chamber 1528 by use of separate tank 1542 to hold buffer solution 1541, which may be bled from time to time to maintain a low Sn concentration. In the exemplary embodiment, both the first soluble anode in deposition module 1512 and the second soluble anode 1520 replenish ions in the process electrolyte depleted by ion deposition onto the surface of the substrate. In alternate embodiments, replenishment module 1511 may be used as a primary ion source. In alternate aspects of the disclosed embodiment, any suitable deposition metal may be provided. In another aspect of the disclosed embodiment, tank 1542 and pump may not be provided where as a supplement or instead, ion removal cell 1592 is shown coupled to buffer compartment 1540 where buffer solution 1541 from the buffer compartment 1540 is recirculated via pumping 1545 through ion removal cell 1592 with the ion removal cell 1592 removing unwanted ions from the buffer solution 1591. Here, scrubber cell 1592 is provided to remove Sn ions from the buffer cell 1590. An suitable example of a "scrubber" cell 1592 is the RenoCell available from Renovare Co of Lancaster, N.Y. In an aspect of the disclosed embodiment, for example, scrubber cell 1592, buffer chamber 1540 and cathode chamber 1528 share 1590 solution with the buffer chamber solution 1541 scrubbed in the scrubbing cell 1592 prior to return to a common catholyte reservoir 1530 where the common catholyte is returned 1590 to both chambers 1540, 1528 via pump 1534. In alternate aspects of the disclosed embodiment, any suitable deposition metal may be provided.

Figure 12:
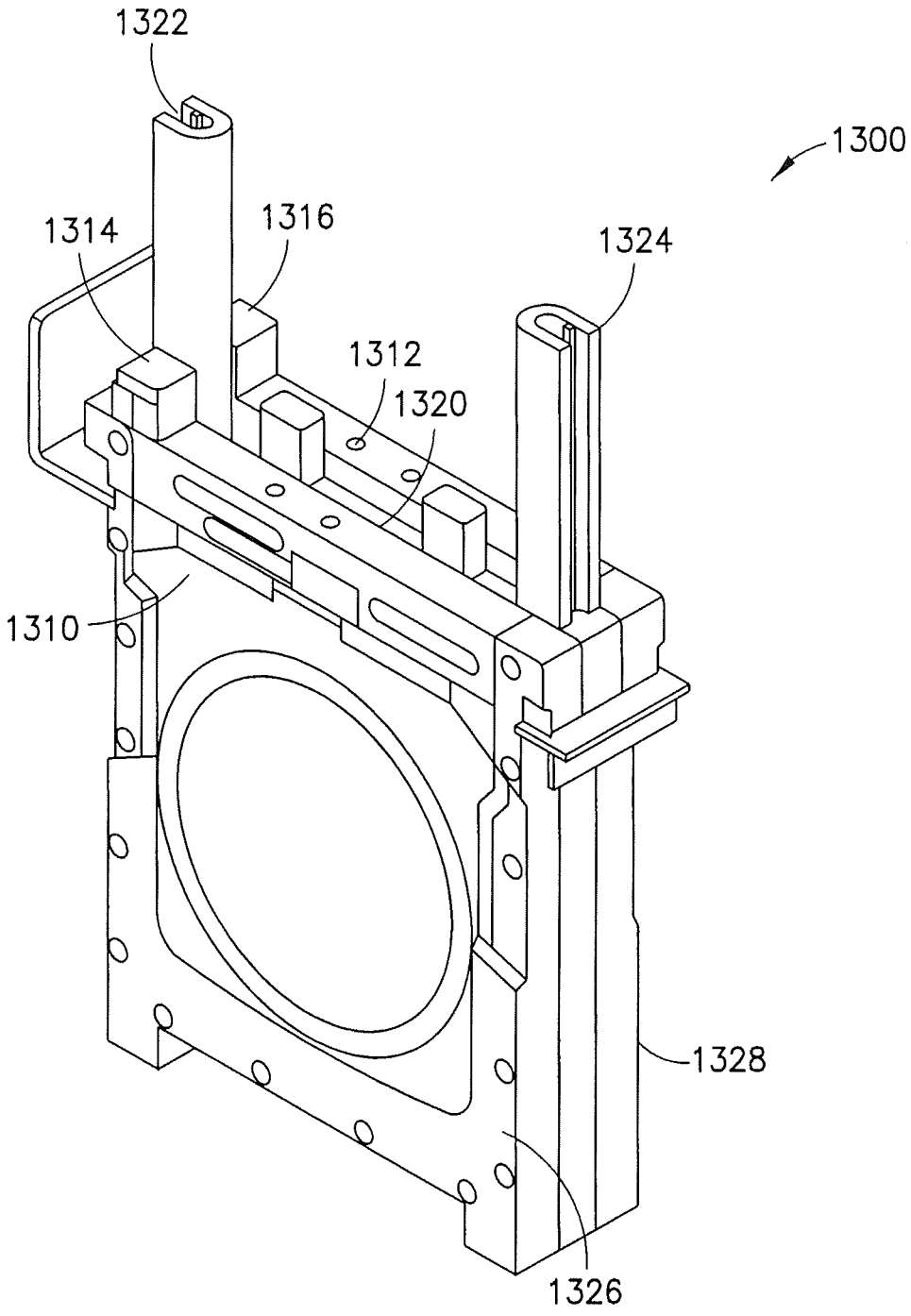
FIG. 12 shows an isometric view of a plating cell.
Figure 13:
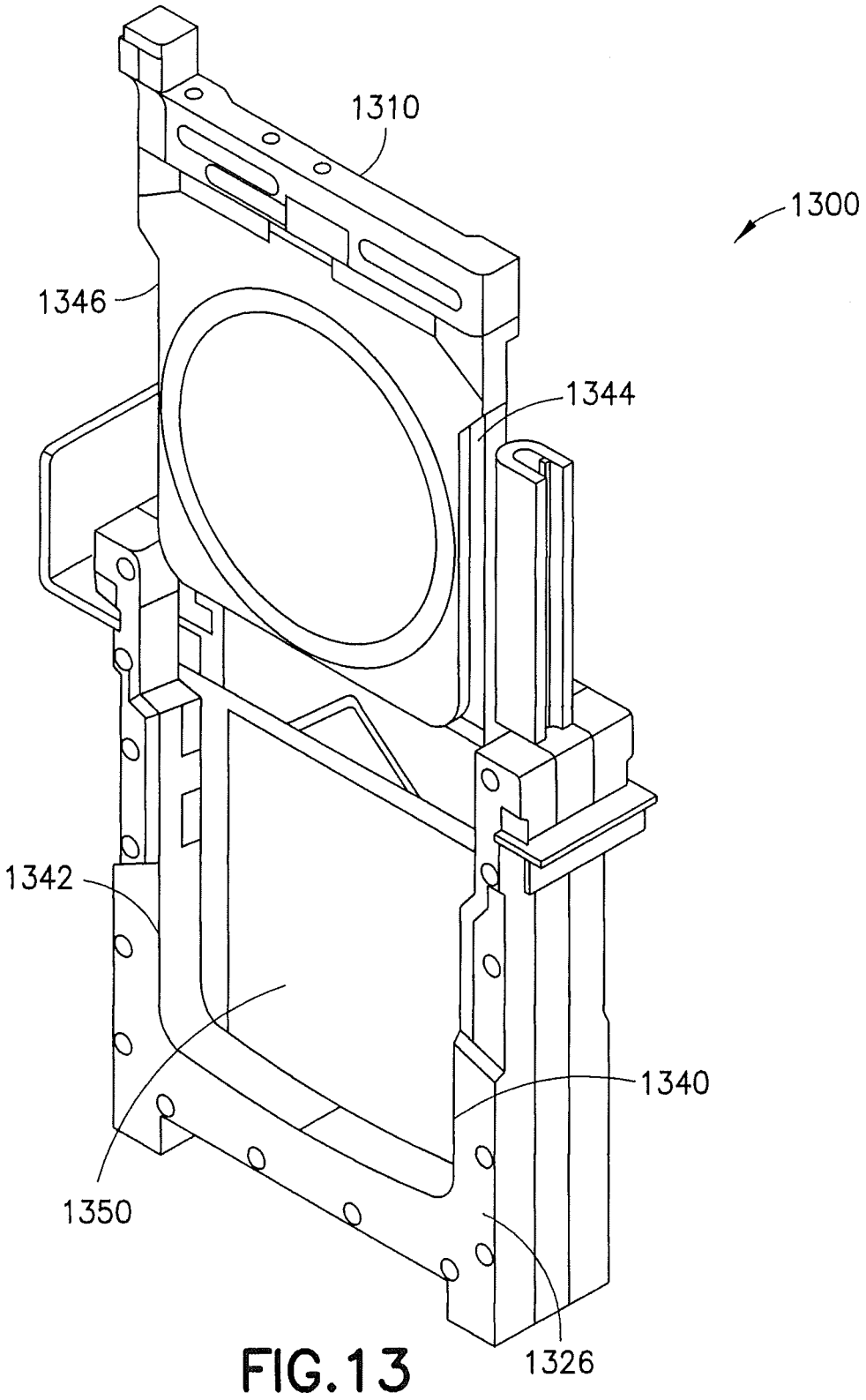
FIG. 13 shows an isometric view of a plating cell.
Figure 14:
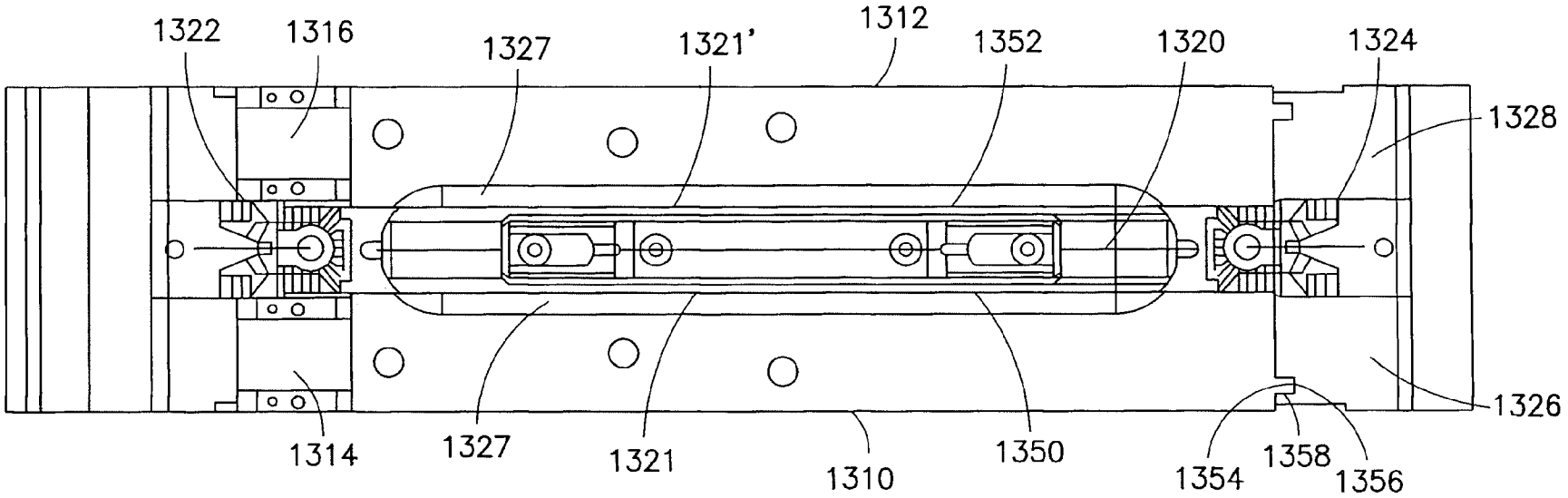
FIG. 14 shows a top view of a plating cell.

Referring now to FIG. 12, there is shown an isometric view of deposition module or plating cell 1300. Deposition module 1300 may have features that may be utilized within previously described deposition modules or plating cells 210, 212, 214, 216, 800, 800' or other suitable modules. For example, deposition module 1300 may be used in conjunction with or without a replenishment module. Deposition module 1300 is shown and will be described with respect to a double sided wafer or substrate holder that holds two substrate 1321, 1321' substrate cathodes. Alternately, the features of deposition module 1300 may be used in conjunction with a single or other suitable wafer holder. Further, the features of deposition modules or plating cells 210, 212, 214, 216, 800, 910, 910', 1010, 1300 may be utilized in either single wafer, double wafer or other suitable plating cells. Plating cell 1300 has an anode that may be either soluble or insoluble. Insoluble anodes are also known as inert, and the terms are used herein interchangeably. For example, the anode may be a soluble Sn anode or any suitable soluble or insoluble anode may be used. Deposition or plating module or cell 1300 is shown as a compact cell for vertical plating having independent anolyte and catholyte compartments and for plating two substrates. Deposition or plating module or cell 1300 is shown having first and second anode inserts 1310, 1312 each having anolyte supply and return ports 1314, 1316. Wafer holder 1320 is shown disposed between first and second anode inserts 1310, 1312 in a process electrolyte 1327. Linear motors 1322, 1324 are shown disposed on opposing sides of holder 1320 and are provided for driving shear plates proximate the surfaces of the wafers held by holder 1320. As will be described in greater detail, first and second anode inserts 1310, 1312 each contain an anode and a supported membrane. As will be described in greater detail, first and second anode inserts 1310, 1312 are removably retained within anode insert guides 1326, 1328 which facilitate removal of first and second anode inserts 1310, 1312, for example, for service of the anode, membrane or otherwise. Referring also to FIG. 13, there is shown an isometric view of plating cell 1300. As seen, first anode insert 1310 is shown vertically removable from anode insert guide 1326. Here, tapered supported sides 1340, 1342 receive mating tapered sides 1344, 1346 of insert 1310. As will be described, the tapered support sides also provide a sealing surface with easy removal of anode insert 1310. As shown, cell 1300 has an easily removable anode holder with membrane supports facilitating easy servicing with separable anode inserts 1310, 1312 which lifts from cell frame 1326, 1328. Here, anode insert 1312 and cell frame 1328 may have similar features as shown with respect to anode insert 1310 and cell frame 1326. Referring also to FIG. 14, there is shown a top view of plating cell 1300. Here, plating module or cell 1300 is shown having first and second anode inserts 1310, 1312. Wafer holder 1320 is shown disposed between first and second anode inserts 1310, 1312. Linear motors 1322, 1324 are shown disposed on opposing sides of holder 1320 and are provided for driving shear plates 1350, 1352 proximate the surfaces of the wafers held by holder 1320. Fluid, pneumatic and electrical connections 1314, 1316 are also shown. Here, flange 1354 of insert 1310 engages a mating recess 1356 in frame 1326 the entire length of the mating interface between insert 1310 and frame 1326. Seal 1358 is also disposed between flange 1354 of insert 1310 and mating recess 1356 in frame 1326 the entire length of the mating interface between insert 1310 and frame 1326. Here, anode insert 1312 and cell frame 1328 may also have similar features as shown with respect to anode insert 1310 and cell frame 1326. Disassembly of anode insert 1310 from cell frame 1326 involves draining anolyte fluid, removing interfacing fasteners and sliding anode insert 1310 up as seen in FIG. 13. Here, tapered slides 1344, 1346 allow easy removal and prevent the need to slide assembly against the restraining friction of an o-ring seal as contact with o-ring seal 1358 and mating recess 1356 may be only at the lower portion of engagement, for example, 15% or otherwise of the total height of insert 1310 as it engages recess 1356 when the lower portion of insert is toward the bottom of frame 1326. Here, anode insert 1310 has perimeter seal 1356 between flange 1358 and mating recess 1356 being a tapered seal engagement for ease of disassembly. In another aspect of the disclosed embodiment, any suitable mating features may be provided.

Figure 15:
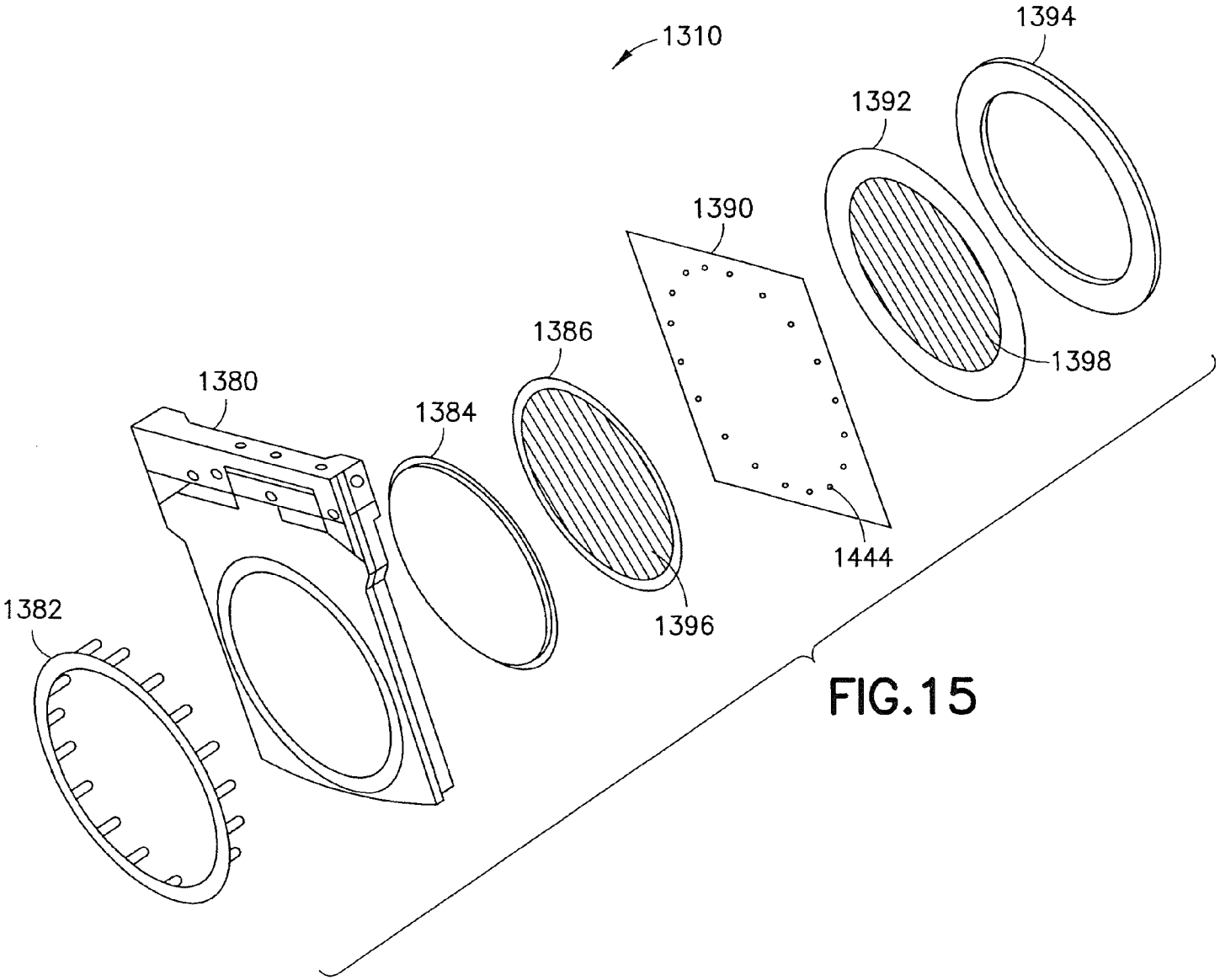
FIG. 15 shows an exploded view of an anode insert.
Figure 16:
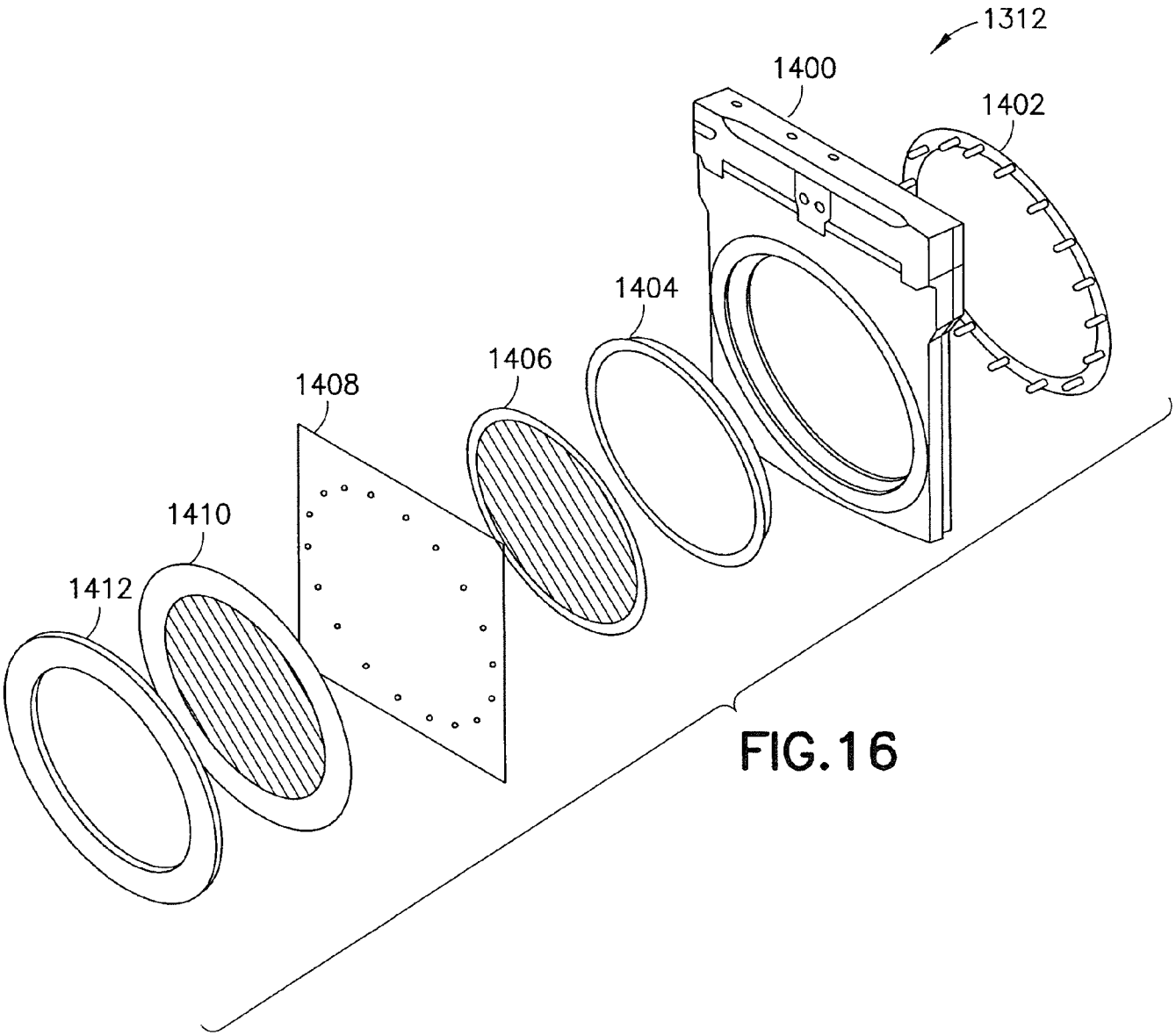
FIG. 16 shows an exploded view of an anode insert.
Figure 17:
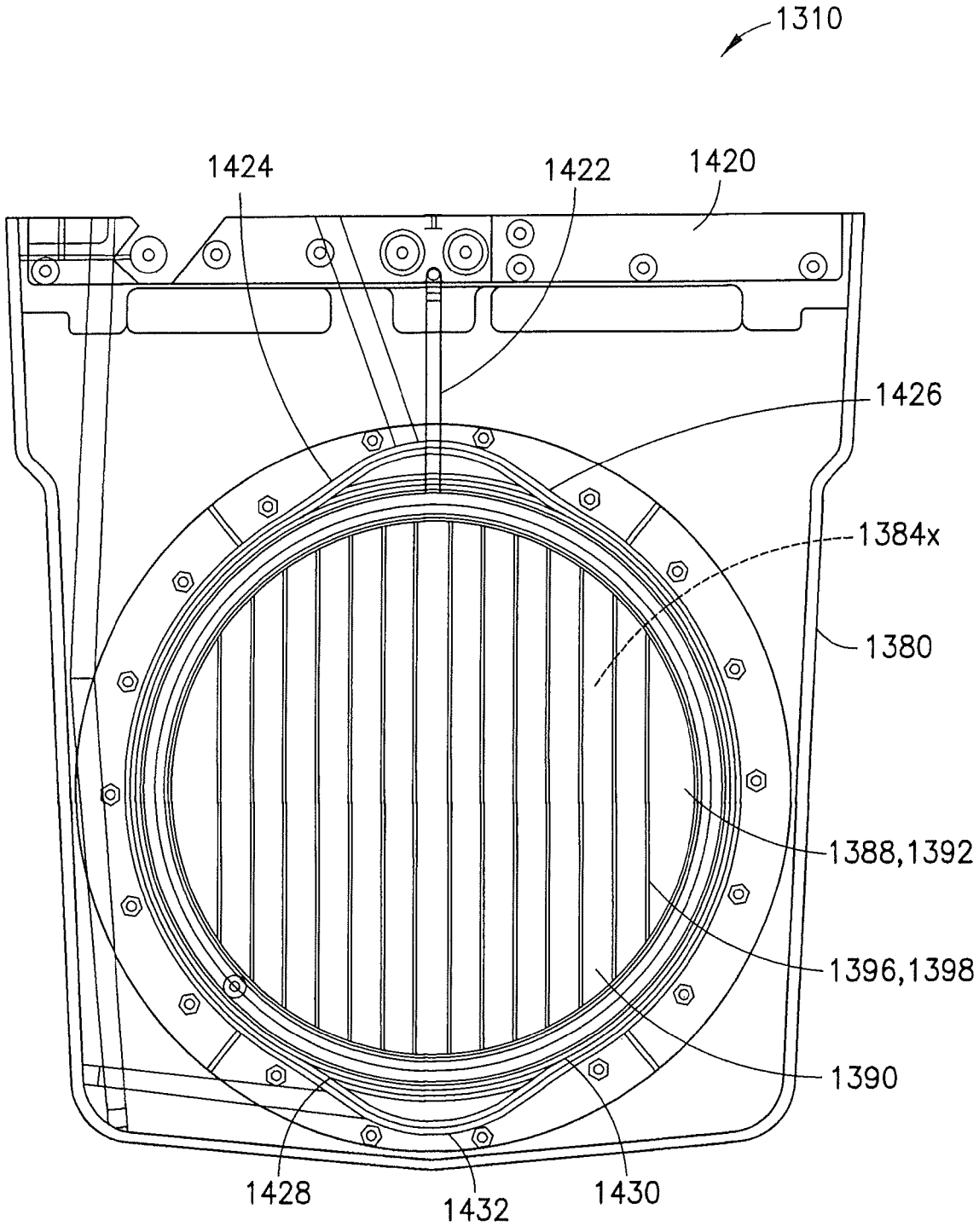
FIG. 17 shows a side view of an anode insert.
Figure 18:
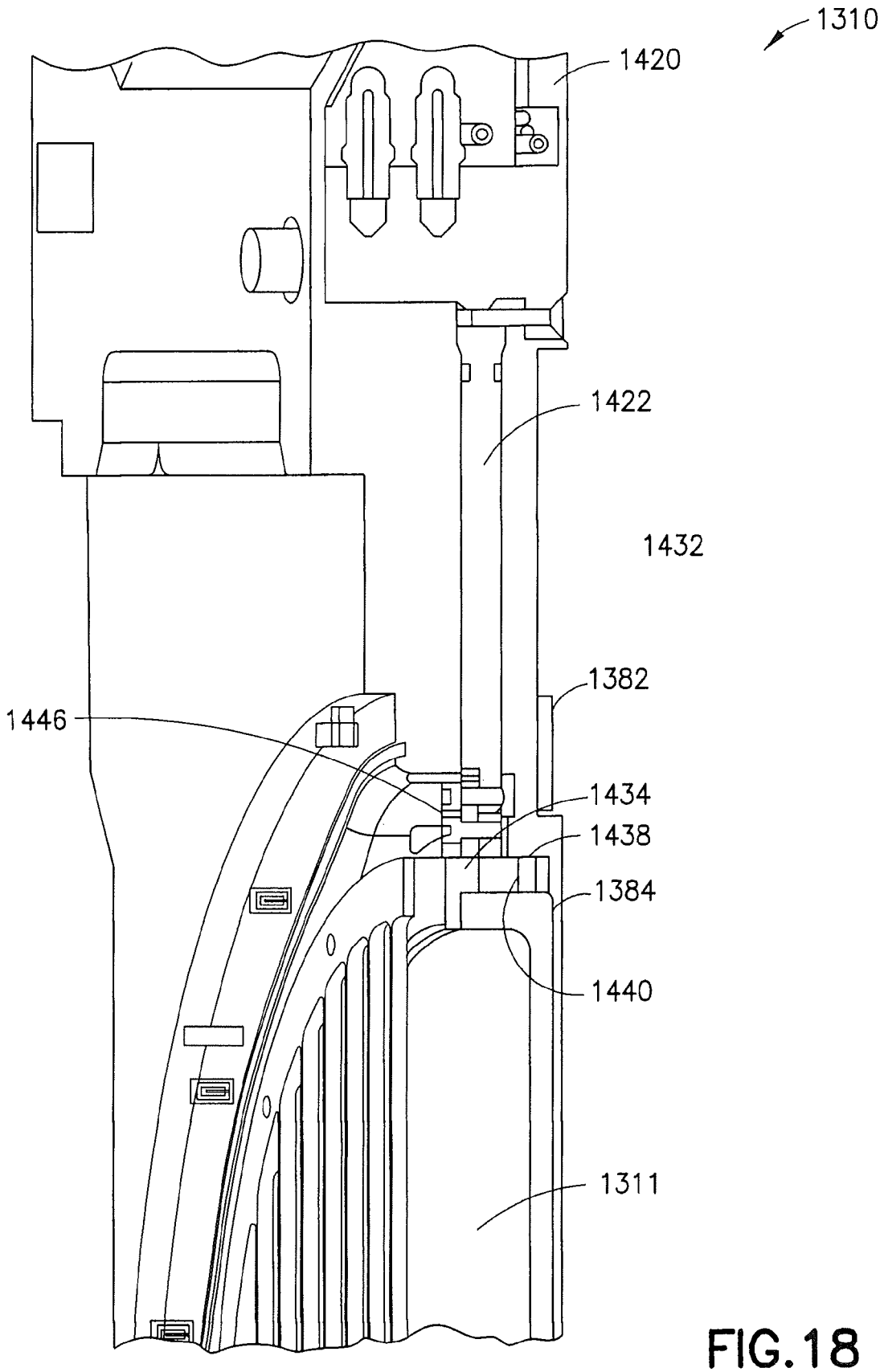
FIG. 18 shows a section view of an anode insert.
Figure 19:
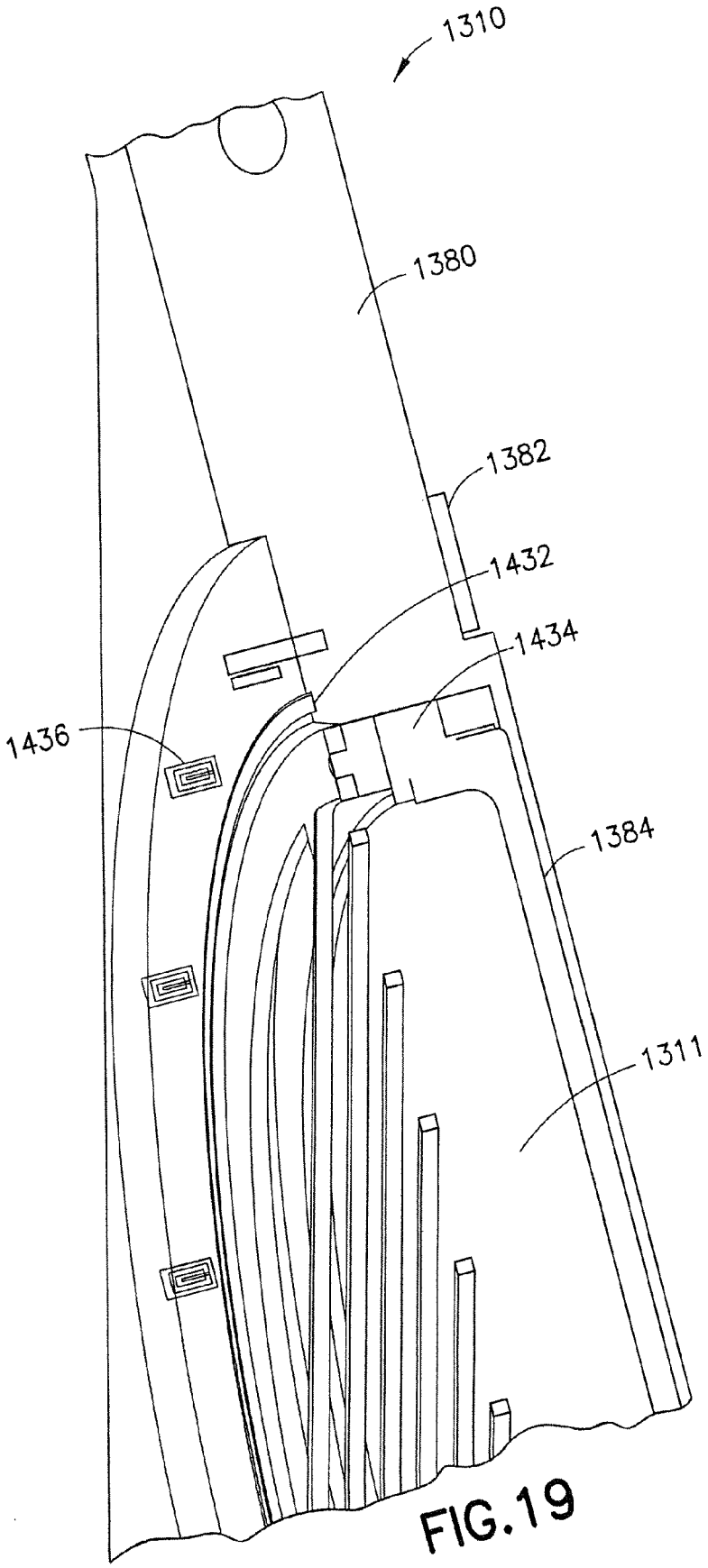
FIG. 19 shows a section view of an anode insert.

Referring now to FIG. 15, there is shown an exploded view of anode insert module 1310. As seen, the exploded view of left anode insert 1310 shows 7 main components. Anode insert body or module frame 1380 houses segmented stud assembly or support ring 1382, anode 1384, back-side membrane support 1386, membrane 1390, front-side membrane support 1392 and electrical shaping shield 1394. Electrical shaping shield 1394 may have features as disclosed in U.S. patent application Ser. No. 10/971,726 filed on Oct. 22, 2004 and entitled "Method and Apparatus for Fluid Processing a Work Piece" which is hereby incorporated by reference in its entirety and as disclosed in Attorney Docket No.: 1146P013798-US(I01), Ser. No. 13/444,570, filed Apr. 11, 2012 and is incorporated by reference in it's entirety. Membrane supports 1386, 1392 which will be shown in greater detail may be single-piece Ti water-jet cut circular plates with minimal contact to membrane 1390 with support for maximal active membrane area. Here, vertical bars also prevent bubble entrapment which can lead to non-uniform deposition. Referring also to FIG. 16, there is shown an exploded view of anode insert module 1312 with features similar to that of insert 1310. As seen, the exploded view of right anode insert 1312 shows 7 main components. Anode insert body or module frame 1400 houses segmented stud assembly or support ring 1402, anode 1404, back-side membrane support 1406, membrane 11408, front-side membrane support 1410 and electrical shaping shield 1412. Referring also to FIG. 17, there is shown a side view of anode insert 1310. Here anode insert 1310 forms a compartment holding anolyte 1311 where ion exchange membrane 1390 separates anolyte 1311 Insert 1310 is shown further having anode connected to anode bus 1420, via anode electrical connection 1422. Backside membrane support 1386 may have anti rotation features 1424, 1426, 1428, 1430, for example, fingers that mate with mating recesses in insert body 1380. Alternately, any suitable auto rotation features may be provided. Similarly, frontside membrane support 1392 may also have anti rotation features such that vertical bars 1396, 1398 align precisely to provide for maximal membrane area, prevention of bubble entrapment, and uniform deposition, for example, without patterns. Here, the vertical bar alignment and membrane support is shown self aligning requiring no retaining bolts. O-ring fluid seal 1432 in insert body 1380 seals against membrane 1390 to prevent fluid migration between the anolyte compartment containing anode 1384 and the catholite compartment containing the wafer. Referring also to FIG. 18, there is shown a partial section view of anode insert 1310. Referring also to FIG. 19, there is shown a partial section view of anode insert 1310. Rubber perimeter seal 1434 may be disposed between anode 1384 and membrane support 1396. Further, an additional seal may be provided between body 1380 and segmented stud ring 1382. Seal ring 1438 may be provided with seal 1440 between ring 1438 and body 1380 and may interface with perimeter seal 1434 and act as a centering device for anode 1384. Segmented stud ring 1382 may have captive threaded studs 1436 that protrude through body 1380 and acts as a multi-purpose segmented ring to support membrane 1390, anode ring 1384, front and back membrane supports 1386, 1392 and electrical field-shaping shield 1394. Once the anode insert assembly 1310 is removed from plating cell 1300, access to serviceable components therein may be done on a bench or otherwise as follows: 1. Place anode assembly on a bench for access to membrane 1390 and anode 1384. 2. Remove the electrical field shaping shield 1394 by removing nuts from threaded fasteners 1436. 3. Remove the front side membrane support 1392. 4. Remove membrane 1390 and replace as needed. Here, membrane 1390 may be a water-jet cut assembly with holes 1444 in locations corresponding to the bolt pattern os studs 1436 in segmented ring 1382. 5. Remove backside membrane 1386 support if access to anode required. 6. Remove anode 1384 by loosening and removing rubber perimeter seal 1438, and then removing anode terminal screws 1446. 7. Clean or replace membrane and anode as required. 8. Reassemble in opposite order. Alternately, more or less steps may be provided.

In an aspect of the disclosed embodiment, an electro chemical deposition apparatus 1300 deposits a metal onto a surface of a substrate 1321. The electro chemical deposition apparatus 1300 has a frame 1326 configured for holding a process electrolyte 1327. A substrate holder 1320 is coupled to the frame 1326, the substrate holder 1320 supporting the substrate 1321 so that the process electrolyte 1327 contacts the surface of substrate 1321. An anode 1384 is coupled to the frame 1326 in a anolyte 1311, and an ion exchange membrane 1390 is coupled to the frame 1326 so that the ion exchange membrane 1390 separates the anolyte 1311 from the process electrolyte 1327. The ion exchange membrane 1390 is supported on a first side by a first membrane support 1386 coupled to the frame 1326 and having a plurality of first arrayed supports 1396. The ion exchange membrane 1390 is supported on a second side by a second membrane support 1392 coupled to the frame 1326 and having a plurality of second arrayed supports 1398 substantially aligned with the plurality of first arrayed supports 1396. In another aspect, the plurality of first arrayed supports 1396 comprises a first array of vertical bars, and where the plurality of second arrayed supports 1398 comprises a second array of vertical bars, and wherein the first arrayed vertical bars are substantially aligned with the second arrayed vertical bars. In another aspect, the substrate holder 1320, the anode 1384 and the ion exchange membrane 1390 are arranged in the frame 1326 so that metal ions pass through the ion exchange membrane 1390 into the process electrolyte 1327 replenishing metal ions depleted by deposition onto the substrate 1321 and wherein the first and second arrayed supports 1396, 1398 have a configuration that prevents bubble entrapment. In another aspect, the surface of the substrate 1321 is in a substantially vertical orientation.

In an aspect of the disclosed embodiment, an electro chemical deposition apparatus 1300 is provided adapted to deposit a metal onto a surface of a substrate 1321. The electro chemical deposition apparatus 1300 has a frame 1326 configured for holding a process electrolyte 1327. A substrate holder 1320 is removably coupled to the frame 1326 and supporting the substrate 1321 so that the process electrolyte 1327 contacts the surface of the substrate 1321. An anode module 1310 is coupled to the frame 1326 and configured for containing an anolyte 1311, the anode module 1310 having a module frame 1380, an anode 1384 and an ion exchange membrane 1390 coupled to the module frame 1380 for removal from and insertion in the frame 1326 as a unit with the anode 1384 and the ion exchange membrane 1390. The ion exchange membrane 1390 is coupled to the module frame being 1380 disposed between the anode 1384 and the surface of the substrate 1321.

In one aspect of the disclosed embodiment, an electro chemical deposition apparatus is provided adapted to deposit metal onto a surface of a substrate. The electro chemical deposition apparatus has a frame configured for holding a process electrolyte. A substrate holder is removably coupled to the frame, the substrate holder supporting the substrate in the process electrolyte. An anode fluid compartment removably coupled to the frame and defining a fluid boundary envelope containing an anolyte in the frame, and separating the anolyte from the process electrolyte, the fluid compartment having within the boundary envelope an anode, facing the surface of the substrate, and an ion exchange membrane, disposed between the anode and the surface of the substrate. The anode fluid compartment fluid boundary envelope being removable from the frame as a unit with the ion exchange membrane and the anode;

In another aspect of the disclosed embodiment, the electro chemical deposition apparatus is provided where the surface of the substrate is in a substantially vertical orientation.

In another aspect of the disclosed embodiment, the electro chemical deposition apparatus is provided where the ion exchange membrane comprises a cationic membrane.

In another aspect of the disclosed embodiment, the electro chemical deposition apparatus is provided where the anode comprises a soluble anode.

In another aspect of the disclosed embodiment, the electro chemical deposition apparatus is provided where the anode comprises an insoluble anode.

In another aspect of the disclosed embodiment, the electro chemical deposition apparatus is provided where the process electrolyte comprises a SnAg bath.

In another aspect of the disclosed embodiment, the electro chemical deposition apparatus is provided where the anode comprises a Sn anode.

In another aspect of the disclosed embodiment, the electro chemical deposition apparatus is provided where the anode comprises a Cu anode.

In another aspect of the disclosed embodiment, the electro chemical deposition apparatus is provided where the ion exchange membrane separates the anolyte from the process electrolyte.

In another aspect of the disclosed embodiment, an electro chemical deposition apparatus is provided adapted to deposit a metal onto a surface of a substrate. The electro chemical deposition apparatus has a frame configured for holding a process electrolyte. A substrate holder is coupled to the frame, the substrate holder supporting the substrate so that the process electrolyte contacts the surface. An anode is coupled to the frame in a anolyte, and an ion exchange membrane is coupled to the frame so that the ion exchange membrane separates the anolyte from the process electrolyte. The ion exchange membrane is supported on a first side by a first membrane support coupled to the frame and having a plurality of first arrayed supports. The ion exchange membrane is supported on a second side by a second membrane support coupled to the frame and having a plurality of second arrayed supports substantially aligned with the plurality of first arrayed supports.

In another aspect of the disclosed embodiment, an electro chemical deposition apparatus is provided where the plurality of first arrayed supports comprises a first array of vertical bars, and where the plurality of second arrayed supports comprises a second array of vertical bars, and wherein the first arrayed vertical bars are substantially aligned with the second arrayed vertical bars.

In another aspect of the disclosed embodiment, an electro chemical deposition apparatus is provided where the substrate holder, the anode and the ion exchange membrane are arranged in the frame so that metal ions pass through the ion exchange membrane into the process electrolyte replenishing metal ions depleted by deposition onto the substrate and wherein the first and second arrayed supports have a configuration that prevents bubble entrapment.

In another aspect of the disclosed embodiment, an electro chemical deposition apparatus is provided where the surface of the substrate is in a substantially vertical orientation.

In another aspect of the disclosed embodiment, an electro chemical deposition apparatus is provided where the ion exchange membrane comprises a cationic membrane.

In another aspect of the disclosed embodiment, an electro chemical deposition apparatus is provided where the anode comprises a soluble Sn anode.

In another aspect of the disclosed embodiment, an electro chemical deposition apparatus is provided where the process electrolyte comprises a SnAg bath.

In another aspect of the disclosed embodiment, an electro chemical deposition apparatus is provided adapted to deposit a metal onto a surface of a substrate. The electro chemical deposition apparatus has a frame configured for holding a process electrolyte. A substrate holder is removably coupled to the frame and supporting the substrate so that the process electrolyte contacts the surface. An anode module is coupled to the frame and configured for containing an anolyte, the anode module having a module frame, an anode and an ion exchange membrane coupled to the module frame for removal from and insertion in the frame as a unit with the anode and the ion exchange membrane. The ion exchange membrane is coupled to the module frame being disposed between the anode and the surface of the substrate.

In another aspect of the disclosed embodiment, an electro chemical deposition apparatus is provided where the substrate holder, the anode and the ion exchange membrane are arranged in the frame so that metal ions pass through the ion exchange membrane into the process electrolyte replenishing metal ions depleted by deposition onto the substrate.

In another aspect of the disclosed embodiment, an electro chemical deposition apparatus is provided where the surface of the substrate is in a substantially vertical orientation.

In another aspect of the disclosed embodiment, an electro chemical deposition apparatus is provided where the ion exchange membrane comprises a cationic membrane.

In another aspect of the disclosed embodiment, an electro chemical deposition apparatus is provided where the anode comprises a soluble anode.

In another aspect of the disclosed embodiment, an electro chemical deposition apparatus is provided where the anode comprises a insoluble anode.

In another aspect of the disclosed embodiment, an electro chemical deposition apparatus is provided where the process electrolyte comprises a SnAg bath.

In another aspect of the disclosed embodiment, an electro chemical deposition apparatus is provided where the anode comprises a Sn anode.

In another aspect of the disclosed embodiment, an electro chemical deposition apparatus is provided where the anode comprises a Cu anode.

In another aspect of the disclosed embodiment, an electro chemical deposition apparatus is provided where the ion exchange membrane separates the anolyte from the process electrolyte.

In another aspect of the disclosed embodiment a process electrolyte replenishment module is provided adapted to replenish ions in a process electrolyte in a substrate electro chemical deposition apparatus having a first anode and a first cathode, the replenishment module having a second anode. The process electrolyte replenishment module has a frame offset from the chemical deposition apparatus. A process electrolyte recirculation compartment is disposed in the frame configured so that the process electrolyte is recirculating between the replenishment module and the deposition apparatus. An anode compartment in the frame is coupled to the process electrolyte recirculation compartment, the anode compartment having the second anode, that is a soluble anode, disposed therein for immersion in a secondary anolyte, and having a first ion exchange membrane separating the secondary anolyte from the process electrolyte, the first ion exchange membrane being a cationic membrane. A cathode compartment is provided in the frame coupled to the process electrolyte recirculation compartment, the cathode compartment having a second cathode disposed therein for immersion in a secondary catholyte, and having a second ion exchange membrane separating the secondary catholyte from the process electrolyte, the second ion exchange membrane being a monovalent selective membrane.

In another aspect of the disclosed embodiment a process electrolyte replenishment module is provided with an agitation member moveably coupled to the frame in the cathode compartment in close proximity to the second cathode to agitate the secondary catholyte proximate the second cathode.

In another aspect of the disclosed embodiment a process electrolyte replenishment module is provided where the soluble second anode and the first ion exchange membrane are arranged so that ions from the soluble second anode pass through the first ion exchange membrane into the process electrolyte.

In another aspect of the disclosed embodiment a process electrolyte replenishment module is provided where the anode comprises a soluble Sn plate.

In another aspect of the disclosed embodiment a process electrolyte replenishment module is provided where the anode comprises soluble Sn pellets.

In another aspect of the disclosed embodiment a process electrolyte replenishment module is provided where the process electrolyte comprises a SnAg bath.

In another aspect of the disclosed embodiment a process electrolyte replenishment module is provided where the process electrolyte comprises a SnAg bath, and wherein ions are replenished in the process electrolyte without Ag contamination of the second anode.

In another aspect of the disclosed embodiment a process electrolyte replenishment module is provided adapted to replenish ions in a process electrolyte in a substrate electro chemical deposition apparatus having a first anode and a first cathode, the replenishment module having a second anode. The process electrolyte replenishment module has a frame offset from the chemical deposition apparatus. A process electrolyte recirculation compartment is disposed in the frame configured so that the process electrolyte is recirculating between the replenishment module and the deposition apparatus. An anode compartment in the frame is coupled to the process electrolyte recirculation compartment, the anode compartment having the second anode, that is a soluble anode, disposed therein for immersion in a secondary anolyte, and having a first ion exchange membrane separating the secondary anolyte from the process electrolyte. A buffer compartment in the frame is coupled to the process electrolyte recirculation compartment, the buffer compartment having a buffer solution therein, and having a second ion exchange membrane separating the buffer solution from the process electrolyte. A cathode compartment in the frame is coupled to the buffer compartment, the cathode compartment having a second cathode disposed therein for immersion in a secondary catholyte, and having a third ion exchange membrane separating the secondary catholyte from the buffer solution.

In another aspect of the disclosed embodiment a process electrolyte replenishment module is provided where the soluble second anode and the first ion exchange membrane are arranged so that ions from the soluble second anode pass through the first ion exchange membrane into the process electrolyte.

In another aspect of the disclosed embodiment a process electrolyte replenishment module is provided where the first ion exchange membrane comprises a cationic membrane.

In another aspect of the disclosed embodiment a process electrolyte replenishment module is provided where the second and third ion exchange membranes comprise second and third monovalent selective membranes.

In another aspect of the disclosed embodiment a process electrolyte replenishment module is provided where the first ion exchange membrane comprises a cationic membrane, and wherein the second and third ion exchange membranes comprise second and third monovalent selective membranes.

In another aspect of the disclosed embodiment a process electrolyte replenishment module is provided where the anode comprises an insoluble anode and soluble Sn pellets.

In another aspect of the disclosed embodiment a process electrolyte replenishment module is provided where the process electrolyte comprises a SnAg bath.

In another aspect of the disclosed embodiment a process electrolyte replenishment module is provided where the first ion exchange membrane selectively passes ions from the anode to the process electrolyte.

In another aspect of the disclosed embodiment a process electrolyte replenishment module is provided where the process electrolyte comprises a SnAg bath, and wherein ions are replenished in the process electrolyte without Ag contamination of the second anode.

In another aspect of the disclosed embodiment a process electrolyte replenishment module is provided adapted to replenish ions in a process electrolyte in a substrate electro chemical deposition apparatus having a first anode and a first cathode, the replenishment module having a second anode. The process electrolyte replenishment module has a frame offset from the chemical deposition apparatus. A process electrolyte recirculation compartment is disposed in the frame configured so that the process electrolyte is recirculating between the replenishment module and the deposition apparatus. An anode compartment in the frame is coupled to the process electrolyte recirculation compartment, the anode compartment having the second anode, that is a soluble anode, disposed therein for immersion in a secondary anolyte, and having a first ion exchange membrane separating the secondary anolyte from the process electrolyte. A buffer compartment in the frame coupled to the process electrolyte recirculation compartment, the buffer compartment having a buffer solution therein, and having a second ion exchange membrane separating the buffer solution from the process electrolyte. A cathode compartment in the frame is coupled to the buffer compartment, the cathode compartment having a second cathode disposed therein for immersion in a secondary catholyte, and having a third ion exchange membrane separating the secondary catholyte from the buffer solution. An ion removal cell is coupled to the buffer compartment. Buffer solution from the buffer compartment is recirculated through the ion removal cell with the ion removal cell removing unwanted ions from the buffer solution.

In another aspect of the disclosed embodiment a process electrolyte replenishment module is provided where the soluble second anode and the first ion exchange membrane are arranged so that ions from the soluble second anode pass through the first ion exchange membrane into the process electrolyte.

In another aspect of the disclosed embodiment a process electrolyte replenishment module is provided where the first ion exchange membrane comprises a cationic membrane.

In another aspect of the disclosed embodiment a process electrolyte replenishment module is provided where the second and third ion exchange membranes comprise second and third monovalent selective membranes.

In another aspect of the disclosed embodiment a process electrolyte replenishment module is provided where the first ion exchange membrane comprises a cationic membrane, and wherein the second and third ion exchange membranes comprise second and third monovalent selective membranes.

In another aspect of the disclosed embodiment a process electrolyte replenishment module is provided where the anode comprises an insoluble anode and soluble Sn pellets.

In another aspect of the disclosed embodiment a process electrolyte replenishment module is provided where the process electrolyte comprises a SnAg bath.

In another aspect of the disclosed embodiment a process electrolyte replenishment module is provided where the first ion exchange membrane selectively passes Sn2+ ions from the anode to the process electrolyte.

In another aspect of the disclosed embodiment a process electrolyte replenishment module is provided where the process electrolyte comprises a SnAg bath, and wherein ions are replenished in the process electrolyte without Ag contamination of the second anode.

In another aspect of the disclosed embodiment an electro chemical deposition apparatus is provided adapted to deposit metal onto a surface of a substrate. The electro chemical deposition apparatus has a deposition module having a deposition module frame configured to hold a process electrolyte. A substrate holder is removably coupled to the deposition module frame, the substrate holder supporting the substrate, the process electrolyte contacting the surface of the substrate, the substrate acting as a first cathode. A first soluble anode is coupled to the deposition module frame. A process electrolyte replenishment module is provided adapted to replenish ions in the process electrolyte, the process electrolyte replenishment module having a replenishment module frame offset from the deposition module. A process electrolyte recirculation compartment is disposed in the replenishment module frame configured so that the process electrolyte is recirculating between the replenishment module and the deposition module. An anode compartment in the replenishment module frame is coupled to the process electrolyte recirculation compartment, the anode compartment having a second soluble anode, disposed therein for immersion in a secondary anolyte, and having a first ion exchange membrane separating the secondary anolyte from the process electrolyte, the first ion exchange membrane being a cationic membrane. A cathode compartment in the replenishment module frame is coupled to the process electrolyte recirculation compartment, the cathode compartment having a second cathode disposed therein for immersion in a secondary catholyte, and having a second ion exchange membrane separating the secondary catholyte from the process electrolyte, the second ion exchange membrane being a monovalent selective membrane. Both the first soluble anode and the second soluble anode replenish ions in the process electrolyte depleted by ion deposition onto the surface.

In another aspect of the disclosed embodiment an electro chemical deposition apparatus is provided with an agitation member moveably coupled to the frame in the cathode compartment in close proximity to the second cathode to agitate the secondary catholyte proximate the second cathode.

In another aspect of the disclosed embodiment an electro chemical deposition apparatus is provided where the deposition module further has a moveable process agitation member moveably coupled to the deposition module frame in close proximity to the surface of the substrate for fluid agitation over the surface of the substrate.

In another aspect of the disclosed embodiment an electro chemical deposition apparatus is provided where the deposition module further has a process ion exchange membrane disposed between the first anode and the surface of the substrate.

In another aspect of the disclosed embodiment an electro chemical deposition apparatus is provided where the surface of the substrate is in a substantially vertical orientation.

In another aspect of the disclosed embodiment an electro chemical deposition apparatus is provided where the process electrolyte comprises a SnAg bath.

In another aspect of the disclosed embodiment an electro chemical deposition apparatus is provided where the first soluble anode comprises a first soluble Sn anode, and wherein the second soluble anode comprises a second soluble Sn anode.

In another aspect of the disclosed embodiment an electro chemical deposition apparatus is provided where the process electrolyte comprises a SnAg bath, and wherein ions are replenished in the process electrolyte without Ag contamination of the second anode.

In another aspect of the disclosed embodiment an electro chemical deposition apparatus is provided adapted to deposit metal onto a surface of a substrate. The electro chemical deposition apparatus has a deposition module having a deposition module frame configured to hold a process electrolyte. A substrate holder is removably coupled to the deposition module frame, the substrate holder supporting the substrate, the process electrolyte contacting the surface of the substrate, the substrate acting as a first cathode. A first soluble anode is coupled to the deposition module frame. A process electrolyte replenishment module is adapted to replenish ions in the process electrolyte, the process electrolyte replenishment module having a replenishment module frame offset from the deposition module. A process electrolyte recirculation compartment is disposed in the replenishment module frame configured so that the process electrolyte is recirculating between the replenishment module and the deposition module. An anode compartment in the replenishment module frame is coupled to the process electrolyte recirculation compartment, the anode compartment having a second soluble anode, disposed therein for immersion in a secondary anolyte, and having a first ion exchange membrane separating the secondary anolyte from the process electrolyte. A buffer compartment in the replenishment module frame is coupled to the process electrolyte recirculation compartment, the buffer compartment having a buffer solution therein, and having a second ion exchange membrane separating the buffer solution from the process electrolyte. A cathode compartment in the replenishment module frame is coupled to the buffer compartment, the cathode compartment having a second cathode disposed therein for immersion in a secondary catholyte, and having a third ion exchange membrane separating the secondary catholyte from the buffer solution. Both the first soluble anode and the second soluble anode replenish ions in the process electrolyte depleted by ion deposition onto the surface.

In another aspect of the disclosed embodiment an electro chemical deposition apparatus is provided having an ion removal cell coupled to the buffer compartment. Buffer solution from the buffer compartment is recirculated through the ion removal cell with the ion removal cell removing unwanted ions from the buffer solution.

In another aspect of the disclosed embodiment an electro chemical deposition apparatus is provided where the deposition module further comprises a moveable process agitation member moveably coupled to the deposition module frame in close proximity to the surface of the substrate for fluid agitation over the surface of the substrate.

In another aspect of the disclosed embodiment an electro chemical deposition apparatus is provided where the deposition module further comprises a process ion exchange membrane disposed between the first anode and the surface of the substrate.

In another aspect of the disclosed embodiment an electro chemical deposition apparatus is provided where the surface of the substrate is in a substantially vertical orientation.

In another aspect of the disclosed embodiment an electro chemical deposition apparatus is provided where the process electrolyte comprises a SnAg bath.

In another aspect of the disclosed embodiment an electro chemical deposition apparatus is provided where the first soluble anode comprises a first soluble Sn anode, and wherein the second soluble anode comprises a second soluble Sn anode.

In another aspect of the disclosed embodiment an electro chemical deposition apparatus is provided where the first ion exchange membrane comprises a cationic membrane, and wherein the second and third ion exchange membranes comprise second and third monovalent selective membranes respectively.

In another aspect of the disclosed embodiment an electro chemical deposition apparatus is provided where the process electrolyte comprises a SnAg bath, and wherein ions are replenished in the process electrolyte without Ag contamination of the second anode.

In another aspect of the disclosed embodiment an electro chemical deposition apparatus is provided adapted to deposit metal onto a surface of a substrate. The electro chemical deposition apparatus has a deposition module having a deposition module frame configured to hold a process electrolyte. A substrate holder is removably coupled to the deposition module frame, the substrate holder supporting the substrate, the process electrolyte contacting the surface of the substrate, the substrate acting as a first cathode. A first soluble anode is coupled to the deposition module frame. The deposition module has a configurable process electrolyte replenishment module interface port configured in a first configuration to interface with a process electrolyte replenishment module and configured in a second configuration to not interface with process electrolyte replenishment module where the process electrolyte replenishment module is not a portion of the electro chemical deposition apparatus. The process electrolyte replenishment module is adapted to replenish ions in the process electrolyte, the process electrolyte replenishment module having a replenishment module frame offset from the deposition module. A process electrolyte recirculation compartment is disposed in the replenishment module frame configured so that the process electrolyte is recirculating between the replenishment module and the deposition module. An anode compartment in the replenishment module frame coupled to the process electrolyte recirculation compartment, the anode compartment having a second soluble anode, disposed therein for immersion in a secondary anolyte, and having a first ion exchange membrane separating the secondary anolyte from the process electrolyte. A cathode compartment in the replenishment module frame is coupled to the process electrolyte recirculation compartment, the cathode compartment having a second cathode disposed therein for immersion in a secondary catholyte, and having a second ion exchange membrane separating the secondary catholyte from the process electrolyte. Both the first soluble anode and the second soluble anode replenish ions in the process electrolyte depleted by ion deposition onto the surface in the first configuration. The first soluble anode replenishes ions in the process electrolyte depleted by ion deposition onto the surface in the second configuration.

In another aspect of the disclosed embodiment an electro chemical deposition apparatus is provided where the configurable process electrolyte replenishment module interface port comprises a process electrolyte inlet port and a process electrolyte outlet port in fluid communication with the deposition module frame, the process electrolyte inlet port and the process electrolyte outlet port coupled in fluid communication with the replenishment module in the first configuration and with the process electrolyte inlet port and the process electrolyte outlet port de-coupled from fluid communication with the replenishment module when in the second configuration.

In another aspect of the disclosed embodiment an electro chemical deposition apparatus is provided where the deposition module further comprises a moveable process agitation member moveably coupled to the deposition module frame in close proximity to the surface of the substrate for fluid agitation over the surface of the substrate.

In another aspect of the disclosed embodiment an electro chemical deposition apparatus is provided where the deposition module further comprises a process ion exchange membrane disposed between the first anode and the surface of the substrate.

In another aspect of the disclosed embodiment an electro chemical deposition apparatus is provided where the surface of the substrate is in a substantially vertical orientation.

In another aspect of the disclosed embodiment an electro chemical deposition apparatus is provided where the process electrolyte comprises a SnAg bath.

In another aspect of the disclosed embodiment an electro chemical deposition apparatus is provided where the first soluble anode comprises a first soluble Sn anode, and wherein the second soluble anode comprises a second soluble Sn anode.

In another aspect of the disclosed embodiment an electro chemical deposition apparatus is provided where the first ion exchange membrane comprises a cationic membrane, and where the second ion exchange membrane comprises a monovalent selective membrane.

In another aspect of the disclosed embodiment an electro chemical deposition apparatus is provided where the process electrolyte comprises a SnAg bath, and wherein ions are replenished in the process electrolyte without Ag contamination of the second anode.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

What is claimed is:

1. An electro chemical deposition apparatus adapted to deposit metal onto a surface of a substrate, the electro chemical deposition apparatus comprising:

a frame configured for holding a process electrolyte;

a substrate holder removably coupled to the frame, the substrate holder supporting the substrate in the process electrolyte; and an anode fluid compartment removably coupled to the frame and defining a fluid boundary envelope containing an anolyte in the frame, and separating the anolyte from the process electrolyte, the fluid compartment having within the boundary envelope an anode, facing the surface of the substrate, and an ion exchange membrane, disposed between the anode and the surface of the substrate, the anode fluid compartment fluid boundary envelope being removable from the frame as a unit with the ion exchange membrane and the anode;

wherein, the holder, the anode and the membrane are arranged in the frame so that ions from the anode pass through the ion exchange membrane into and primarily replenish ions in the process electrolyte depleted by ion deposition onto the surface of the substrate, and wherein the frame includes first and second insert guides in which the anode fluid compartment and substrate holder are insertable within the frame and removable from the frame along the first and second insert guides in a direction parallel to the surface of the substrate.

2. The electro chemical deposition apparatus of claim 1, wherein the surface of the substrate is in a substantially vertical orientation.

3. The electro chemical deposition apparatus of claim 1, wherein the ion exchange membrane comprises a cationic membrane.

4. The electro chemical deposition apparatus of claim 1, wherein the anode comprises a soluble anode.

5. The electro chemical deposition apparatus of claim 1, wherein the anode comprises an inert anode.

6. The electro chemical deposition apparatus of claim 1, wherein the process electrolyte comprises a SnAg bath.

7. The electro chemical deposition apparatus of claim 1, wherein the anode comprises a Sn anode.

8. The electro chemical deposition apparatus of claim 1, wherein the anode comprises a Cu anode.

9. The electro chemical deposition apparatus of claim 1, wherein the ion exchange membrane separates the anolyte from the process electrolyte.

10. The electro chemical deposition apparatus according to claim 1, wherein the anode fluid compartment and substrate holder are retained within the first and second insert guides upon insertion within the frame.

11. An electro chemical deposition apparatus adapted to deposit a metal onto a surface of a substrate, the electro chemical deposition apparatus comprising:

a frame configured for holding a process electrolyte;

a substrate holder coupled to the frame, the substrate holder supporting the substrate so that the process electrolyte contacts the surface of the substrate;

an anode coupled to the frame in an anolyte; and an ion exchange membrane coupled to the frame so that the ion exchange membrane separates the anolyte from the process electrolyte, wherein the ion exchange membrane is supported on a first side by a first membrane support coupled to the frame, the first membrane support including a plurality of first arrayed supports, wherein the ion exchange membrane is supported on a second side by a second membrane support coupled to the frame, the second membrane support including a plurality of second arrayed supports, wherein the plurality of second arrayed supports is substantially aligned with the plurality of first arrayed supports, and wherein the frame includes first and second insert guides in which the anode and substrate holder are insertable within the frame and removable from the frame along the first and second insert guides in a direction parallel to the surface of the substrate.

12. The electro chemical deposition apparatus of claim 11, wherein the plurality of first arrayed supports comprises a first array of vertical bars, and wherein the plurality of second arrayed supports comprises a second array of vertical bars, and wherein the first arrayed vertical bars are substantially aligned with the second arrayed vertical bars.

13. The electro chemical deposition apparatus of claim 11, wherein, the substrate holder, the anode and the ion exchange membrane are arranged in the frame so that metal ions pass through the ion exchange membrane into the process electrolyte replenishing metal ions depleted by deposition onto the substrate and wherein the first and second arrayed supports have a configuration that prevents bubble entrapment.

14. The electro chemical deposition apparatus of claim 11, wherein the surface of the substrate is in a substantially vertical orientation.

15. The electro chemical deposition apparatus of claim 11, wherein the ion exchange membrane comprises a cationic membrane.

16. The electro chemical deposition apparatus of claim 11, wherein the anode comprises a soluble Sn anode.

17. The electro chemical deposition apparatus of claim 11, wherein the process electrolyte comprises a SnAg bath.

18. The electro chemical deposition apparatus according to claim 11, wherein the first membrane support includes an outer frame periphery in contact with the ion exchange membrane in which the plurality of first arrayed supports are contained within the outer frame periphery, and wherein the second membrane support includes an outer frame periphery in contact with the ion exchange membrane in which the second arrayed supports are contained within the outer frame periphery.

19. The electro chemical deposition apparatus according to claim 11, wherein the anode and substrate holder are retained within the first and second insert guides upon insertion within the frame.

20. An electro chemical deposition apparatus adapted to deposit a metal onto a surface of a substrate, the electro chemical deposition apparatus comprising:

a frame configured for holding a process electrolyte;

a substrate holder removably coupled to the frame and supporting the substrate so that the process electrolyte contacts the surface;

an anode module coupled to the frame and configured for containing an anolyte, the anode module having a module frame, an anode and an ion exchange membrane coupled to the module frame for removal from and insertion in the frame as a unit with the anode and the ion exchange membrane;

the ion exchange membrane coupled to the module frame being disposed between the anode and the surface of the substrate; and wherein the frame includes first and second insert guides in which the anode module and substrate holder are insertable within the frame and removable from the frame along the first and second insert guides in a direction parallel to the surface of the substrate.

21. The electro chemical deposition apparatus of claim 20, wherein, the substrate holder, the anode and the ion exchange membrane are arranged in the frame so that metal ions pass through the ion exchange membrane into the process electrolyte replenishing metal ions depleted by deposition onto the substrate.

22. The electro chemical deposition apparatus of claim 20, wherein the surface of the substrate is in a substantially vertical orientation.

23. The electro chemical deposition apparatus of claim 20, wherein the ion exchange membrane comprises a cationic membrane.

24. The electro chemical deposition apparatus of claim 20, wherein the anode comprises soluble anode.

25. The electro chemical deposition apparatus of claim 20, wherein the anode comprises an inert anode.

26. The electro chemical deposition apparatus of claim 20, wherein the process electrolyte comprises a SnAg bath.

27. The electro chemical deposition apparatus of claim 20, wherein the anode comprises a Sn anode.

28. The electro chemical deposition apparatus of claim 20, wherein the anode comprises a Cu anode.

29. The electro chemical deposition apparatus of claim 20, wherein the ion exchange membrane separates the anolyte from the process electrolyte.

30. The electro chemical deposition apparatus according to claim 20, wherein the anode module and substrate holder are retained within the first and second insert guides upon insertion within the frame.

* * * * *